US008578974B2

(12) United States Patent
Bonner

(10) Patent No.: US 8,578,974 B2
(45) **Date of Patent: *Nov. 12, 2013**

(54) PORTABLE FLUID EXCHANGE SYSTEM FOR CONCURRENTLY PUMPING LIQUID FROM A SOURCE CONTAINER TO A DESTINATION CONTAINER AND PUMPING VAPOR FROM THE DESTINATION CONTAINER TO THE SOURCE CONTAINER

(75) Inventor: Mark Bonner, Frenchtown, NJ (US)

(73) Assignee: Fuel Transfer Technologies Inc., Moncton, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/475,283

(22) Filed: May 18, 2012

(65) Prior Publication Data

US 2012/0227863 A1 Sep. 13, 2012

Related U.S. Application Data

(63) Continuation of application No. 11/779,882, filed on Jul. 18, 2007, now Pat. No. 8,201,588.

(60) Provisional application No. 60/831,559, filed on Jul. 18, 2006.

(51) Int. Cl.
*B65B 31/00* (2006.01)

(52) U.S. Cl.
USPC ..... 141/59; 141/198; 141/290; 141/382; 222/318; 222/424; 417/534

(58) Field of Classification Search
USPC ..... 141/59, 198, 206, 231, 285, 286, 291, 141/292, 301, 302, 382, 389; 222/318, 401, 222/424; 417/528, 534–537
See application file for complete search history.

(56) References Cited

U.S. PATENT DOCUMENTS 330,540 A 11/1885 Worthington
1,564,617 A 12/1925 Pepper (Continued)

FOREIGN PATENT DOCUMENTS

WO 2004080884 A2 9/2004

OTHER PUBLICATIONS

Khan, Konika—Australian Patent Office, "Examination Report" for corresponding Australian Patent Application No. 2007276622, dated Feb. 21, 2011, Australia.

(Continued)

*Primary Examiner* — Jason K Niesz
(74) *Attorney, Agent, or Firm* — Norton Rose Fulbright Canada LLP

(57) ABSTRACT

A portable fluid exchange system comprises a source container, a liquid and vapor pump for pumping liquid from the source container to the destination container and for pumping vapor from the destination container to the source container. The liquid inlet and vapor outlets of the liquid and vapor pump are connected in fluid communication with the source container. A liquid delivery hose delivers liquid from the pump to the destination container. A vapor delivery hose delivers vapor from the destination container to the pump. A selectively controllable actuation mechanism actuates the liquid and vapor pump to thereby concurrently pump liquid from the liquid and vapor pump through the liquid outlet and vapor into the liquid and vapor pump through the vapor inlet, and concurrently pump vapor from the liquid and vapor pump through the vapor outlet and liquid into the liquid and vapor pump through the liquid inlet.

20 Claims, 59 Drawing Sheets

(56) References Cited

U.S. PATENT DOCUMENTS

| | | | | |
|---|---|---|---|---|
| 4,449,827 | A * | 5/1984 | Karkiewicz | 366/131 |
| 4,947,491 | A | 8/1990 | Parkinson et al. | |
| 4,972,972 | A | 11/1990 | Goguen | |
| 5,711,355 | A | 1/1998 | Kowalczyk | |
| 6,056,028 | A | 5/2000 | Crawford | |
| 6,412,528 | B1 | 7/2002 | Alex et al. | |
| 6,619,341 | B2 | 9/2003 | Cushing | |
| 6,766,838 | B1 | 7/2004 | Zywicki | |
| 6,945,286 | B2 * | 9/2005 | Freeman | 141/59 |
| D516,673 | S | 3/2006 | Chisholm et al. | |
| 7,793,801 | B2 | 9/2010 | Drummond | |
| 2004/0079439 | A1 | 4/2004 | Freeman | |
| 2006/0086411 | A1 | 4/2006 | Luca | |
| 2009/0045216 | A1 | 2/2009 | Mamaghani | |

OTHER PUBLICATIONS

Fisher Adams Kelly, "Response to Examination Report" for corresponding Australian Patent Application No. 2007276622, dated Jul. 18, 2012, Australia.

Muller, Claus—European Patent Office, "Extended European Search Report" for corresponding European Patent Application No. 07800427.2, dated Jan. 24, 2012, Germany.

Huber & Schussler, "Response to Extended European Search Report" for corresponding European Patent Application No. 07800427.2, dated Aug. 13, 2012, Germany.

Hijazi, Mazen—Canadian Intellectual Property Office, "Examiner's Requisition" for corresponding Canadian Patent Application No. 2,594,995, dated Dec. 16, 2010, Canada.

Andrews Robichaud, "Response to Examiner's Requisition" for corresponding Canadian Patent Application No. 2,594,995, dated Jun. 16, 2011, Canada.

Lohani, Pritesh—Intellectual Property Office of New Zealand, "Examination Report" for corresponding New Zealand Patent Application No. 574937, dated Jul. 23, 2010, New Zealand.

Fisher Adams Kelly, "Response to Examination Report" for corresponding New Zealand Patent Application No. 574937, dated Oct. 20, 2011, Australia.

Khan, Konika —Australian Patent Office, "Examination Report" for corresponding Australian Patent Application No. 2007276622, dated Aug. 17, 2012, Australia.

Fisher Adams Kelly, "Response to Examiner's Second Report" for corresponding Australian Patent Application No. 2007276622, dated Nov. 15, 2012, Australia.

* cited by examiner

PORTABLE FLUID EXCHANGE SYSTEM FOR CONCURRENTLY PUMPING LIQUID FROM A SOURCE CONTAINER TO A DESTINATION CONTAINER AND PUMPING VAPOR FROM THE DESTINATION CONTAINER TO THE SOURCE CONTAINER

This application is a non-provisional application claiming priority to U.S. provisional patent application Ser. No. 60/831,559 filed on Jul. 18, 2006, which is herein incorporated by reference.

FIELD OF THE INVENTION

The present invention relates to fluid exchange systems for pumping liquid from a source container to a destination container and concurrently pumping vapor from said destination container to said source container, and more particularly to portable fluid exchange systems for pumping liquid from a source container to a destination container and concurrently pumping vapor from said destination container to said source container.

BACKGROUND OF THE INVENTION

It is common to store liquids, such as fuel, in portable containers for subsequent delivery into a destination container or the like. One example of such a portable container is a portable fuel container, made for carrying petroleum based products, such as fuel, and typically made from a petroleum resistant plastic material. Various types of these containers are well known in the prior art and are readily available. The destination container might be another portable fuel container, or the fuel tank of an apparatus having an external combustion engine, such as a vehicle, a boat, a lawn mower, and so on.

In many prior art portable fuel containers, a rigid nozzle or spout is securely attached thereto at an upper outlet. In order to deliver liquid from the portable container, the portable container is lifted and tilted, so the rigid nozzle or spout can be inserted into the inlet of the destination container, and liquid is poured from the spout into the destination container.

Some recently introduced portable containers have an fuel delivery hose attached to the portable fuel container at an outlet, with a nozzle and spout attached to the free end of the hose. An optional pump may be included in-line with the hose, nozzle and spout. In use, the spout is inserted into the inlet of the destination container, and liquid is delivered from the source container, namely the portable fuel container to the destination container, typically by means of siphoning or pumping.

One problem that exists with the use of such portable fuel containers is that vapour from the delivered liquid, especially liquid fuel, which evaporates quite readily, tends to escape from the destination container. In the case of transferring liquid fuel, this is highly undesirable. Indeed, it is believed that legislation exists, or is about to be enacted, in some jurisdictions, to require the recovery of vapour when delivering liquid fuel from a portable fuel container.

In a co-pending patent application by the same inventor, it is taught to have a flexible vapor recovery hose connected to the source container in addition to a flexible liquid delivery hose. The flexible vapor recovery hose is connected at its proximal end to the source container so as to be in fluid communication with the interior of the container. The distal end of the flexible vapor recovery hose either terminates adjacent the outlet end of the liquid delivery hose, the nozzle's spout, or may attach in vapor receiving relation to a separate vapor flow channel of the spout, which has its intake adjacent the liquid outlet end of the spout. Vapor recovery is accomplished by means of the reduced air pressure in the substantially hollow interior of the portable fuel container, which results from the removal of the liquid from the substantially hollow interior of the portable fuel container. This reduced air pressure causes vapor to be suctioned via the elongate flexible vapor recovery hose into the substantially hollow interior of the portable fuel container.

The problem with this method of vapor recovery is that there can be a significant delay in the start of the vapor recovery process. With volatile chemicals, such as liquid fuel, pressure can build up within the source container due to a higher atmospheric temperature or a decreased atmospheric pressure. This increased pressure within the source container would need to be relieved before the vapor would begin to be suctioned into the portable fuel container. Additionally, there is a head pressure associated with the amount of fuel within the container that will also need to be overcome before vapor would be suctioned into the portable fuel container.

In this hose system for fuel delivery and vapor recovery, the vapor recovery will only begin to occur at the point where the pressure within the container is relieved and the negative pressure within the container becomes low enough to overcome the head pressure of the liquid within the container, which means some of the environmentally harmful vapor displaced in the receiving fuel tank would not be recovered and would be released into the atmosphere.

Currently, there are some prior art fuel containers that accomplish vapor recovery in the above described manner, utilizing a standard spout. These containers have only one opening through which the liquid fuel flows out and through which the vapor flows back into the container. In these instances, the same spout is used to deliver liquid fuel and to recover the displaced vapor. These systems have the same shortcoming as the hosing system mentioned above in that there can be a significant delay in time between the fuel flowing out of the container and the vapor being drawn into the container, depending on the pressure and volume of liquid within the container.

U.S. Pat. No. 6,899,149 issued May 31, 2005 to Hartsell Jr., et al, discloses a Vapor Recovery Fuel Dispenser for Multiple Hoses. This dispenser is for dispensing volatile liquids such as hydrocarbon fuel for vehicles into a tank having a filler neck. It also collects the vapors generated by the dispensing to reduce atmospheric pollution. A fuel delivery hose includes a hand-held fuel valve and nozzle for insertion in the filler neck of a fuel tank or the like. An in-ground pump delivers fuel under pressure to the fuel delivery hose. A flow meter provides electrical pulses corresponding to the volumetric flow of liquid through the fuel delivery hose when the fuel valve is open. A micro-processor produces the signal applied to the vapor motor in response to the electrical pulses resulting from the flow of liquid to produce a volumetric flow of vapor corresponding to the volumetric flow of fuel to the tank. A vapor recovery hose includes a vapor intake connected to the hand-held nozzle for insertion in the filler neck of a fuel tank or the like. A separate above-ground motor-driven vapor pump produces a volumetric flow through the vapor recovery hose corresponding to the signal produced by the microprocessor and applied to the motor. The system as described in U.S. Pat. No. 6,899,149 has a number of drawbacks associated with it. Primarily, it is not portable and it is not manually powered. It is also expensive to manufacture and install. The dispensing system also absolutely requires electricity to operate, no matter what configuration of it might be used.

Further, it is complicated in terms of its functionality. It relies on feedback from measurements of the flow of the fuel being pumped to cause vapor to be pumped. Accordingly, the pumping of the vapor could be significantly different than the pumping of the fuel, such as in situations where the interaction between the fuel flow measuring device and the fuel is not as expected.

It is an object of the present invention to provide a portable fluid exchange system for concurrently pumping liquid from a source container to a destination container and pumping vapor from said destination container to said source container.

It is an object of the present invention to provide a portable fluid exchange system for concurrently pumping liquid from a source container to a destination container and pumping vapor from said destination container to said source container, wherein the portable fluid exchange system can be manually powered.

It is an object of the present invention to provide a portable fluid exchange system for concurrently pumping liquid from a source container to a destination container and pumping vapor from said destination container to said source container, wherein the portable fluid exchange system is inexpensive to manufacture.

It is a further object of the present invention to provide a portable fluid exchange system that also suctions vapor displaced by the liquid, wherein the portable fluid exchange system does not need to be powered by electricity.

It is a further object of the present invention to provide a portable fluid exchange system that also suctions vapor displaced by the liquid, wherein the portable fluid exchange system is simple and uncomplicated.

It is a further object of the present invention to provide a portable fluid exchange system that also suctions vapor displaced by the liquid, wherein the portable fluid exchange system does not require feedback in order to operate.

It is a further object of the present invention to provide a portable fluid exchange system that also suctions vapor displaced by the liquid, wherein the pumping of vapor does not rely on certain conditions of the liquid flow to exist and be measured.

It is a further object of the present invention to provide a portable fluid exchange system that also suctions vapor displaced by the liquid, wherein the recovery of vapor is not dependent on the negative pressure within the portable fuel container.

It is a further object of the present invention to provide a portable fluid exchange system that also suctions vapor displaced by the liquid, wherein there is no significant delay in time between the fuel flowing out of the portable fuel container and the vapor being recovered into the container.

It is a further object of the present invention to provide a portable fluid exchange system that also suctions vapor displaced by the liquid, wherein the portable fluid exchange system is manually transportable by a single individual.

SUMMARY OF THE INVENTION

In accordance with one aspect of the present invention there is disclosed a novel portable fluid exchange system for concurrently pumping liquid from a source container to a destination container and pumping vapor from the destination container to the source container. The portable fluid exchange system comprises a source container having a substantially hollow interior for retaining liquid and vapor therein. There is a liquid and vapor pumping means for pumping liquid from the source container to the destination container and for pumping vapor from the destination container to the source container, The liquid and vapor pumping means has a liquid inlet, a liquid outlet, a vapor inlet and a vapor outlet. The liquid inlet and the vapor outlet of the liquid and vapor pumping means are connected in fluid communication with the substantially hollow interior of the source container. A liquid delivery means is for delivering liquid from the liquid and vapor pumping means to the destination container. A vapor delivery means is for delivering vapor from the destination container to the liquid and vapor pumping means. A selectively controllable actuation mechanism is for actuating the liquid and vapor pumping means to thereby concurrently pump liquid from the liquid and vapor pumping means through the liquid outlet and vapor into the liquid and vapor pumping means through the vapor inlet, and concurrently pump vapor from the liquid and vapor pumping means through the vapor outlet and liquid into the liquid and vapor pumping means through the liquid inlet.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter of which is briefly described herein below.

1. A portable fluid exchange system for concurrently pumping liquid from a source container to a destination container and pumping vapor from said destination container to said source container, said portable fluid exchange system comprising: a source container having a substantially hollow interior for retaining liquid and vapor therein; a liquid and vapor pumping means for pumping liquid from said source container to said destination container and for pumping vapor from said destination container to said source container, and having a liquid inlet, a liquid outlet, a vapor inlet and a vapour outlet; wherein said liquid inlet and said vapor outlet of said liquid and vapor pumping means are connected in fluid communication with said substantially hollow interior of said source container; liquid delivery means for delivering liquid from said liquid and vapor pumping means to said destination container; vapor delivery means for delivering vapor from said destination container to said liquid and vapor pumping means; and, a selectively controllable actuation mechanism for actuating said liquid and vapor pumping means to thereby concurrently pump liquid from said liquid and vapor pumping means through said liquid outlet and vapor into said liquid and vapor pumping means through said vapor inlet, and concurrently pump vapor from said liquid and vapor pumping means through said vapor outlet and liquid into said liquid and vapor pumping means through said liquid inlet.

2. The portable fluid exchange system of claim 1, wherein said liquid and vapor pumping means comprises a liquid pumping portion and a vapor pumping portion fluidically isolated one from the other.

3. The portable fluid exchange system of claim 2, wherein said selectively controllable actuation mechanism concurrently pumps vapor from said vapor pumping portion through said vapor outlet and liquid into said liquid pumping portion through said liquid inlet, and alternatingly concurrently pumps liquid from said liquid pumping portion through said liquid outlet and vapor into said vapor pumping portion through said vapor inlet.

4. The portable fluid exchange system of claim 3, wherein said liquid pumping portion and said vapor pumping portion are fluidically isolated one from the other by a pumping mechanism movable to vary the internal volume of each of said liquid pumping portion and said vapor pumping portion.

5. The portable fluid exchange system of claim 4, wherein the internal volume of said liquid pumping portion is variable, via pumping movement of said pumping mechanism, between a full configuration and a reduced configuration wherein the internal volume of said liquid pumping portion is less than in the full configuration.

6. The portable fluid exchange system of claim 5, wherein the internal volume of said vapor pumping portion is variable, via pumping movement of said pumping mechanism, between a full configuration and a reduced configuration wherein the internal volume of said vapor pumping portion is less than in the full configuration.

7. The portable fluid exchange system of claim 4, wherein said liquid and vapor pumping means comprises a main body having a substantially hollow chamber.

8. The portable fluid exchange system of claim 7, wherein said pumping mechanism comprises a movable pumping member disposed within said substantially hollow chamber so as to divide said substantially hollow chamber into said variable volume liquid pumping portion and said variable volume vapor pumping portion.

9. The portable fluid exchange system of claim 8, wherein said movable pumping member comprises a piston.

10. The portable fluid exchange system of claim 9, wherein said selectively controllable actuation mechanism comprises a piston rod member operatively connected to said piston.

11. The portable fluid exchange system of claim 10, wherein said piston rod member includes a throughpassage that permits said variable volume liquid pumping portion to be in fluid communication with one of said liquid inlet and said liquid outlet.

12. The portable fluid exchange system of claim 10, wherein said piston rod member includes a throughpassage that permits said variable volume vapor pumping portion to be in fluid communication with one of said vapor inlet and said vapor outlet.

13. The portable fluid exchange system of claim 4, wherein said pumping mechanism comprises a resiliently deformable pumping member disposed within said substantially hollow chamber so as to divide said substantially hollow chamber into said variable volume liquid pumping portion and said variable volume vapor pumping portion.

14. The portable fluid exchange system of claim 13, wherein said selectively controllable actuation mechanism comprises a rod member operatively connected to said resiliently deformable pumping member.

15. The portable fluid exchange system of claim 14, wherein said rod includes a throughpassage that permits said variable volume liquid pumping portion to be in fluid communication with one of said liquid inlet and said liquid outlet.

16. The portable fluid exchange system of claim 14, wherein said rod includes a throughpassage that permits said variable volume vapor pumping portion to be in fluid communication with one of said vapor inlet and said vapor outlet.

17. The portable fluid exchange system of claim 14, further comprising a plate member secured to said resiliently deformable pumping member for movement therewith and wherein said rod member is operatively connected to said plate member for movement therewith.

18. The portable fluid exchange system of claim 13, wherein said resiliently deformable pumping member comprises a bellows member.

19. The portable fluid exchange system of claim 1, wherein said liquid and vapor pumping means comprises a liquid pumping means having said liquid inlet and said liquid outlet, and a vapour pumping means having said vapor inlet and said vapor outlet.

20. The portable fluid exchange system of claim 19, wherein said selectively controllable actuation mechanism concurrently pumps vapor from said vapor pumping means through said vapor outlet and liquid into said liquid pumping means through said liquid inlet, and alternatingly concurrently pumps liquid from said liquid pumping means through said liquid outlet and vapor into said vapour pumping means through said vapor inlet.

21. The portable fluid exchange system of claim 20, wherein said liquid pumping means comprises a resiliently deformable liquid pumping member having a substantially hollow interior, and said vapor pumping means comprises a resiliently deformable vapour pumping member having a substantially hollow interior.

22. The portable fluid exchange system of claim 21, wherein said resiliently deformable liquid pumping member is resiliently deformable between a full configuration and a reduced configuration wherein the internal volume of the resiliently deformable liquid pumping member is less than in the full configuration, and wherein said selectively controllable actuation mechanism causes the deformation of said resiliently deformable liquid pumping member.

23. The portable fluid exchange system of claim 22, wherein said resiliently deformable vapor pumping member is resiliently deformable between a full configuration and a reduced configuration wherein the internal volume of the resiliently deformable vapour pumping member is less than in the full configuration, and wherein said selectively controllable actuation mechanism causes the deformation of said resiliently deformable vapor pumping member.

24. The portable fluid exchange system of claim 23, wherein said selectively controllable actuation mechanism physically interconnects said resiliently deformable liquid pumping member and said resiliently deformable vapor pumping member.

25. The portable fluid exchange system of claim 23, wherein said selectively controllable actuation mechanism is movable in a cyclical motion when actuating said resiliently deformable liquid pumping member and said resiliently deformable vapor pumping member.

26. The portable fluid exchange system of claim 25, wherein said selectively controllable actuation mechanism is movable through one cycle of said cyclical motion when actuating said resiliently deformable liquid pumping member from said full configuration through said reduced configuration and back to said full configuration.

27. The portable fluid exchange system of claim 26, wherein said selectively controllable actuation mechanism is movable through one cycle of said cyclical motion when actuating said resiliently deformable vapor pumping member from said reduced configuration through said full configuration and back to said reduced configuration.

28. The portable fluid exchange system of claim 27, wherein in one cycle of said selectively controllable actuation mechanism, the volume of liquid pumped by said liquid pumping portion is equal to the volume of vapor pumped by said vapor pumping portion.

29. The portable fluid exchange system of claim 23, wherein said resiliently deformable liquid pumping member comprises a liquid pumping resiliently deformable force cup and said resiliently deformable vapor pumping member comprises a vapor pumping resiliently deformable force cup.

30. The portable fluid exchange system of claim 29, wherein, when said liquid pumping resiliently deformable force cup is in said full configuration, said vapor pumping resiliently deformable force cup is in said reduced configuration, and when said vapor pumping resiliently deformable force cup is in said full configuration, said liquid pumping resiliently deformable force cup is in said reduced configuration.

31. The portable fluid exchange system of claim 23, wherein said resiliently deformable liquid pumping member comprises a liquid pumping resiliently deformable bellows member and said resiliently deformable vapor pumping member comprises a vapor pumping resiliently deformable bellows member.

32. The portable fluid exchange system of claim 31, wherein, when said liquid pumping resiliently deformable bellows member is in said full configuration, said vapor pumping resiliently deformable bellows member is in said reduced configuration, and when said vapor pumping resiliently deformable bellows member is in said full configuration, said liquid pumping resiliently deformable bellows member is in said reduced configuration.

33. The portable fluid exchange system of claim 1, wherein said selectively controllable actuation mechanism causes said concurrent pumping of liquid from said liquid and vapor pumping means through said liquid outlet and vapor into said liquid and vapor pumping means through said vapor inlet, at an equal rate one to the other.

34. The portable fluid exchange system of claim 23, wherein the volume of said substantially hollow interior of said resiliently deformable liquid pumping member in said full configuration is substantially equal to the volume of said substantially hollow interior of said resiliently deformable vapor pumping member in said full configuration.

35. The portable fluid exchange system of claim 34, wherein said resiliently deformable liquid pumping member and said resiliently deformable vapor pumping member are substantially identical one to the other.

36. The portable fluid exchange system of claim 1, wherein said liquid delivery means comprises an elongate flexible liquid delivery hose having a liquid inlet and a liquid outlet.

37. The portable fluid exchange system of claim 36, wherein said elongate flexible liquid delivery hose is in fluid communication at said liquid inlet with the liquid outlet of said liquid and vapour pumping means for receiving liquid from said liquid and vapour pumping means, and in fluid communication at said liquid outlet with said destination container for delivering the received liquid to said destination container.

38. The portable fluid exchange system of claim 37, wherein said vapor delivery means comprises an elongate flexible vapor recovery hose having a vapor inlet and a vapor outlet.

39. The portable fluid exchange system of claim 38, wherein said elongate flexible vapor recovery hose is in fluid communication at said vapor inlet with said destination container for receiving vapor from said destination container, and being in fluid communication at said vapor outlet with said vapor inlet of said liquid and vapor pumping means for delivering the received vapor to said liquid and vapor pumping means.

40. The portable fluid exchange system of claim 39, wherein said elongate flexible liquid delivery hose and said elongate flexible vapor recovery hose permit the movement of said liquid outlet of said elongate flexible liquid delivery hose to said destination container while said source container remains substantially stationary, to thereby permit the delivery of said liquid to said destination container.

41. The portable fluid exchange system of claim 39, wherein said elongate flexible liquid delivery hose and said elongate flexible vapor recovery hose together comprise a two line hose.

42. The portable fluid exchange system of claim 41, wherein said elongate flexible liquid delivery hose and said elongate flexible vapor recovery hose are integrally formed one with the other.

43. The portable fluid exchange system of claim 39, further comprising a nozzle-and-spout assembly, wherein said liquid outlet of said elongate flexible liquid delivery hose is operatively connected in supported relation to said nozzle-and-spout assembly, and said vapor inlet of said elongate flexible vapor recovery hose is operatively connected in supported relation to said elongate flexible liquid delivery hose.

44. The portable fluid exchange system of claim 43, wherein said elongate flexible liquid delivery hose is operatively connected at said liquid outlet in liquid delivery relation to said nozzle-and-spout assembly and said elongate flexible vapor recovery hose is operatively connected in vapor receiving relation at said vapor inlet to said nozzle-and-spout assembly.

45. The portable fluid exchange system of claim 44, wherein said nozzle-and-spout assembly receives liquid from the liquid outlet of said elongate flexible liquid delivery hose and dispenses said liquid to said destination container and receive vapor from said destination container and conveys said vapor to said vapor inlet of said elongate flexible vapor delivery hose.

46. The portable fluid exchange system of claim 44, wherein said nozzle-and-spout assembly comprises an auto-shutoff mechanism.

47. The portable fluid exchange system of claim 44, wherein said nozzle-and-spout assembly comprises an auto-closure mechanism.

48. The portable fluid exchange system of claim 1, wherein said selectively controllable actuation mechanism comprises a pedal member.

49. The portable fluid exchange system of claim 5, wherein said actuation means further comprises a biasing means for biasing said liquid pumping portion to said full configuration.

50. The portable fluid exchange system of claim 23, wherein said actuation means further comprises a biasing means for biasing said liquid pumping portion to said full configuration.

51. The portable fluid exchange system of claim 1, wherein said selectively controllable actuation mechanism comprises a rocker arm.

52. The portable fluid exchange system of claim 2, wherein said selectively controllable actuation mechanism is movable in a rotary motion to actuate said liquid and vapor pumping means.

53. The portable fluid exchange system of claim 51, wherein said selectively controllable actuation mechanism comprises a selectively rotatable cam member.

54. The portable fluid exchange system of claim 51, wherein said liquid pumping portion comprises a first rotary pump and said vapour pumping portion comprises a second rotary pump.

55. The portable fluid exchange system of claim 52, wherein said liquid and vapor pumping means comprises at least one peristaltic pump.

56. The portable fluid exchange system of claim 1, further comprising attachment means for connecting in fluid communication at least one of said liquid inlet and said vapor outlet with the interior of a source container or connecting in fluid communication at least one of said liquid outlet and said vapor inlet with the interior of said destination container.

57. The portable fluid exchange system of claim 1, further comprising attachment means for attaching said liquid and vapour pumping means to said source container or said destination container such that said liquid inlet and said vapor outlet are in fluid communication with the interior of said source container or said liquid outlet and said vapor inlet are in fluid communication with the interior of said destination container.

58. The portable fluid exchange system of claim 1, further comprising a mounting means for mounting said portable fluid exchange system at least substantially within the interior of said source container or said destination container.

59. The portable fluid exchange system of claim 1, wherein said selectively controllable actuation mechanism is manually powered.

60. The portable fluid exchange system of claim 59, wherein said selectively controllable actuation mechanism comprises a handle member.

BRIEF DESCRIPTION OF THE DRAWINGS

The novel features which are believed to be characteristic of the portable fluid exchange system for concurrently pumping liquid from a source container to a destination container and pumping vapor from the destination container to the source container according to the present invention, as to its structure, organization, use and method of operation, together with further objectives and advantages thereof,
will be better understood from the following drawings in which a presently preferred embodiment of the invention will now be illustrated by way of example. It is expressly understood, however, that the drawings are for the purpose of illustration and description only, and are not intended as a definition of the limits of the invention. In the accompanying drawings.

DETAILED DESCRIPTION OF THE PREFERRED EMBODIMENTS

Figure 33:
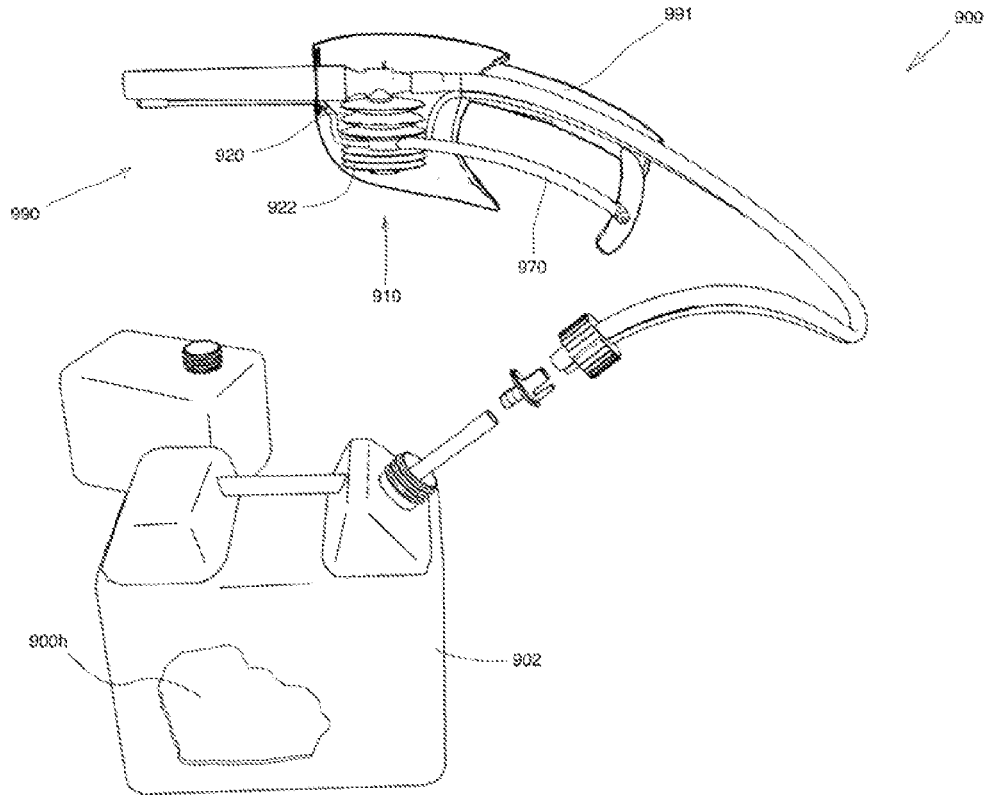
FIG. 33 is a partially cut-away perspective view of the ninth preferred embodiment of the portable fluid exchange system according to the present invention, about to be used to pump fuel from a portable fuel container type of source container to a portable fuel container type of destination container.
Figure 34:
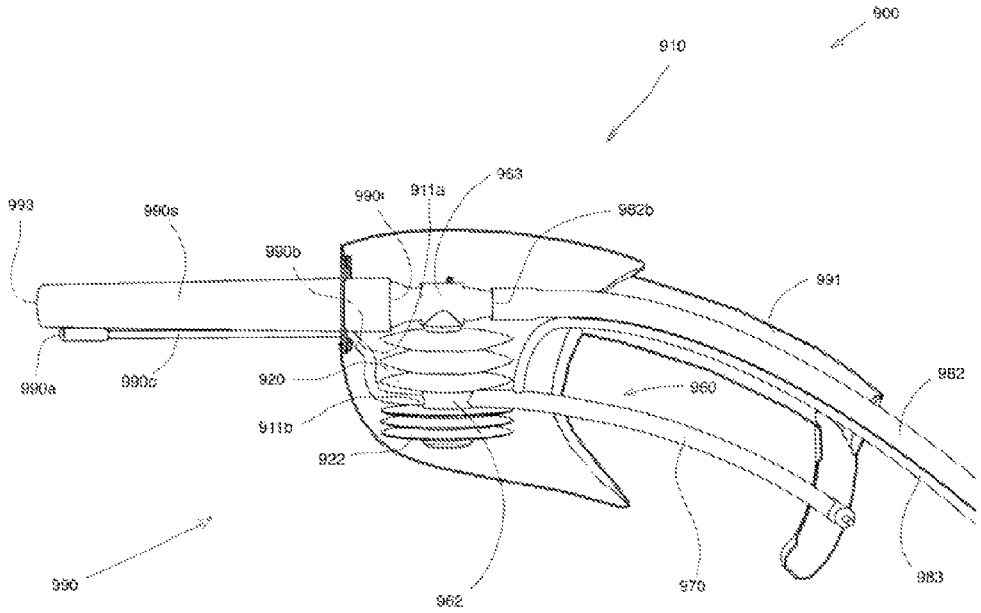
FIG. 34 is a partially cut-away side elevational view of the ninth preferred embodiment portable fluid exchange system of FIG. 33, with the resiliently deformable liquid pumping member in its full configuration and the resiliently deformable vapor pumping member is in its reduced configuration.
Figure 35:
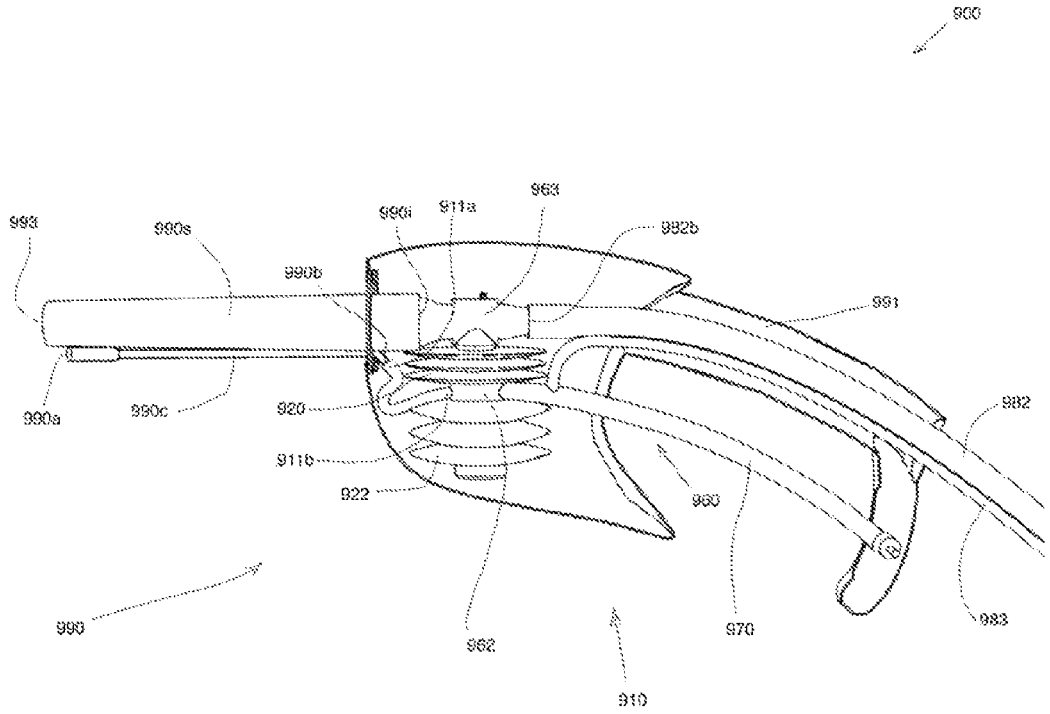
FIG. 35 is a partially cut-away side elevational view similar to FIG. 34, but with the resiliently deformable liquid pumping member in its reduced configuration and the resiliently deformable vapor pumping member is in its full configuration.
Figure 36:
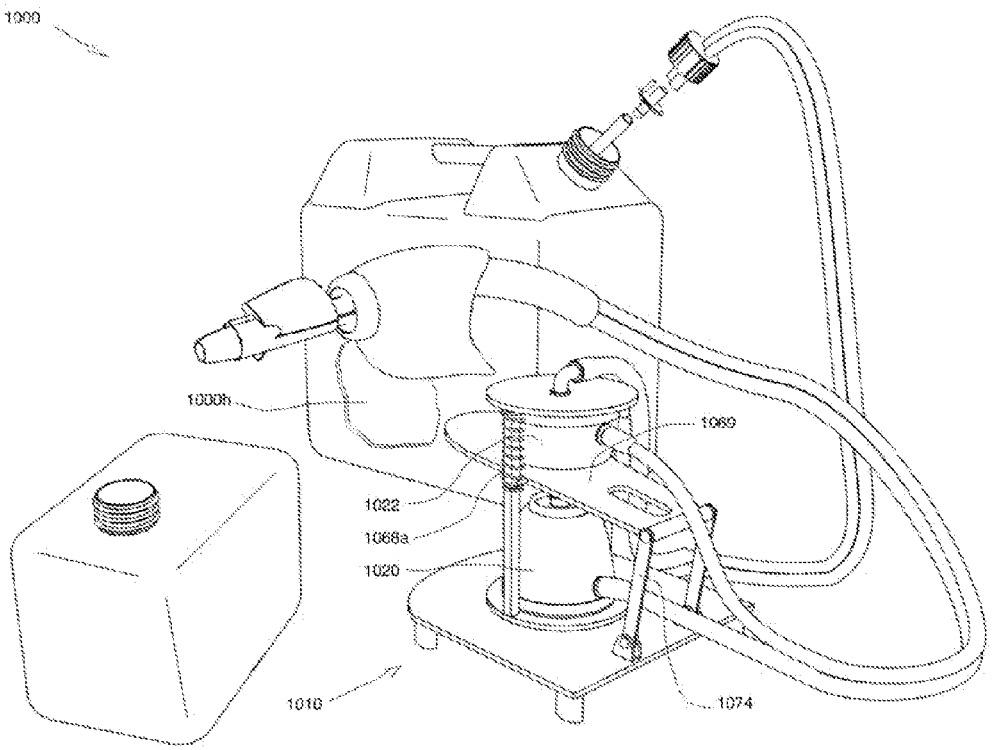
FIG. 36 is a perspective view from above of the tenth preferred embodiment of the portable fluid exchange system according to the present invention, about to be used to pump fuel from a portable fuel container type of source container to a portable fuel container type of destination container.
Figure 37:
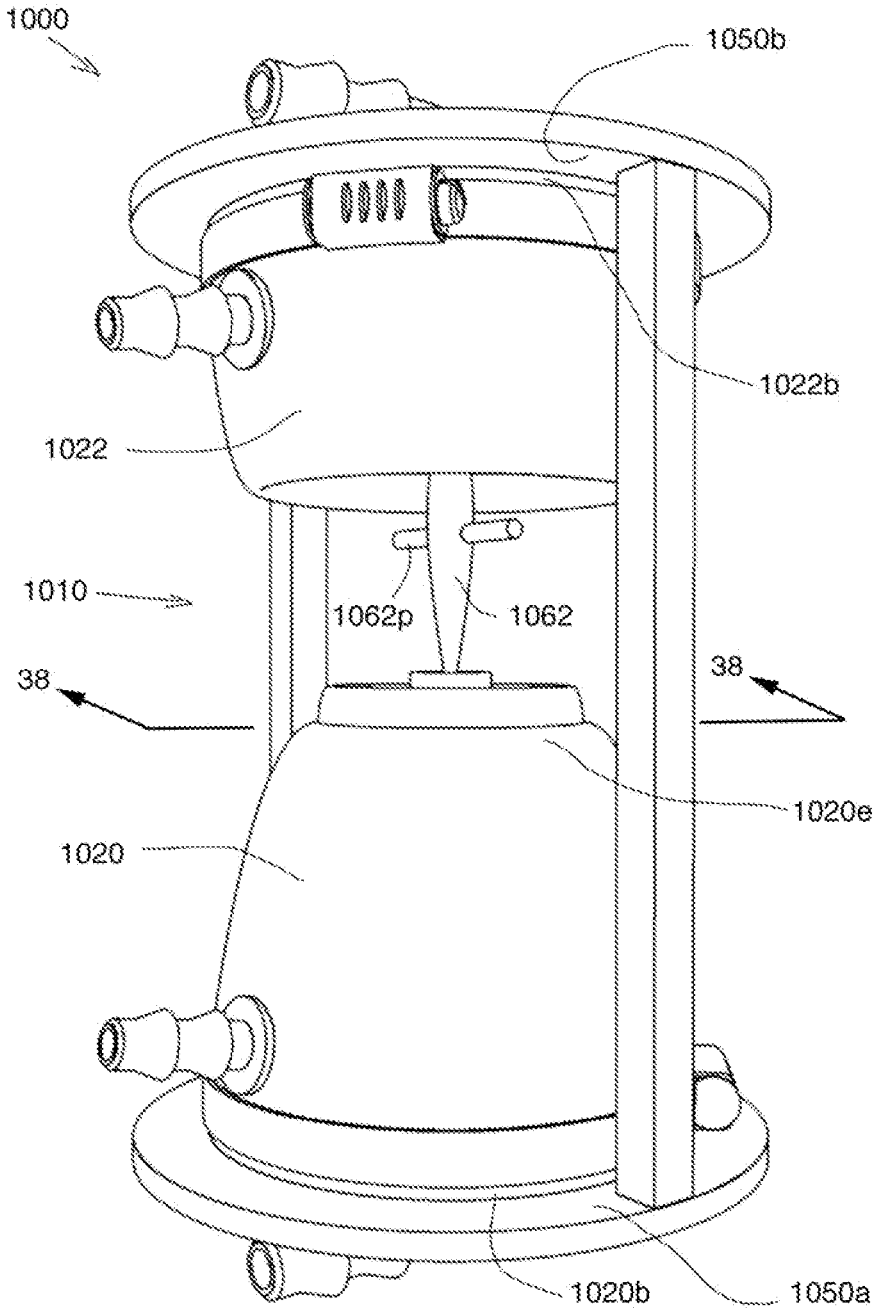
FIG. 37 is a side elevational view of the tenth preferred embodiment portable fluid exchange system of FIG. 36.
Figure 40:
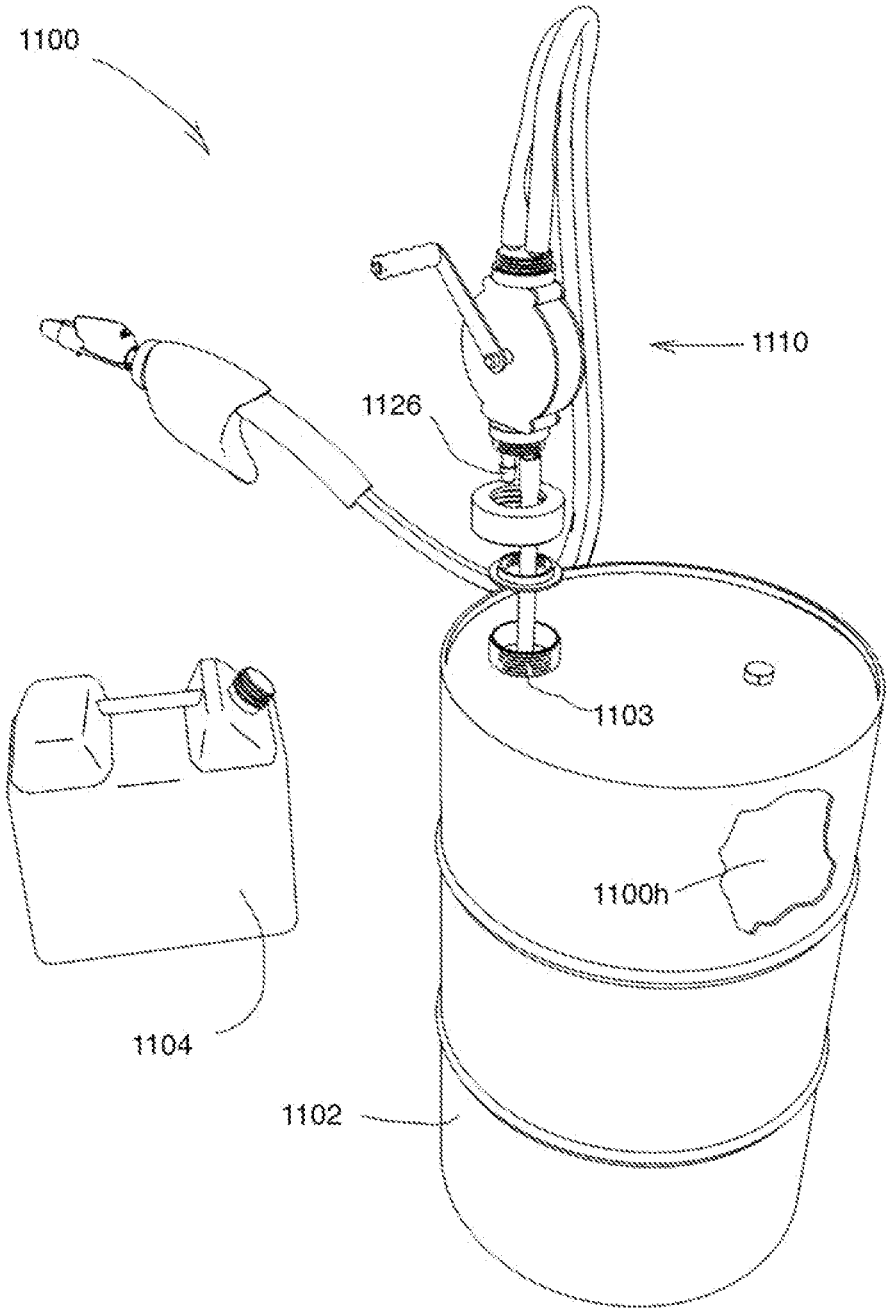
FIG. 40 is a perspective view of the eleventh preferred embodiment of the portable fluid exchange system according to the present invention, about to be used to pump fuel from a fifty-five gallon drum type source container to a portable fuel container type destination container.
Figure 41:
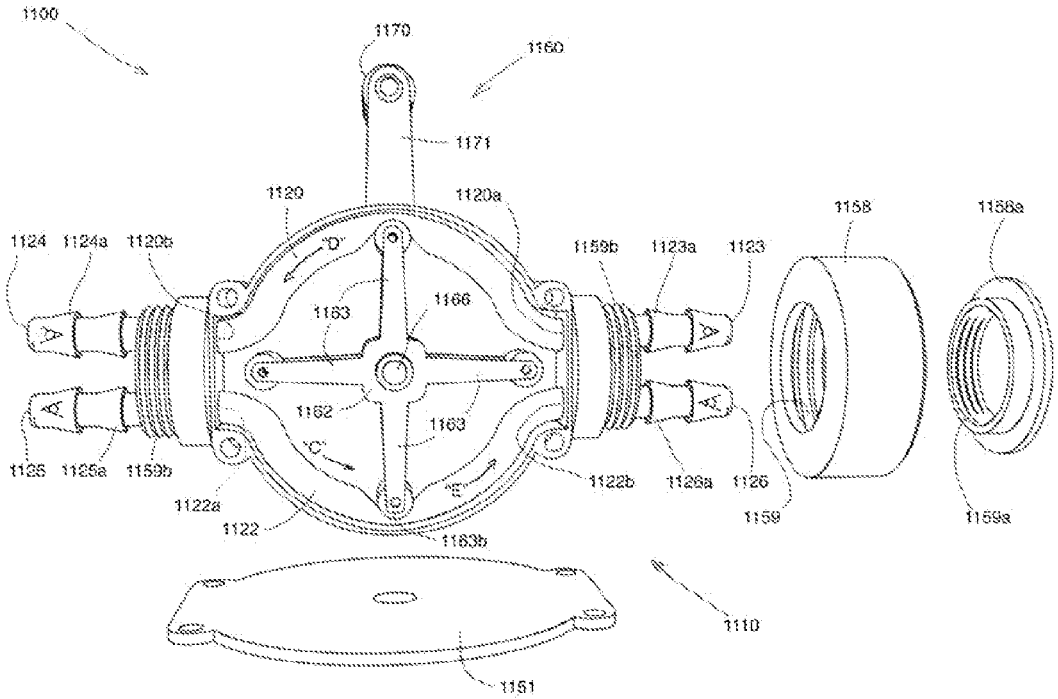
FIG. 41 is a partially exploded partially cut-away side elevational view of the eleventh preferred embodiment portable fluid exchange system of FIG. 40, with the rotor of the peristaltic pump in a first rotational position.
Figure 42:
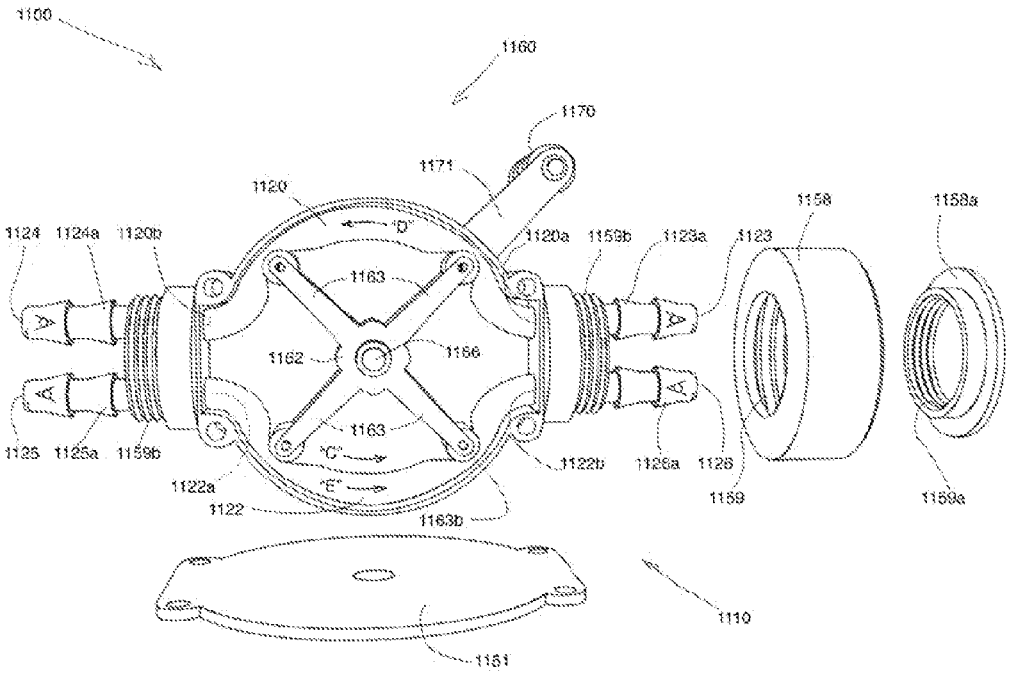
FIG. 42 is a partially exploded partially cut-away side elevational view similar to FIG. 41, but with the rotor of the peristaltic pump in a second rotational position.
Figure 43:
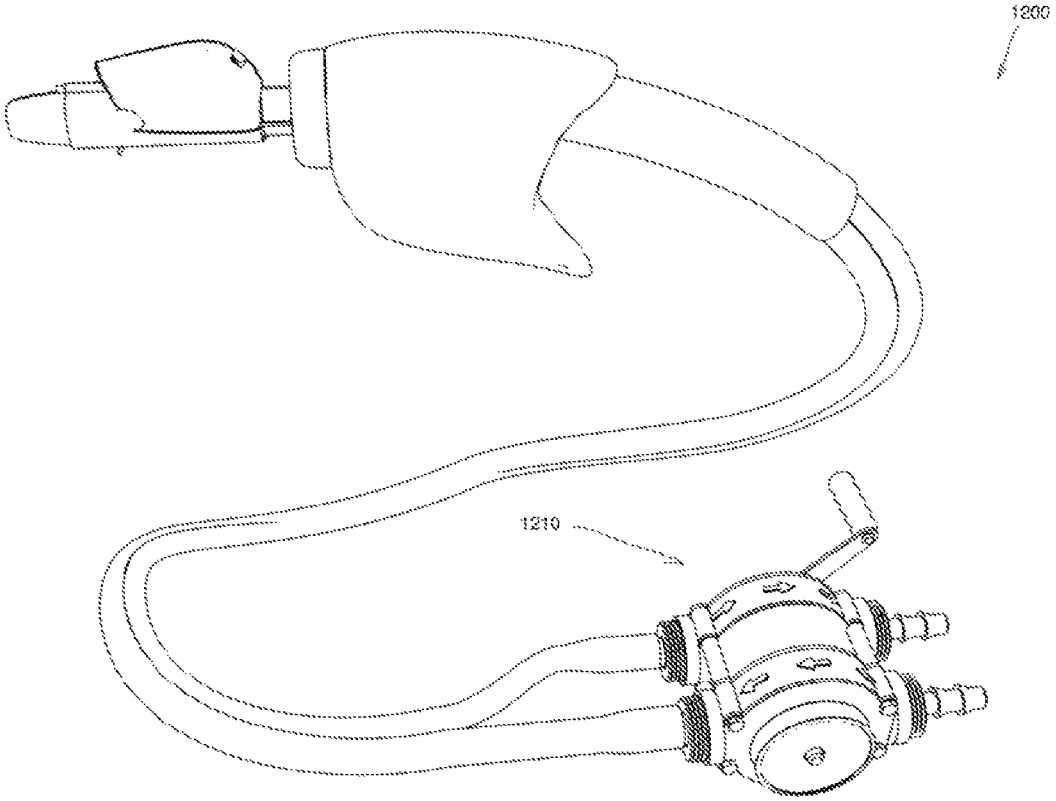
FIG. 43 is a perspective view from above of the twelfth preferred embodiment of the portable fluid exchange system according to the present invention.
Figure 44:
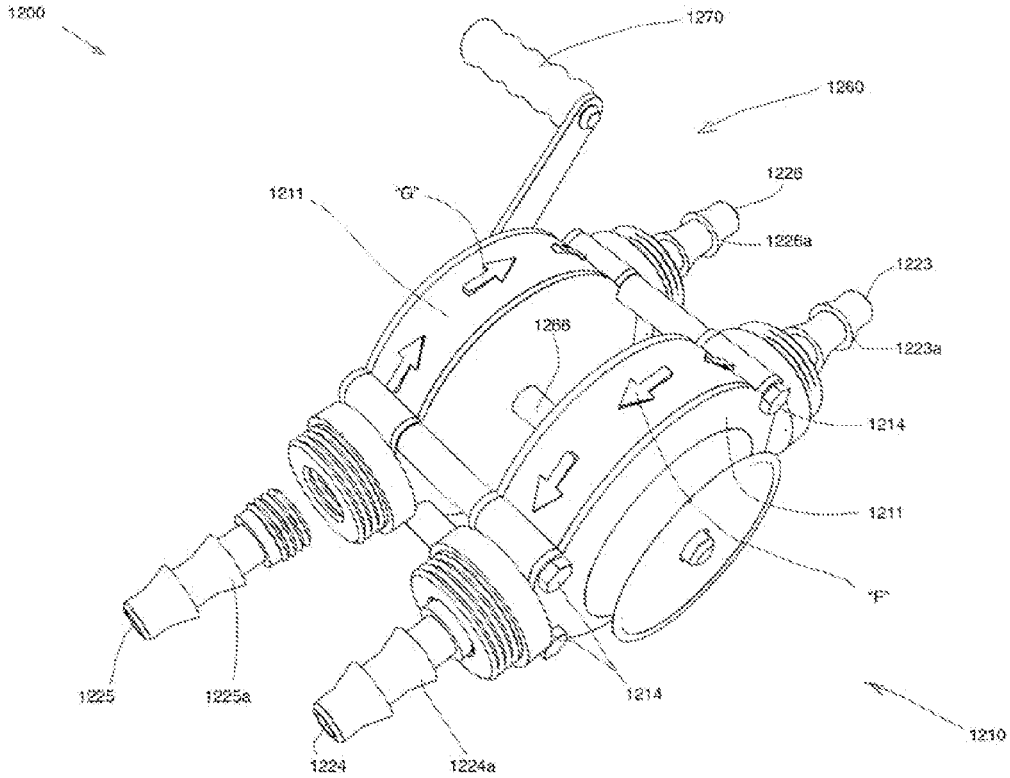
FIG. 44 is a side elevational view of the twelfth preferred embodiment portable fluid exchange system of FIG. 43.
Figure 45:
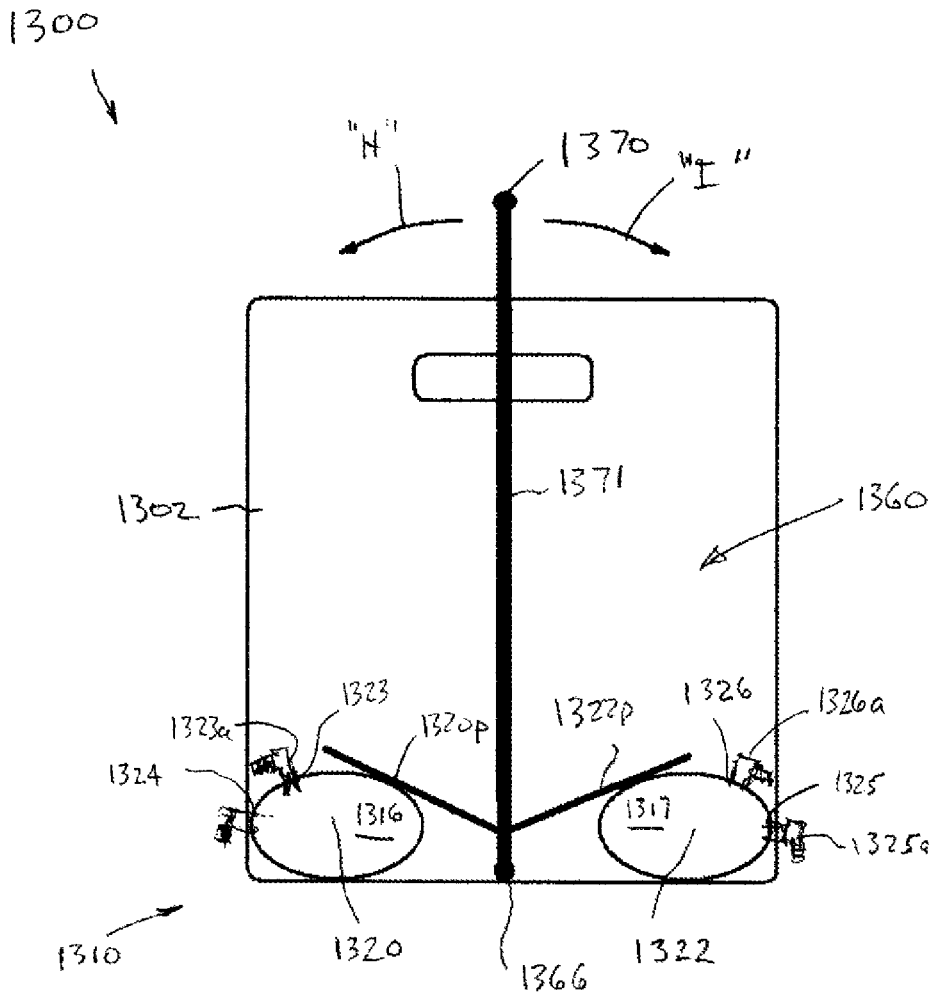
FIG. 45 is a side elevational view of the thirteenth preferred embodiment of the portable fluid exchange system according to the present invention.
Figure 46:
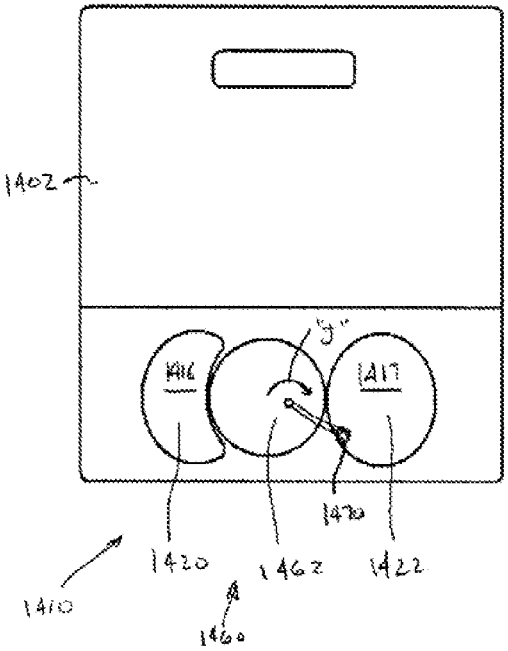
FIG. 46 is a partially cut-away side elevational view of the fourteenth preferred embodiment of the portable fluid exchange system according to the present invention.
Figure 47:
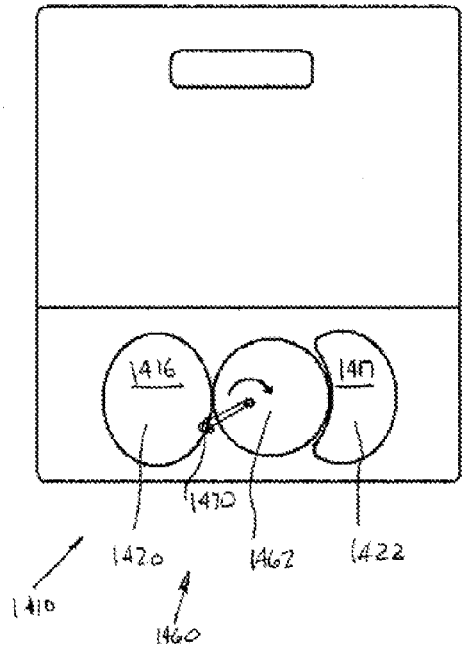
FIG. 47 is a partially cut-away side elevational view of the fourteenth preferred embodiment portable fluid exchange system of FIG. 46.
Figure 48A:
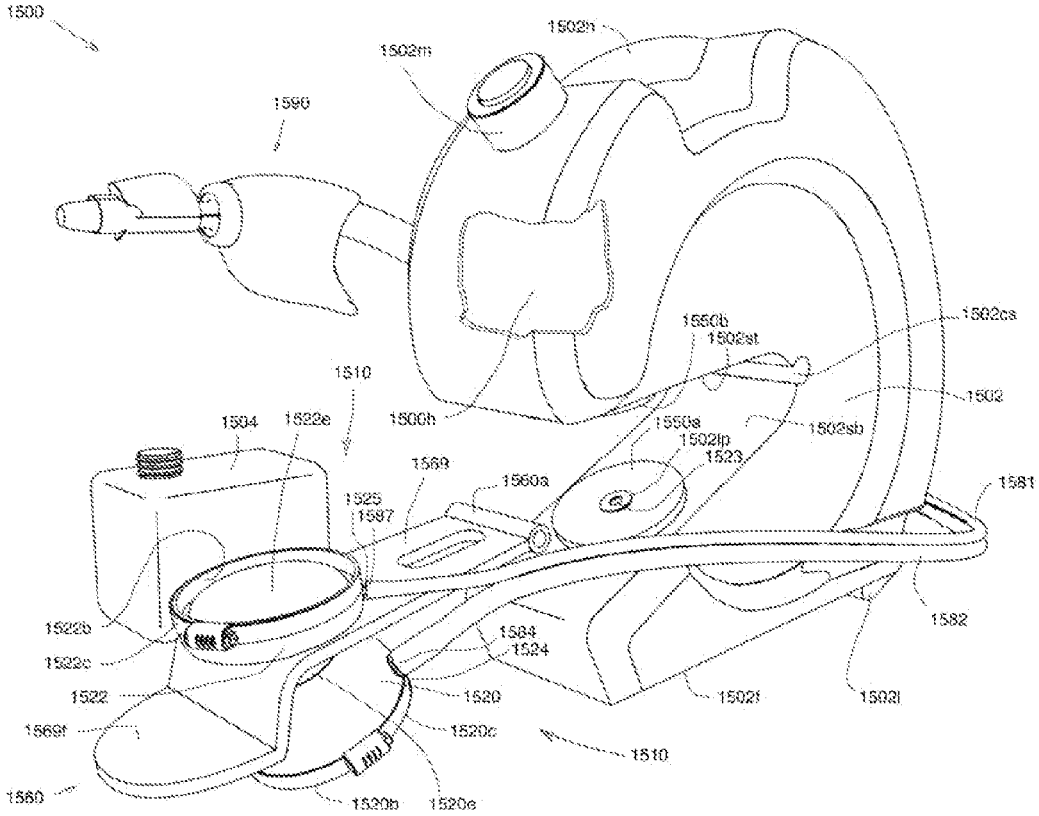
FIG. 48A is a perspective view from above and from the front left of the fifteenth preferred embodiment of the portable fluid exchange system according to the present invention, with the liquid and vapor pumping means shown separated from the source container for the sake of clarity.
Figure 48B:
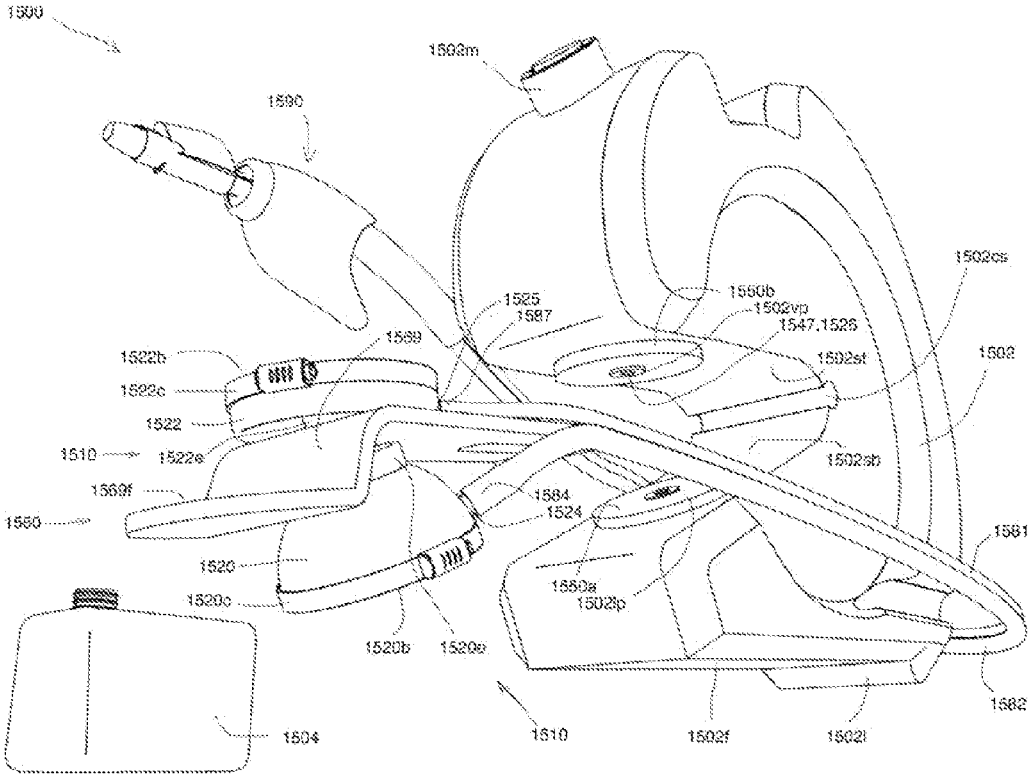
FIG. 48B is a perspective view from below and from the front left of the fifteenth preferred embodiment portable fluid exchange system of FIG. 48A, with the liquid and vapor pumping means shown separated from the source container for the sake of clarity.
Figure 48C:
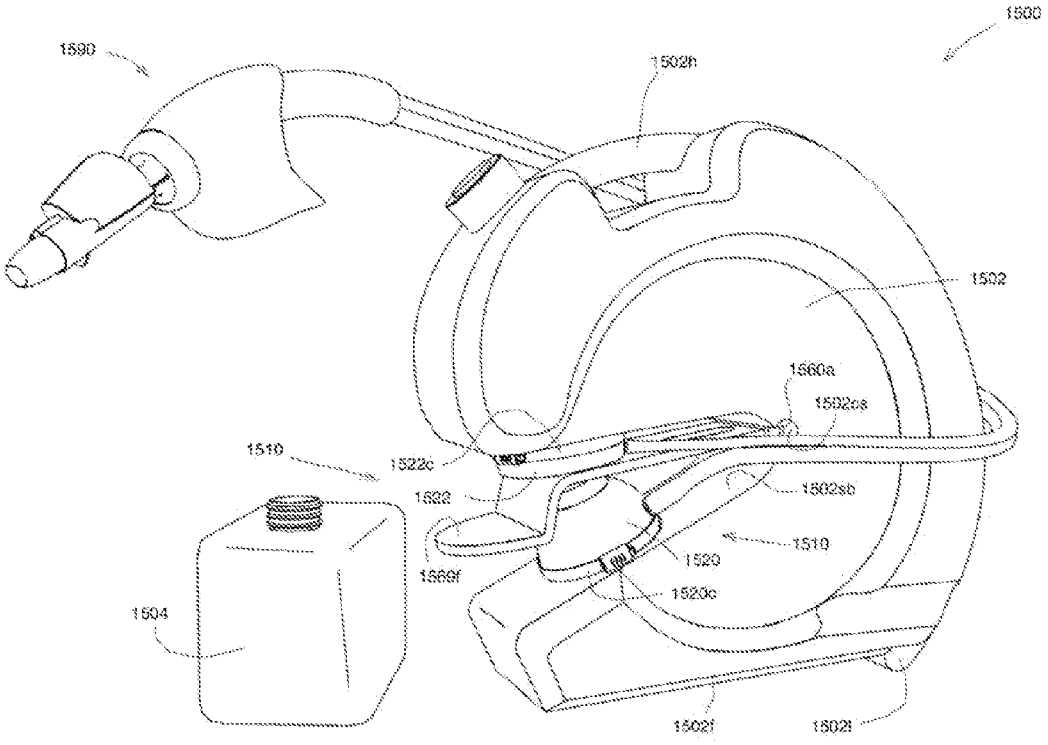
FIG. 48C is a perspective view from the left of the fifteenth preferred embodiment portable fluid exchange system of FIG. 48A, with the liquid and vapor pumping means shown in place mounted on the source container; and, FIG. 48D is a perspective view from the front left of the fifteenth preferred embodiment portable fluid exchange system of FIG. 48A, with the liquid and vapor pumping means shown in place mounted on the source container.
Figure 48D:
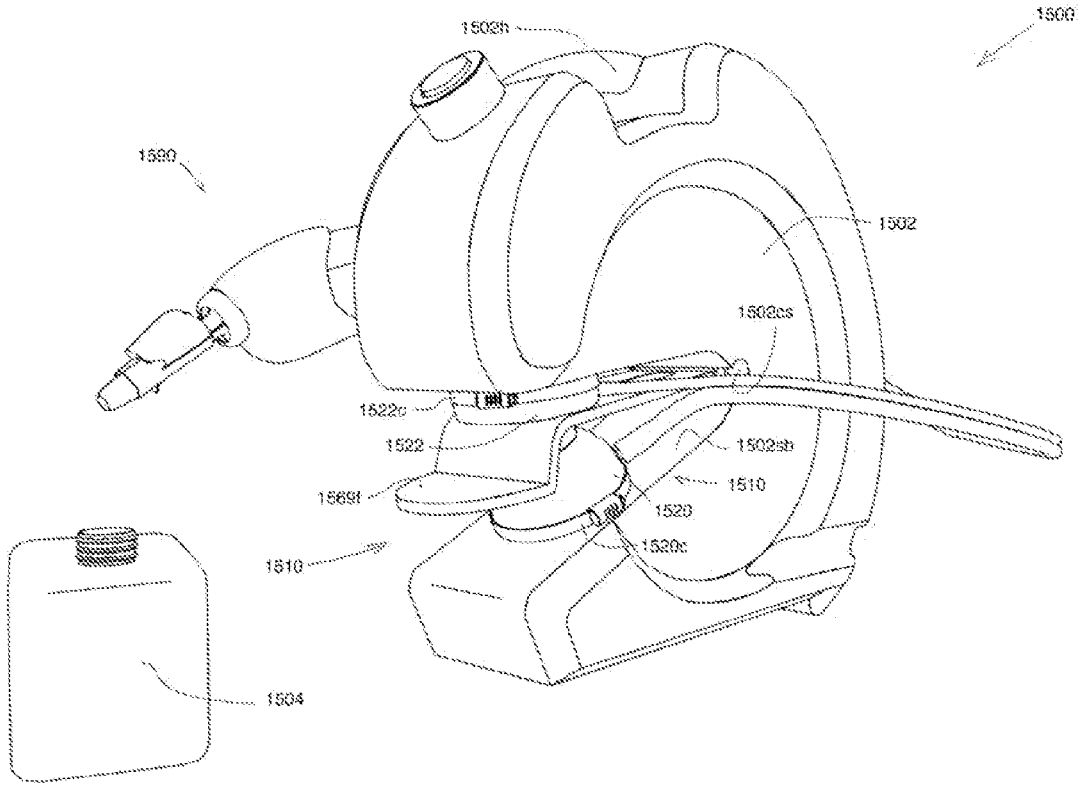

Referring to FIGS. 1 through 48D of the drawings, it will be noted that FIGS. 1 through 4 illustrate a first preferred embodiment of the portable fluid exchange system of the present invention, FIGS. 5 through 8 illustrate a second preferred embodiment of the portable fluid exchange system of the present invention, FIGS. 9A through 12 illustrate a third preferred embodiment of the portable fluid exchange system of the present invention, FIGS. 13 through 16 illustrate a fourth preferred embodiment of the portable fluid exchange system of the present invention, FIGS. 17 through 20 illustrate a fifth preferred embodiment of the portable fluid exchange system of the present invention, FIGS. 21 through 24 illustrate a sixth preferred embodiment of the portable fluid exchange system of the present invention, FIGS. 25 through 28 illustrate a seventh preferred embodiment of the portable fluid exchange system of the present invention, FIGS. 29 through 32 illustrate a eighth preferred embodiment of the portable fluid exchange system of the present invention, FIGS. 33 through 35 illustrate a ninth preferred embodiment of the portable fluid exchange system of the present invention, FIGS. 36 through 39 illustrate a tenth preferred embodiment of the portable fluid exchange system of the present invention, FIGS. 40 through 42 illustrate an eleventh preferred embodiment of the portable fluid exchange system of the present invention, FIGS. 43 and 44 illustrate a twelfth preferred embodiment of the portable fluid exchange system of the present invention, FIG. 45 illustrates a thirteenth preferred embodiment of the portable fluid exchange system of the present invention, FIGS. 46 and 47 illustrate a fourteenth preferred embodiment of the portable fluid exchange system of the present invention, and FIGS. 48A through 48D illustrate a fifteenth preferred embodiment of the portable fluid exchange system of the present invention.

Reference will now be made to FIGS. 1 through 4, which show a first preferred embodiment of the portable fluid exchange system of the present invention, as indicated by general reference numeral 100. The first preferred embodiment portable fluid exchange system, as indicated by the general reference numeral 100, is for concurrently pumping liquid from a source container 102 to a destination container 104 and pumping vapor from the destination container 104 to the source container 102. In the first preferred embodiment, the portable fluid exchange system 100 comprises the source container 102 having a substantially hollow interior 100*h*, and is capable of retaining liquid and vapor therein, in sealed relation with respect to the ambient environment. As illustrated, the source container 102 comprises a fifty-five gallon drum and the destination container 104 comprises a portable fuel container.

The portable fluid exchange system 100 comprises a liquid and vapor pumping means 110, as indicated by the general reference numeral 110, having a liquid inlet 123, a liquid outlet 124, a vapor inlet 125 and a vapor outlet 126. The liquid and vapor pumping means 110 is shown separate from the source container 102; however, when the liquid and vapor pumping means 110 is properly installed in sealed relation with the source container 102, as described below, the liquid inlet 123 and the vapor outlet 126 of the liquid and vapor pumping means 110 are connected in fluid communication with the substantially hollow interior of the source container 102.

Conventional check valves 123*b*,124*b*,125*b*, and 126*b* are included at the liquid inlet 123, the liquid outlet 124, the vapor inlet 125 and the vapor outlet 126 respectively to control flow of liquid and vapor into and out of the liquid and vapor pumping means 110, as will be discussed in greater detail subsequently. In the first preferred embodiment, as illustrated, the liquid and vapor pumping means 110 comprises a variable volume liquid pumping portion, as indicated by the general reference numeral 120 and a variable volume vapor pumping portion, as indicated by the general reference numeral 122. The liquid pumping portion 120 is in fluid communication with the liquid inlet 123 and the liquid outlet 124 and the vapor pumping portion 122 is in fluid communication with the vapor inlet 125 and the vapor outlet 126.

The variable volume liquid pumping portion 120 and the variable volume vapor pumping portion 122 are fluidically isolated one from the other by a pumping mechanism 130 movable to vary the internal volume of each of the liquid pumping portion 120 and the vapor pumping portion 122.

More specifically, the liquid and vapor pumping means 110 comprises a main body 140 having a generally cylindrical wall 142 and a rounded top portion 144 that together define a substantially hollow chamber 146. The substantially hollow chamber 146 is further defined by a base member 150 having a disc-shaped main body portion 151, an upper flange 152 having an exterior thread 153 and a lower flange 154 having an interior thread 155. A lower threaded collar 148 on the main body 140 threadably engages the exterior thread 153 on the upper flange 152 in sealed relation, to retain the main body 140 on the base member 150.

The liquid pumping portion 120 and the vapor pumping portion 122 are each substantially cylindrical in cross-section. The pumping mechanism 130 comprises a movable pumping member 132 disposed within the substantially hollow chamber 146 so as to divide the substantially hollow chamber 146 into the variable volume liquid pumping portion 120 and the variable volume vapor pumping portion 122.

The pumping mechanism 130 is operatively disposed within the substantially hollow chamber 146 so as to divide the substantially hollow chamber 146 in sealed relation into the variable volume liquid pumping portion 120 and the variable volume vapor pumping portion 122 that are fluidically isolated one from the other by the pumping mechanism 130, specifically the movable pumping member 132. The variable volume liquid pumping portion 120 is in fluid communication with the liquid inlet 123 and the liquid outlet 124 and the variable volume vapor pumping portion 122 is in fluid communication with the vapor inlet 125 and the vapor outlet 126.

As discussed previously, the pumping mechanism 130 is moveable between the full configuration of the liquid pumping portion 120 and the full configuration of the vapor pumping portion 122. When the pumping mechanism 130 moves from the full configuration of the liquid pumping portion 120 to the full configuration of the vapor pumping portion 122, liquid within the variable volume liquid pumping portion 120 of the substantially hollow chamber 146 is pumped from the variable volume liquid pumping portion 120 through the liquid outlet 124 and vapor is pumped into the variable volume vapor pumping portion 122 of the substantially hollow chamber 146 through the vapor inlet 125. When the pumping mechanism 130 moves from the full configuration of the vapor pumping portion 122 to the full configuration of the liquid pumping portion 120, vapor within the variable volume vapor pumping portion 122 of the substantially hollow chamber 146 is pumped from the variable volume vapor pumping portion 122 through the vapor outlet 126, and liquid is pumped into the variable volume liquid pumping portion 120 of the substantially hollow chamber 146 through the liquid inlet 123.

The liquid inlet 123 comprises a barbed hose fitting 123*a* threadably engaged into a cooperating threaded portion 141*a* of a liquid inlet 123 throughpassage 141 in the main body 151 of the base member 150. Similarly, the liquid outlet 124 comprises a barbed hose fitting 124*a* threadably engaged into a cooperating threaded portion 143*a* of a curved liquid outlet throughpassage 143 in the main body 151 of the base member 150.

Figure 3:
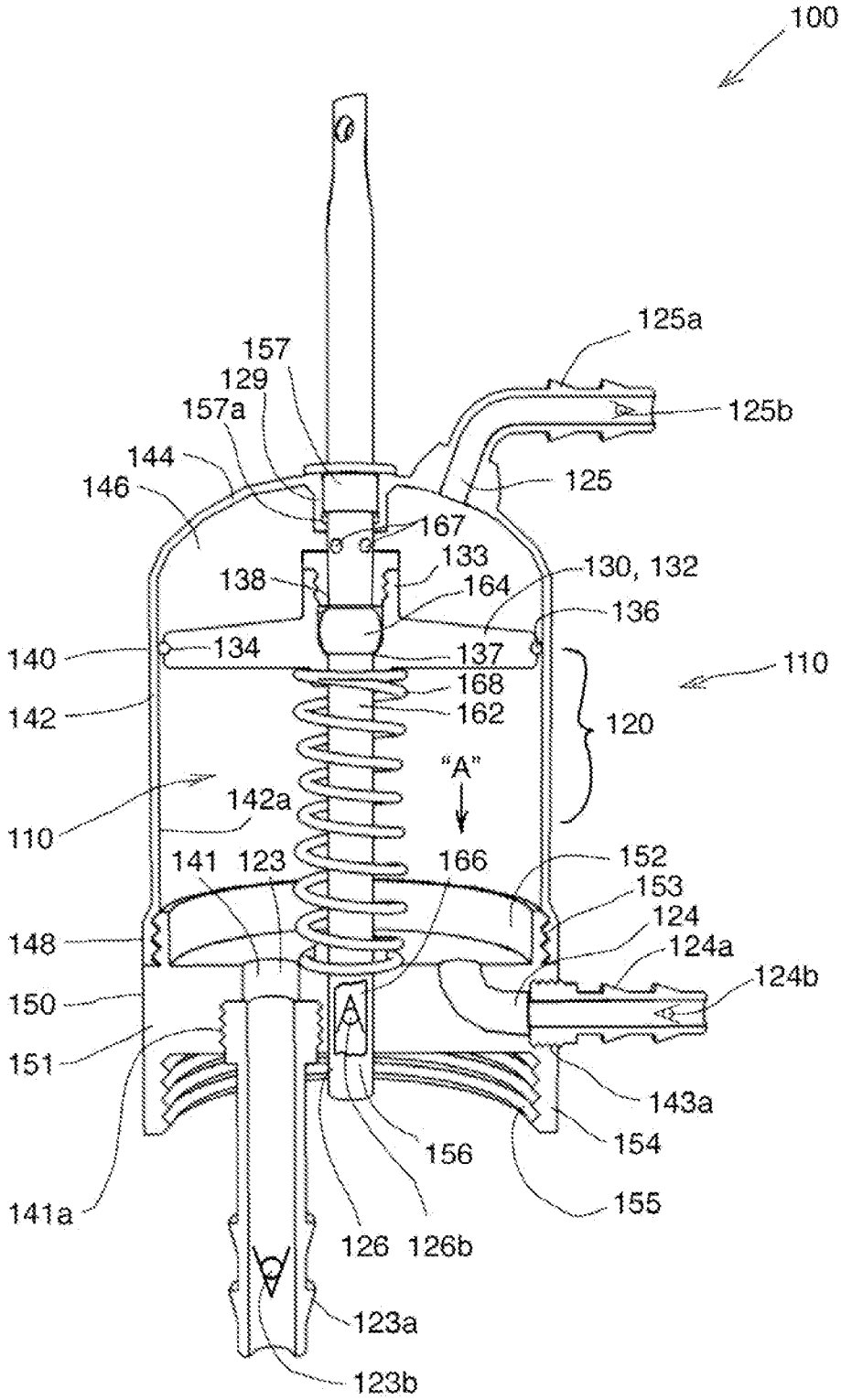
FIG. 3 is a sectional side elevational view of the first preferred embodiment portable fluid exchange system of FIG. 1, taken along section line 3-3 of FIG. 2, with the piston in position such that the liquid pumping portion is in its full configuration and the vapor pumping portion is in its reduced configuration.
Figure 4:
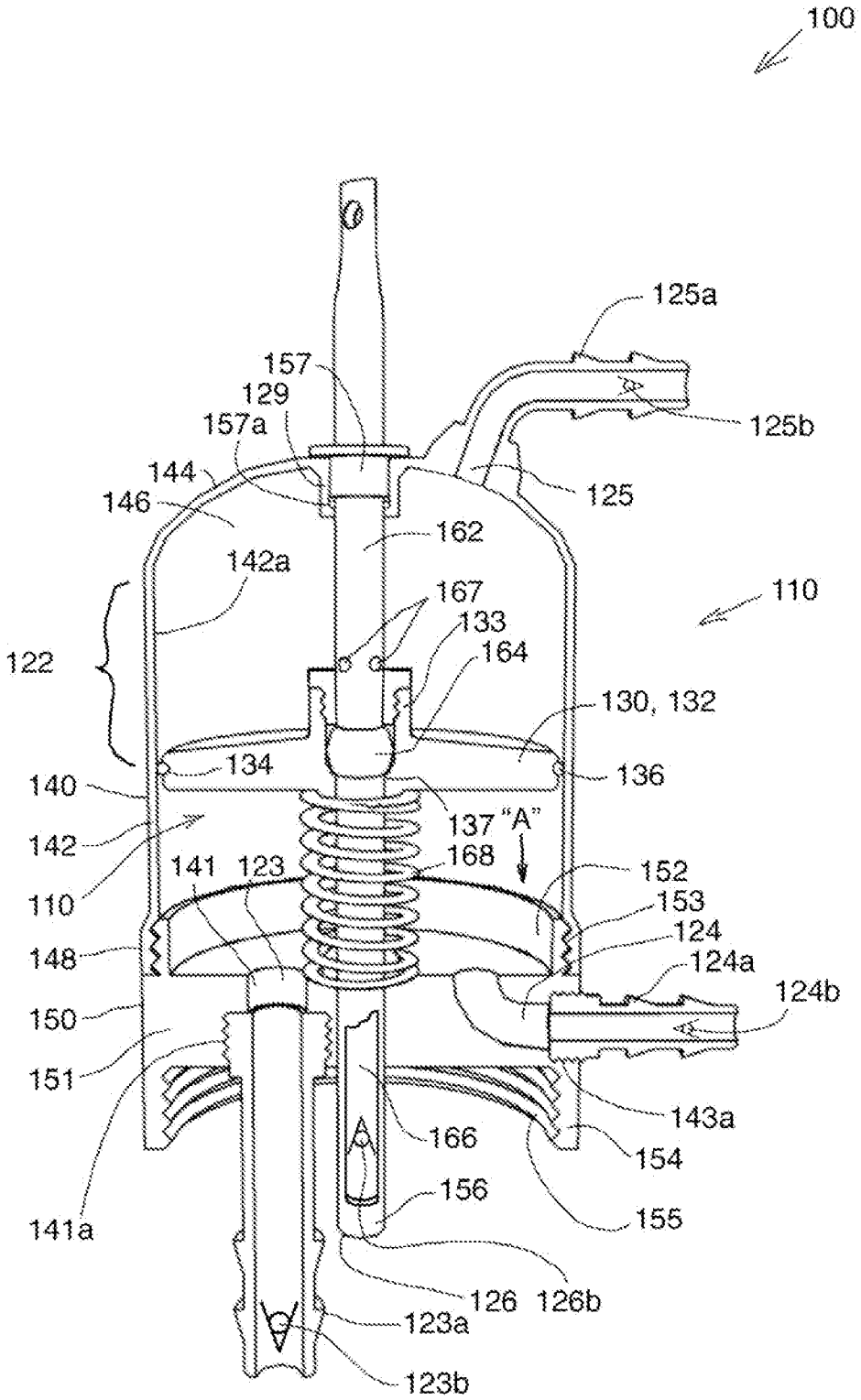
FIG. 4 is a sectional side elevational view similar to FIG. 3, but with the piston in position such that the liquid pumping portion is in its reduced configuration and the vapor pumping portion is in its full configuration.

In the first preferred embodiment, as illustrated, the movable pumping member 132 comprises a piston 132 mounted on and actuated by a piston rod member 162, as will be discussed in greater detail subsequently, for sliding movement within the substantially hollow chamber 146 between a first position, as shown in FIG. 3, and a second position, as shown in FIG. 4. The piston 132 has a peripherally disposed annular channel 134 that receives and retains an "O"-ring 136 therein. The "O"-ring 136 seals against the inner surface 142*a* of the cylindrical wall 142 of the main body 140. The piston 132 also has a central throughpassage 137 with a widened portion 138 and an upwardly extending annular flange 133.

In the first position, the liquid pumping portion 120 is in its pre-determined full configuration and the vapor pumping portion 122 is in its pre-determined reduced configuration. Conversely, in the second position, the vapor pumping portion 122 is in its full configuration and the liquid pumping portion 120 is in its reduced configuration. As can be readily seen in FIGS. 3 and 4, the change in volume of the liquid pumping portion 120 between the full configuration and the reduced configuration is substantially equal to the change in volume of the vapor pumping portion 122 between the reduced configuration and the full configuration, even though the internal volume of the liquid pumping portion is not equal to the internal volume of the vapor pumping portion.

As can be seen in FIGS. 3 and 4, the internal volume of the liquid pumping portion 120 is variable, via pumping movement of the pumping mechanism 130, between a full configuration, as seen in FIG. 3, and a reduced configuration, as seen in FIG. 4, wherein the internal volume of the liquid pumping portion 120 is less than in the full configuration. Similarly, the internal volume of the vapor pumping portion 122 is variable, via pumping movement of the pumping mechanism 130, between a full configuration, as seen in FIG. 4, and a reduced configuration, as seen in FIG. 3, wherein the internal volume of the vapor pumping portion 122 is less than in the full configuration.

There is also a selectively controllable actuation mechanism, as indicated by the general reference numeral 160, for directly actuating the liquid and vapor pumping means 110 to thereby concurrently pump liquid from the liquid and vapor pumping means 110 through the liquid outlet 124 and vapor into the liquid and vapor pumping means 110 through the vapor inlet 125, and concurrently pump vapor from the liquid and vapor pumping means 110 through the vapor outlet 126 and liquid into the liquid and vapor pumping means 110 through the liquid inlet 123. In the first preferred embodiment, as illustrated, the movable pumping mechanism 130 is for concurrently pumping liquid from the liquid pumping portion 120 through the liquid outlet 124 and vapor into the vapor pumping portion 122 through the vapor inlet 125, and concurrently pumping vapor from the vapor pumping portion 122 through the vapor outlet 126 and liquid into the liquid pumping portion 120 through the liquid inlet 123. More specifically, the pumping mechanism 130 concurrently pumps vapor from the vapor pumping portion 122 through the vapor outlet 126 and liquid into the liquid pumping portion 120 through the liquid inlet 123, and due to the reciprocating nature of the pumping mechanism 130, alternatingly concurrently pumps liquid from the liquid pumping portion 120 through the liquid outlet 124 and vapor into the vapor pumping portion 122 through the vapor inlet 125. It can readily be seen that the pumping of vapor form the destination container to the portable fluid exchange system 100 is not dependent on measurement of a condition of the liquid being pumped from the portable fluid exchange system 100 to the destination container 104, but is directly effected in accordance with the pumping of the liquid from the portable fluid exchange system 100 to the destination container 104.

As can be seen in FIGS. 3 and 4, the check valve 124*b* permits fluid to flow out of the portable fluid exchange system 100 through the liquid outlet 124, and the check valve 125*b* permits vapor to concurrently flow into the portable fluid exchange system 100 through the vapor inlet 125. Similarly, the check valve 123*b* permits liquid to flow into the portable fluid exchange system 100 through the liquid inlet 123 and the check valve 126*b* permits vapor to flow out of the portable fluid exchange system 100 through the vapor outlet 126.

The check valves 123*b*, 125*b*, and 124*b* could be positioned either within the barbed hose fitting 123*a* at the liquid inlet 123, the barbed hose fitting 125*a* at the vapor inlet 125, and the barbed hose fitting 124*a* at the liquid outlet 124, or alternatively these check valves could be a part of the elongate flexible liquid delivery hose 182, the elongate flexible vapor recovery hose 183, or the liquid supply hose 106, or even be part of the piston rod member 162 in conjunction with the throughpassage 166. Also alternatively, the various check valves could be attached to the vapor inlet 125, liquid inlet 123, and liquid outlet 124 of the liquid and vapor pumping means, or the check valves could be within a component such as the nozzle of the nozzle and spout assembly 190.

As mentioned previously, the selectively controllable actuation mechanism 160 comprises the piston rod member 162 that is operatively connected to the piston 132. More specifically, the piston 132 is secured to the piston rod member 162 by means of a force fit compression fitting 164 that is received in a widened portion 138 of the central throughpassage 137 of the piston 132.

The piston rod member 162 is slidably engaged with in a central borehole 156 in the main body 151 of the base member 150, and is slidably engaged within a bushing 157 which retains an "O"-ring 157*a* within the bushing housing 129 of rounded top portion 144 of the main body 140.

The piston rod member 162 includes a throughpassage 166 that permits the variable volume vapor pumping portion 122 to be in fluid communication with one of the vapor inlet 125 and said vapor outlet 126. In the first preferred embodiment, the variable volume vapor pumping portion 122 is in fluid communication with the vapor outlet 126 via the throughpassage 166 and a plurality of small diameter apertures 167 in the piston rod member 162 immediately above the compression fitting 164. The vapor outlet 126 is disposed at the bottom end of the piston rod member 162. The vapor inlet 125 comprises a barbed hose fitting 125*a* integrally molded to the rounded top portion 144 of the main body 140 at the vapor inlet 125.

Figure 1:
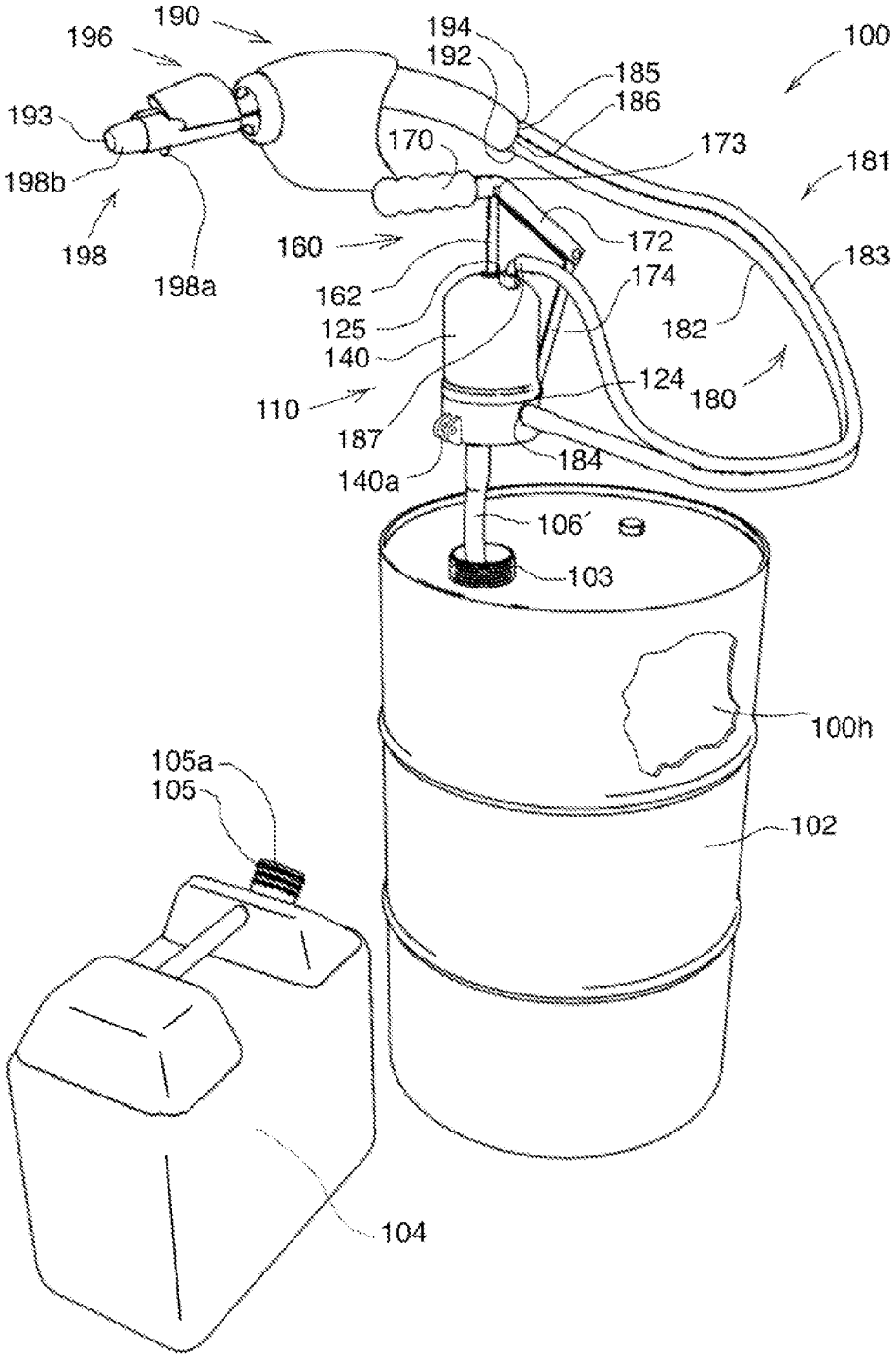
FIG. 1 is a perspective view from above of the first preferred embodiment of the portable fluid exchange system according to the present invention, about to be used to pump fuel from a fifty-five gallon drum type source container to a portable fuel container type destination container.
Figure 2:
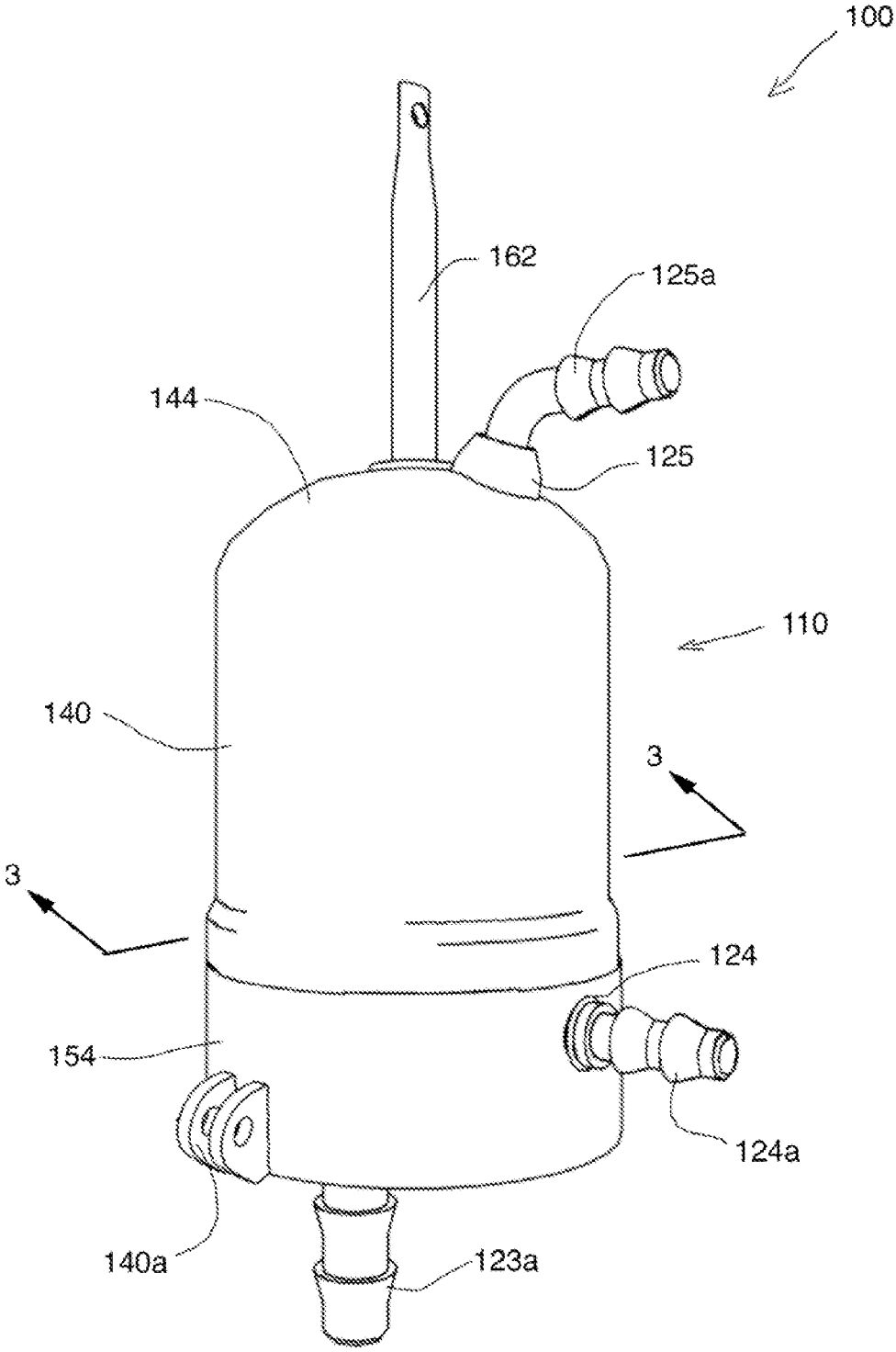
FIG. 2 is a side elevational view of the first preferred embodiment portable fluid exchange system of FIG. 1.

As can be seen in FIG. 1, the selectively controllable actuation mechanism 160 is manually powered, and comprises a handle member 170 that is part of a pump arm 172 that is itself connected in freely pivoting relation at a central vertex 173 to the top of the piston rod member 162, and connected in freely pivoting relation at an opposite end to the handle member 170 to the top end of a connecting arm 174. The connecting arm 174 is connected in freely pivoting relation at its bottom end to the main body 140 between a pair of parallel connecting tabs 140*a*.

The selectively controllable actuation mechanism 160 further comprises a biasing means 168 for biasing the liquid pumping portion 120 to its full configuration. The biasing means 168 preferably comprises a spring member 168 operatively acting on one of the selectively controllable actuation mechanism 160 and the liquid and vapor pumping means 110 for biasing the liquid pumping portion 120 to the full configuration. In the first preferred embodiment, as illustrated, the spring member 168 comprises a coil spring 168 operatively interposed between the piston 132 and the base member 150 such that the spring member 168 biases the piston 132 upwardly, to the full configuration of the liquid pumping portion 120, as shown in FIG. 3, whereat the coil spring 168 is in a neutral configuration. In the full configuration of the vapor pumping portion 122, the coil spring 168 is compressed by the downward actuation of the handle member 170, as indicated by arrow "A" in FIGS. 3 and 4.

It can readily be seen that the selectively controllable actuation mechanism 160 causes the concurrent pumping of liquid from the liquid and vapor pumping means 110 through the liquid outlet 124 and vapor into the liquid and vapor pumping means 110 through the vapor inlet 125, at an equal rate one to the other, on an ongoing basis.

The selectively controllable actuation mechanism 160 is movable in a cyclical motion when actuating the liquid and vapor pumping means 110, or in other words when varying the volume of the liquid pumping portion 120 and the vapor pumping portion 122 between their respective full and reduced configurations. The pumping mechanism 130 is movable through one cycle of the cyclical motion when varying the volume of the liquid pumping portion 120 from the full configuration, as shown in FIG. 3, through the reduced configuration, as shown in FIG. 4, and back to the full configuration. Similarly, the pumping mechanism 130 is movable through one cycle of the cyclical motion when varying the volume of the vapor pumping portion 122 from the reduced configuration, as shown in FIG. 4, through the full configuration, as shown in FIG. 3, and back to the reduced configuration. In one cycle of the pumping mechanism 130, the volume of liquid pumped by the liquid pumping portion 120 is equal to the volume of vapor pumped by the vapor pumping portion 122.

The portable fluid exchange system 100 further comprises a liquid delivery means 180 for delivering liquid from the liquid and vapor pumping means 110 to the destination container 104, and a vapor recovery means 181 for delivering vapor from the destination container 104 to the liquid and vapor pumping means 110.

In the first preferred embodiment is illustrated, the liquid recovery means 180 comprises an elongate flexible liquid delivery hose 182 having a liquid inlet 184 and a liquid outlet 186. The elongate flexible liquid delivery hose 182 is securely connected to the barbed hose fitting 124*a* at the liquid outlet 124 of the liquid and vapor pumping means 110. Accordingly, the elongate flexible liquid delivery hose 182 is in fluid communication at the liquid inlet 184 with the liquid outlet 124 of the liquid and vapor pumping means 110 for receiving liquid from the liquid and vapor pumping means 110, and in fluid communication at the liquid outlet 186 with the destination container 104 through a nozzle and spout assembly 190, for delivering the received liquid to the destination container 104.

Similarly, the vapor recovery means 181 comprises an elongate flexible vapor recovery hose 183 having a vapor inlet 185 and a vapor outlet 187. The elongate flexible vapor delivery hose 183 is securely connected to the barbed hose fitting 125*a* at the vapor inlet 125 of the liquid and vapor pumping means 110. Accordingly, the elongate flexible vapor recovery hose 183 is in fluid communication at the vapor inlet 185 with the destination container 104 through a nozzle and spout assembly 190, for receiving vapor from the destination container 104, and is in fluid communication at the vapor outlet 187 with the vapor inlet 125 of the liquid and vapor pumping means 110 for delivering the received vapor to the liquid and vapor pumping means 110.

As can be seen in FIG. 1, the elongate flexible liquid delivery hose 182 and the elongate flexible vapor recovery hose 183 together comprise a two line hose, and in the first preferred embodiment, as illustrated, the elongate flexible liquid delivery hose 182 and the elongate flexible vapor recovery hose 183 are integrally formed one with the other.

The portable fluid exchange system 100 further comprises a nozzle and spout assembly 190. The liquid outlet 186 of the elongate flexible liquid delivery hose 182 is operatively connected in supported relation to the nozzle and spout assembly 190, and more specifically is operatively connected in liquid delivery relation to the liquid inlet 192 of the nozzle and spout assembly 190. Similarly, the vapor inlet 185 of the elongate flexible vapor recovery hose 183 is operatively connected in supported relation to the nozzle and spout assembly 190, and more specifically is operatively connected in vapor receiving relation to the vapor outlet 194 of the nozzle and spout assembly 190. The nozzle and spout assembly 190 receives liquid from the liquid outlet of the elongate flexible liquid delivery hose 182 and dispenses the liquid to the destination container 104 and receive vapor from the destination container 104 and conveys the vapor to the vapor inlet of the elongate flexible vapor recovery hose 183.

As can also be seen in FIG. 1, the nozzle and spout assembly 190 comprises an auto-shutoff mechanism 196 and an auto-closure mechanism 198. The auto-shutoff mechanism 196 operates similarly to a gas station nozzle, and works by shutting off the valve means in the nozzle and spout assembly 190, which was opened to allow liquid to be conveyed from the liquid outlet 186 of the elongate flexible liquid delivery hose 182 through the nozzle and spout assembly 190. To the destination container 104. The auto-shutoff mechanism 196 closes the valve means of the nozzle and spout assembly 190, to thereby stop the flow of liquid from the liquid outlet 193 of the nozzle and spout assembly 190 in response to a level of liquid being encountered by the auto-shutoff mechanism. By automatically shutting off the flow of liquid in this manner, the nozzle and spout assembly 190 will prevent the destination container 104 from being overfilled.

The auto-closure mechanism 198 comprises an activation means for causing the valve means of the nozzle and spout assembly 190 to open and close. The activation means has an engaging means 198*a* comprises a hook on the underside of the spout 198*b*, which, in use, can be activated by engaging the hook 198*a* of the nozzle and spout assembly 190 to a destination container 104 at the lip 105*a* of its receiving opening 105, and applying pressure to cause the valve means of the nozzle and spout assembly 190 to open and permit liquid delivery through the nozzle and spout assembly 190. The engaging means 198*a* also causes the valve means to close, thus inhibiting liquid from flowing through the nozzle and spout assembly 190 in response to the disengagement of the engaging means 198*a*, which relieves the applied pressure when the nozzle and spout assembly is removed away from the opening 105 of the destination container 104.

The elongate flexible liquid delivery hose 182 and the elongate flexible vapor recovery hose 183 permit the movement of the liquid outlet 186 of the elongate flexible liquid delivery hose 182 to the destination container 104 while the source container 102 remains substantially stationary, to thereby permit the delivery of the liquid to the destination container 104.

The liquid inlet 123 is in fluid communication with the interior of the source container 102, namely the fifty-five gallon drum, via a liquid extension hose 106' securely attached to the barbed hose fitting 123*a*. The liquid extension hose 106' extends downwardly into the fifty-five gallon drum. Liquid is pumped form the source container 102 and into the variable volume liquid pumping portion 120 of the substantially hollow chamber 146 through the liquid extension hose 106', the barbed hose fitting 123*a*, and the liquid inlet 123.

The portable fluid exchange system 100 further comprises an attachment means for connecting in fluid communication at least one of the liquid inlet 123 and the vapor outlet 126 with the interior of the source container 102 or connecting in fluid communication at least one of the liquid outlet 124 and the vapor inlet 125 with the interior of the destination container 104. More specifically, the attachment means is for attaching the portable fluid exchange system 100 to the source container 102 or the destination container 104, and in the first preferred embodiment, as illustrated, the portable fluid exchange system 100 is attached to the source container 102, such that the liquid inlet 123 and the vapor outlet 126 are in fluid communication with the interior of the source container 102. The attachment means comprises the lower flange 154 with the interior thread 155, which allows the portable fluid exchange system 100 to be attachable to a container, such as the fifty-five gallon drum 102, so that the liquid inlet 123 and the vapor outlet 126 are in fluid communication with the interior of the source container 102. The liquid extension hose 106' is connected to the barbed hose fitting 123*a*, to thereby allow liquid to be conveyed from the bottom of the fifty-five gallon drum source container 102 to the liquid pumping portion 120 of the liquid and vapor pumping means 110. The attachment means provides an airtight leakproof seal to the mouth 103 of the fifty-five gallon drum 102.

It will be understood that in FIG. 1, the liquid and vapor pumping means 110 of the portable fluid exchange system 100 is shown slightly above the fifty-five gallon drum 102 and not actually connected to it. In order to connect the liquid and vapor pumping means 110 of the portable fluid exchange system 100 to the fifty-five gallon drum 102, the liquid and vapor pumping means 110 is lowered to the mouth 103 of the fifty-five gallon drum 102 until the lower flange 154 is engaged on the mouth 103 of the fifty-five gallon drum 102. The interior thread 155 of the lower flange 154 threadably engages the co-operating threads on the mouth 103 of the fifty-five gallon drum 102, to thereby secure the liquid and vapor pumping means 110 in place and provide the aforementioned airtight leakproof seal.

The liquid inlet 123 comprises a barbed hose fitting 123*a* threadably engaged into a cooperating threaded portion 141*a* of a liquid inlet 123 throughpassage 141 in the main body 151 of the base member 150.

In use, in order to pump liquid from the source container 102 to the destination container 104, by means of the first preferred embodiment portable fluid exchange system, the handle member 170 is first moved downwardly from the raised position as shown in FIG. 1, such that the piston 132 moves from the position shown in FIG. 3, whereat the variable volume liquid pumping portion 120 is in its full configuration, to the position shown in FIG. 4, whereat the variable volume liquid pumping portion 120 is in its reduced configuration. Accordingly, liquid is pumped from the liquid pumping portion 120 of the liquid and vapor pumping means 110 through the liquid outlet 124, and through the elongate flexible liquid delivery hose 182 to the nozzle and spout assembly 190, where it is delivered to the destination container 104. Concurrently, the liquid and vapor pumping means 110 pumps vapor into the liquid and vapor pumping means 110 through the vapor inlet 125, wherein the vapor being pumped is being drawn in from the destination container 104 through the nozzle and spout assembly 190 to the elongate flexible vapor recovery hose 183 and on into the vapor inlet 125 of the liquid and vapor pumping means 110. In this manner, on an ongoing basis, vapor is pumped out of the destination container 104 as liquid is pumped into the destination container 104, thus precluding vapor from escaping to the ambient surroundings.

Next, the handle member 170 is then moved upwardly from the lowered position, such that the piston 132 moves from the position shown in FIG. 4, whereat the variable volume liquid pumping portion 120 is in its reduced configuration, back to the position shown in FIG. 3, whereat the variable volume liquid pumping portion 120 is in its full configuration. Accordingly, liquid is pumped from the source container 102 to the liquid pumping portion 120 of the liquid and vapor pumping means 110 up through the liquid extension hose 106' and into the liquid inlet 123. Concurrently, the liquid and vapor pumping means 110 pumps vapor out of the liquid and vapor pumping means 110 through the vapor outlet 126 and into the source container 102. In this manner, concurrently on an ongoing basis, vapor is pumped into the source container 102 as liquid is pumped out of the source container 102, thus precluding vapor from escaping to the ambient surroundings.

Reference will now be made to FIGS. 5 through 8, which show a second preferred embodiment of the portable fluid exchange system of the present invention, as indicated by general reference numeral 200. The second preferred embodiment portable fluid exchange system 200 is similar to the first preferred embodiment of the portable fluid exchange system 100 of the present invention, with many elements being in common. Accordingly, elements in the second preferred embodiment portable fluid exchange system 200 that are common to, and essentially the same as, elements in the first preferred embodiment portable fluid exchange system 100, will not be specifically discussed with reference to the second preferred embodiment portable fluid exchange system 200, for the sake of brevity. Similar numbering has been used between the two embodiments to indicate commonality of functioning parts within each embodiment. For example, the liquid inlet 223 of the second preferred embodiment will be similar in function to the liquid inlet 123 of the first preferred embodiment, and so on. Only the significant differences between the second preferred embodiment portable fluid exchange system 200 and the first preferred embodiment portable fluid exchange system 100 will be discussed.

Figure 5:
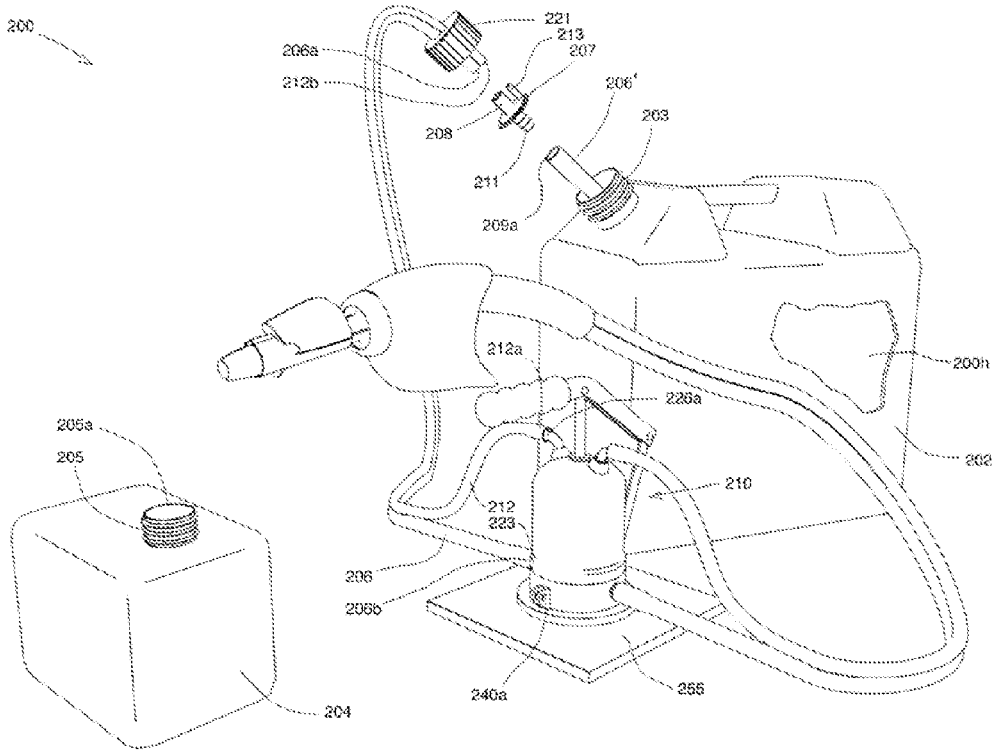
FIG. 5 is a perspective view from above of the second preferred embodiment of the portable fluid exchange system according to the present invention, about to be used to pump fuel from a portable fuel container type of source container to a portable fuel container type of destination container.
Figure 6:
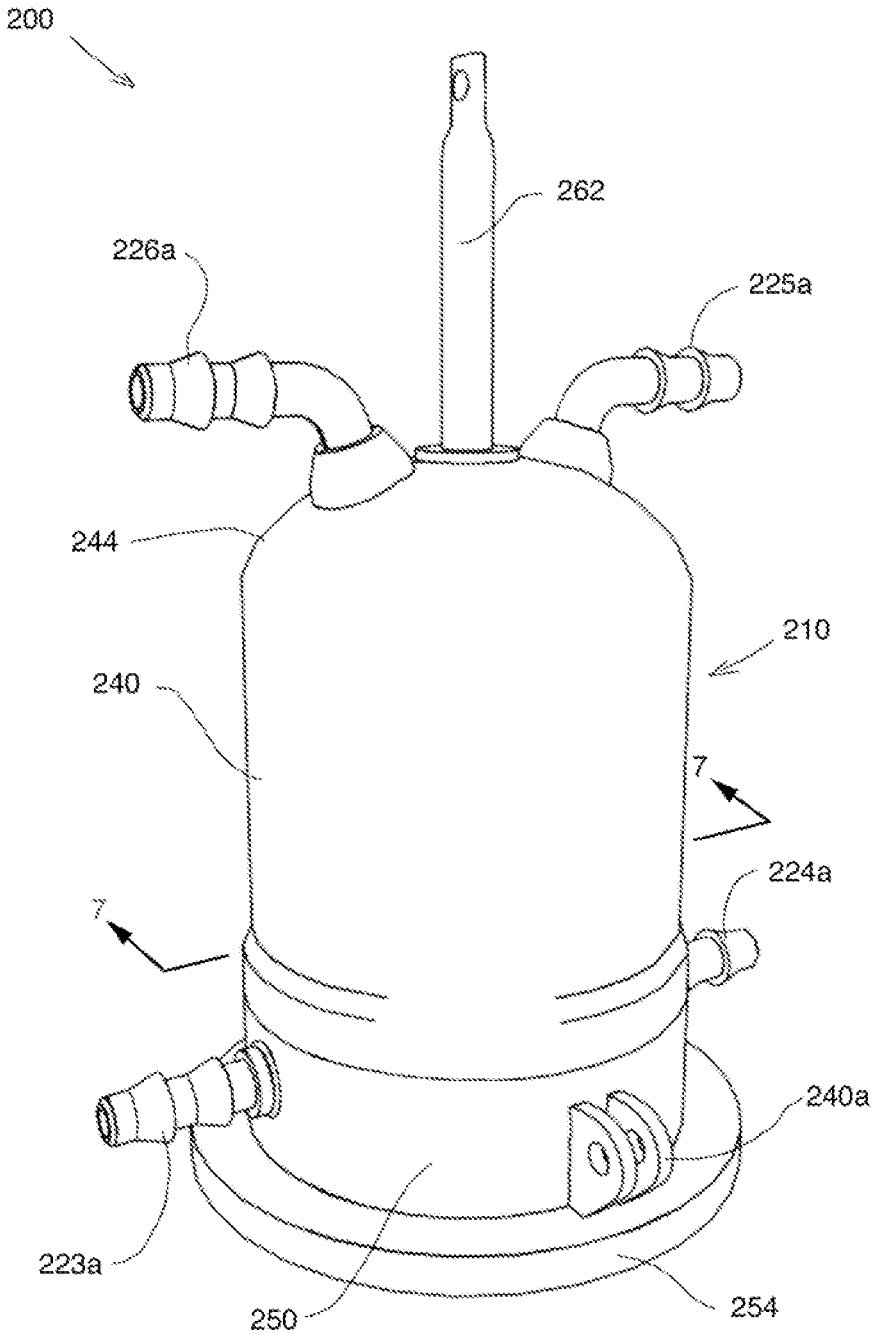
FIG. 6 is a side elevational view of the second preferred embodiment portable fluid exchange system of FIG. 5.
Figure 7:
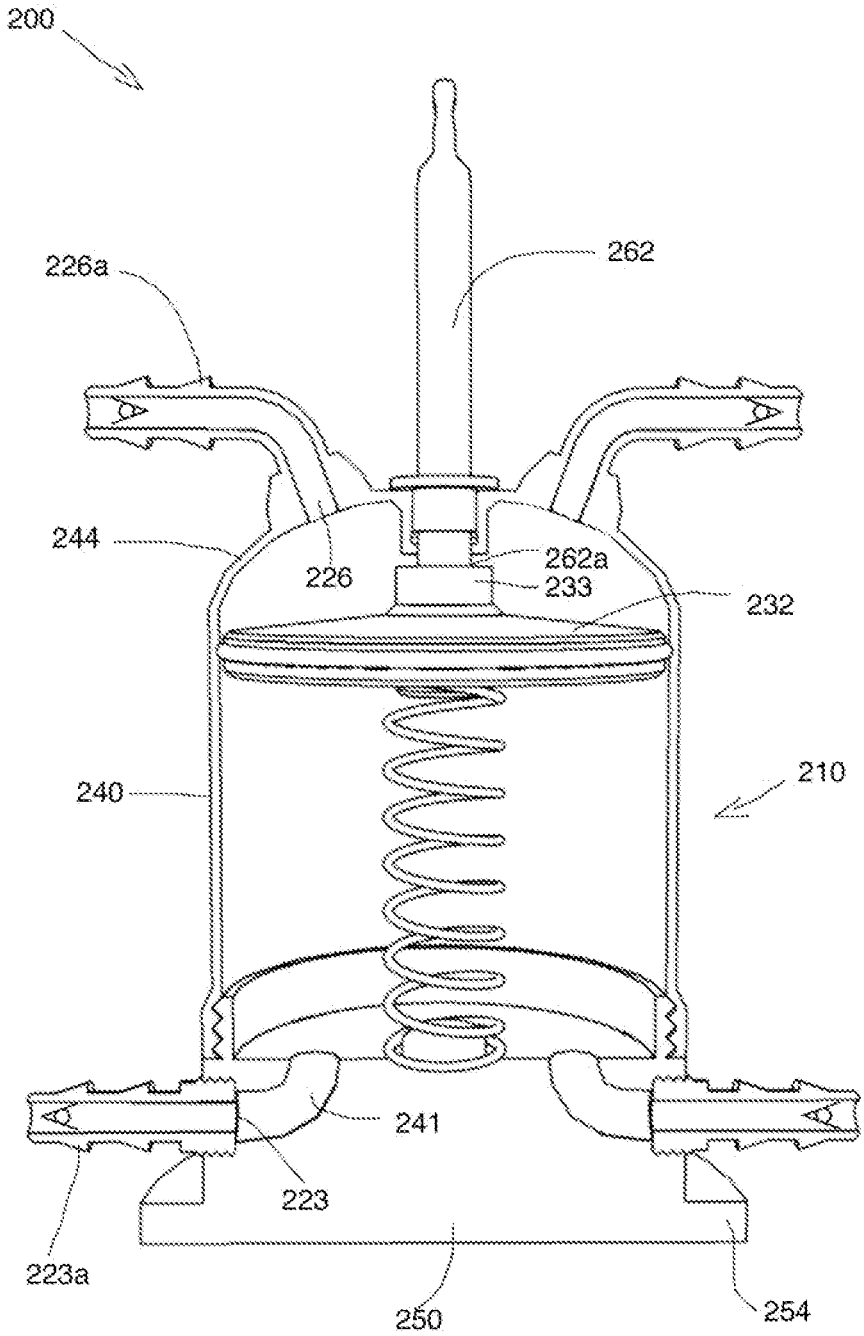
FIG. 7 is a sectional side elevational view of the second preferred embodiment portable fluid exchange system of FIG. 5, taken along section line 7-7 of FIG. 6, with the piston in position such that the liquid pumping portion is in its full configuration and the vapor pumping portion is in its reduced configuration.
Figure 8:
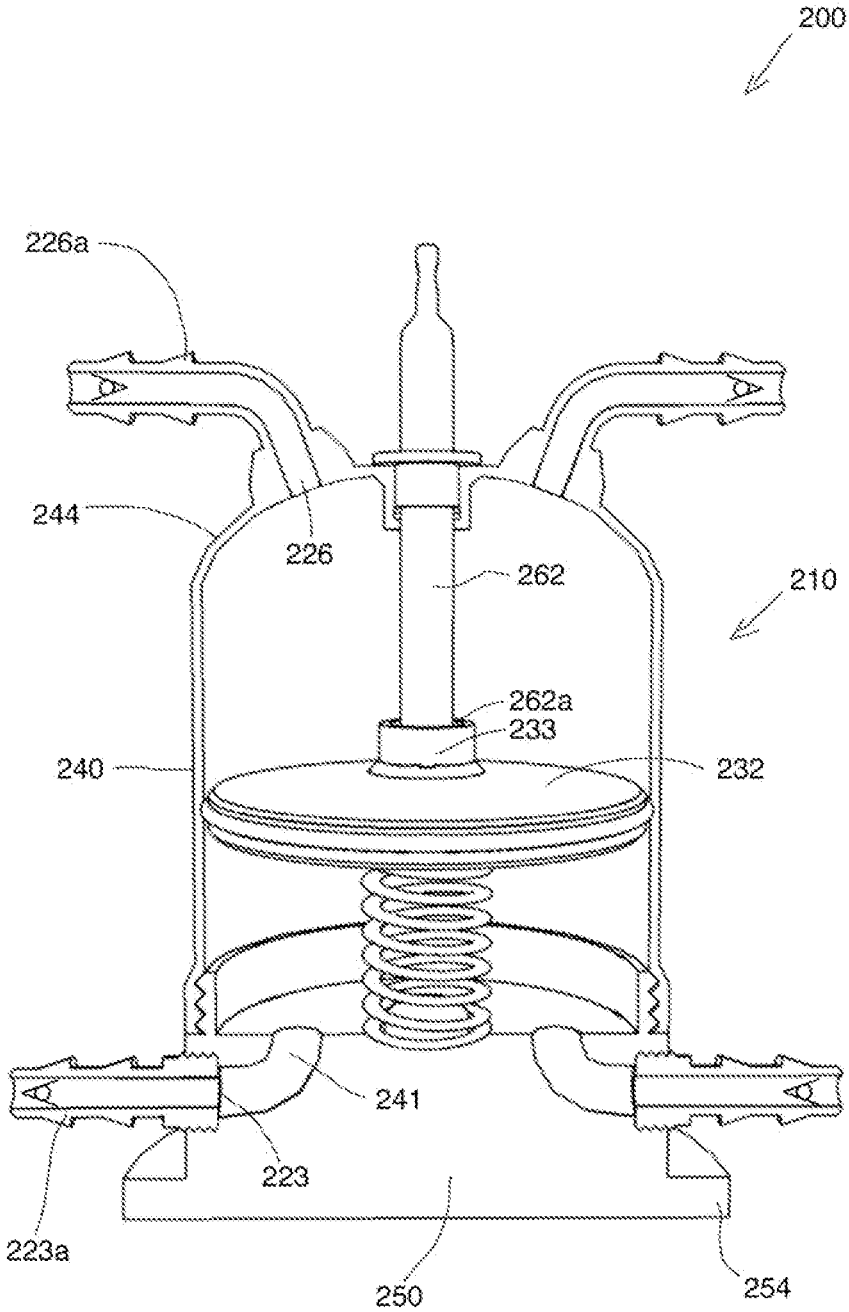
FIG. 8 is a sectional side elevational view similar to FIG. 7, but with the piston in position such that the liquid pumping portion is in its reduced configuration and the vapor pumping portion is in its full configuration.

In the second preferred embodiment portable fluid exchange system 200, the piston rod member 262 does not extend through the piston 232, but instead, the bottom end 262*a* of the piston rod member 262 is securely retained within an annular flange 233 projecting upwardly from the piston 232. Accordingly, there is no throughpassage in the piston rod member 262. Instead, the vapor outlet 226 is disposed in the rounded top portion 244 of the main body 240. The vapor outlet 226 comprises a barbed hose fitting 226*a* integrally molded to the rounded top portion 244 of the main body 240 at the vapor outlet 226. Also, the liquid inlet 223 has been repositioned slightly such that the liquid inlet throughpassage 241 in the main body 251 of the base member 250 projects latterly outwardly from the side of the base member 250. Further, the base member 250 has a laterally projecting annular flange 254 that serves to stabilize the portable fluid exchange system 200 when it is mounted onto a small platform 255, as can be seen in FIG. 5. Further, the source container 202 is a conventional portable fuel container, and the attachment means for attaching the portable fluid exchange system 200 to the source container 202 or the destination container 204, comprises a threaded cap 221 for threadably engaging the mouth 203 of the source container 202. A two-line container coupling means 207 is used to connect the liquid supply hose 206 so as to be in fluid communication with liquid in the source container 202 via an extension hose 206'. A vapor return hose 212 is also connected to the two-line container coupling means 207, so as to be in fluid communication with the source container 202.

The liquid inlet 223 of the liquid and vapor pumping means 210 is in fluid communication with the interior of the source container 202, via liquid supply hose 206 which is securely attached at its outlet end 206*b* to the barbed hose fitting 223*a*. The inlet end 206*a* of liquid supply hose 206 is securely attached to liquid supply nipple 208 of coupling means 207. The inlet end 206*a* of liquid supply hose 206 is in fluid communication with extension hose 206', which is securely connected to the nipple 211 of the coupling means 207. The coupling means 207 conveys liquid between the inlet end 206*a* of liquid supply hose 206 and the outlet end 209*a* of the extension hose 206'. The extension hose 206' extends downwardly into the portable fuel container 202 to draw liquid off the bottom so that liquid is pumped form the source container 202 into the variable volume liquid pumping portion 220 in this manner.

The vapor outlet 226 of the liquid and vapor pumping means 210 is in fluid communication with the interior of the source container 202, via a vapor return hose 212 which is securely attached to the barbed hose fitting 226*a* at its inlet end 212*a*. The outlet end 212*b* of the vapor return hose 212 is securely attached to the vapor return nipple 213 of the coupling means 207, which communicates the vapor into the interior of the source container 202 when properly installed.

is used to connect the liquid supply hose 206 so as to be in fluid communication with liquid in the source container 202 via an extension hose 206'. A vapor return hose 212 is also connected to the two-line container coupling means 207, so as to be in fluid communication with the source container 202.

It will be understood that in FIG. 5, the threaded cap 221 and the two-line container coupling means 207 are shown displaced from the mouth 203 of the portable fuel container 202 and not actually connected to it. In order to connect the liquid and vapor pumping means 210 in fluid communication with the interior of the portable fuel container 202, the outlet end of the extension hose 206' is connected to the nipple 211 on the two-line container coupling means 207. The inlet end 206*a* of the liquid supply hose 206 is connected to the liquid supply nipple 208 of coupling means 207, and the outlet end 212*b* of the vapor return hose 212 is connected to the vapor return nipple 213 of the coupling means 207. The extension hose 206' is lowered into the interior of the portable fuel container 202, and the threaded cap 221 is brought to the mouth 203 of the portable fuel container 202 and is threadably engaged thereon, to thereby secure the two-line container coupling means 207 in place and provide the aforementioned airtight leakproof seal.

Reference will now be made to FIGS. 9 through 12, which show a third preferred embodiment of the portable fluid exchange system of the present invention, as indicated by general reference numeral 300. The third preferred embodiment portable fluid exchange system 300 is similar to the first preferred embodiment of the portable fluid exchange system 100 of the present invention, with many elements being in common. Accordingly, elements in the third preferred embodiment portable fluid exchange system 300 that are common to, and essentially the same as, elements in the first preferred embodiment portable fluid exchange system 100, will not be specifically discussed with reference to the third preferred embodiment portable fluid exchange system 300, for the sake of brevity. Similar numbering has been used between the two embodiments to indicate commonality of functioning parts within each embodiment. For example, the liquid inlet 323 of the third preferred embodiment will be similar in function to the liquid inlet 123 of the first preferred embodiment, and so on. Only the significant differences between the third preferred embodiment portable fluid exchange system 300 and the first preferred embodiment portable fluid exchange system 100 will be discussed.

In the third preferred embodiment portable fluid exchange system 300, the piston rod member 362 extends up through to borehole 356 in the base member 350 but does not extend through the piston 332. Instead, the top end 362*a* of the piston rod member 362 is securely retained by an airtight leakproof seal within an annular recess 333 projecting upwardly from the piston 332. A leakproof seal between the piston rod member 362 and the borehole 356 is provided by "O"-rings 365*a* retained in the borehole 356 by bushing 365. The throughpassage 366 in the piston rod member 362 is open at its top end so as to be in fluid communication with the vapor pumping portion 322 of the liquid and vapor pumping means 310, and is in fluid communication at its bottom end with the vapor inlet 325 that is disposed at a barbed hose fitting 325*a*. The barbed hose fitting 325*a* is connected to the piston rod member 362 by means of a forty-five degree elbow 361. Further, the vapor outlet 326 comprises a plurality of small apertures in the main body 340, disposed in groups of four, that are in fluid communication with the interior of the source container 302. The flow of vapor through each group of four small apertures 326 is regulated by means of a check valve 326*b* represented as an umbrella style check valve.

The liquid outlet 324 is also repositioned where the barbed hose fitting 324*a* at the liquid outlet 324 is integrally molded with base member 350. Further, the base member 350 has a thin main body 351 and an upwardly projecting main annular flange 353. The liquid inlet 323 comprises a plurality of small apertures, disposed in groups of four, in the upwardly projecting annular flange 353, as can be best seen in FIG. 10. The flow of liquid through each group of four small apertures 323 is regulated by means of a check valve 323*b* represented as an umbrella style check valve.

The attachment means in the portable fluid exchange system 300 comprises a threaded cap 358 with an interior thread 359, which allows the portable fluid exchange system 300 to be attachable to the source container 302 at its mouth 303. The portable fluid exchange system 300 further comprises a mounting means for mounting the portable fluid exchange system 300 at least substantially within the interior of the source container 302 or the destination container 304. In the third preferred embodiment portable fluid exchange system 300, the mounting means comprises a laterally projecting annular flange 354 that fits within the threaded 358, to create an airtight leakproof seal between the liquid and vapor pumping means 310 and the source container 302.

It can also be seen in FIG. 9, that the source container 302 is non-conventional, and has a cylindrical main body 302*a* with a rounded top portion 302*b*, and a substantially vertically oriented slot 302*c* in one side of the cylindrical main body 302*a*, for receiving the nozzle and spout assembly 390 therein. Also, the cylindrical main body 302*a* is mountable to arc-shaped base portion 302*d*. A pair of wheels 301 is also mounted on the arc-shaped base portion, to permit the source container 302 to be readily moved round. The selectively controllable actuation mechanism 360 further comprises a pedal member 369 pivotally mounted on the axle 301*a* of the wheels 301. The pedal member 369 is connected at its central area in freely pivoting relation to the forty-five degree elbow 361 by means of two axially aligned posts 361*a* on the elbow 361.

Figure 9A:
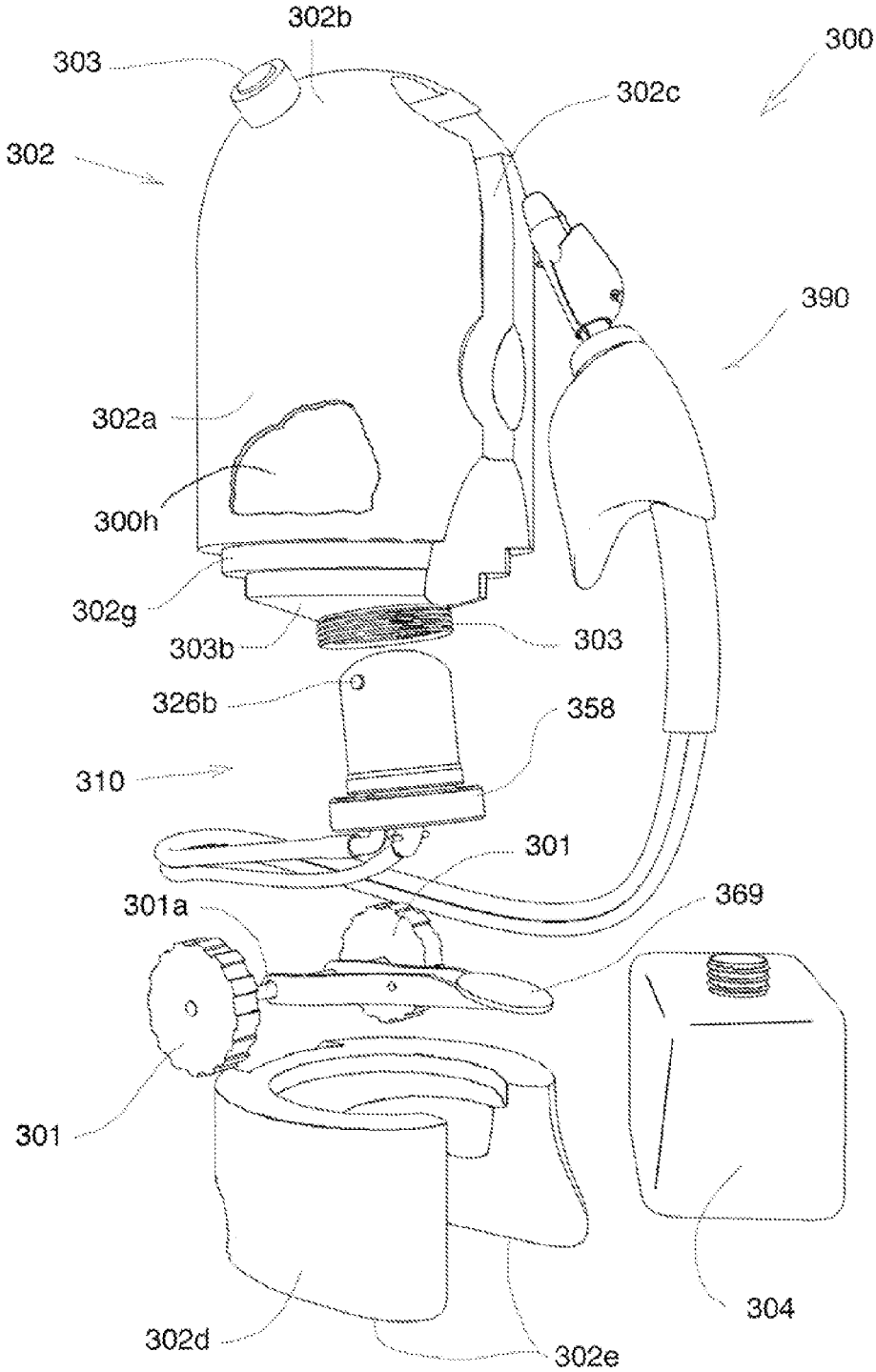
FIG. 9A is an exploded perspective view of the third preferred embodiment of the portable fluid exchange system according to the present invention.
Figure 9B:
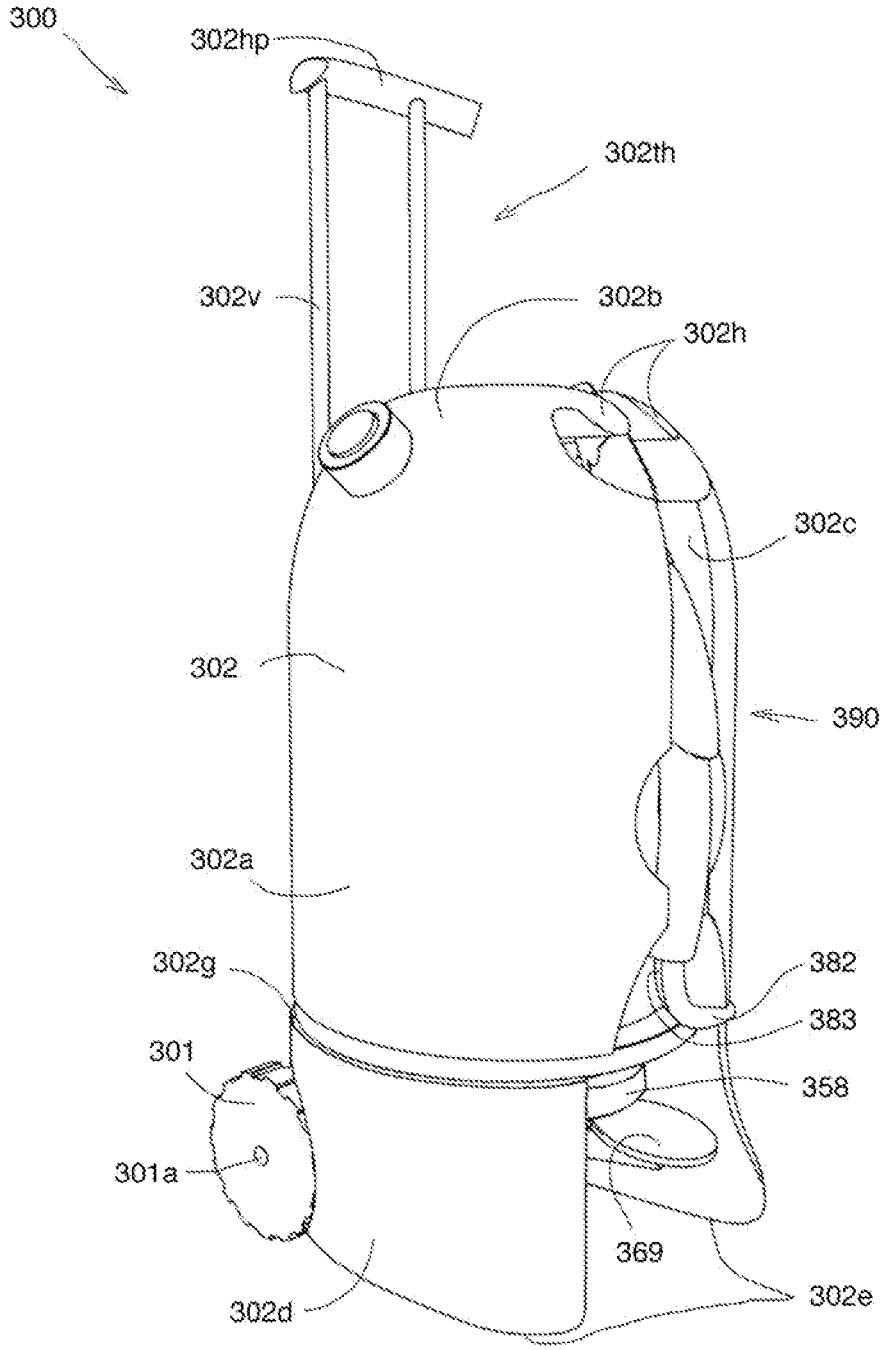
FIG. 9B is a perspective view from the front right of the third preferred embodiment portable fluid exchange system of FIG. 9A.
Figure 9C:
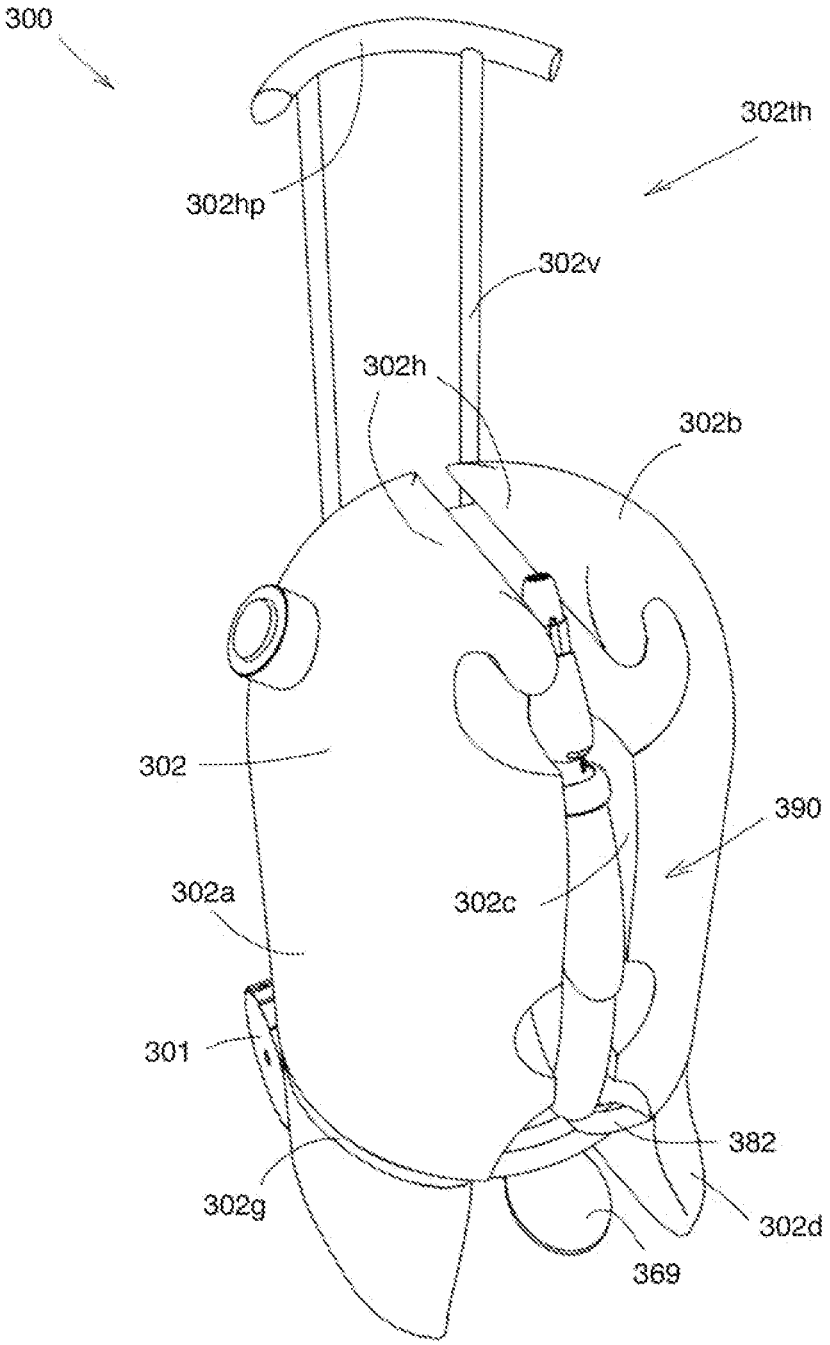
FIG. 9C is a front perspective view from above of the third preferred embodiment portable fluid exchange system of FIG. 9A.
Figure 9D:
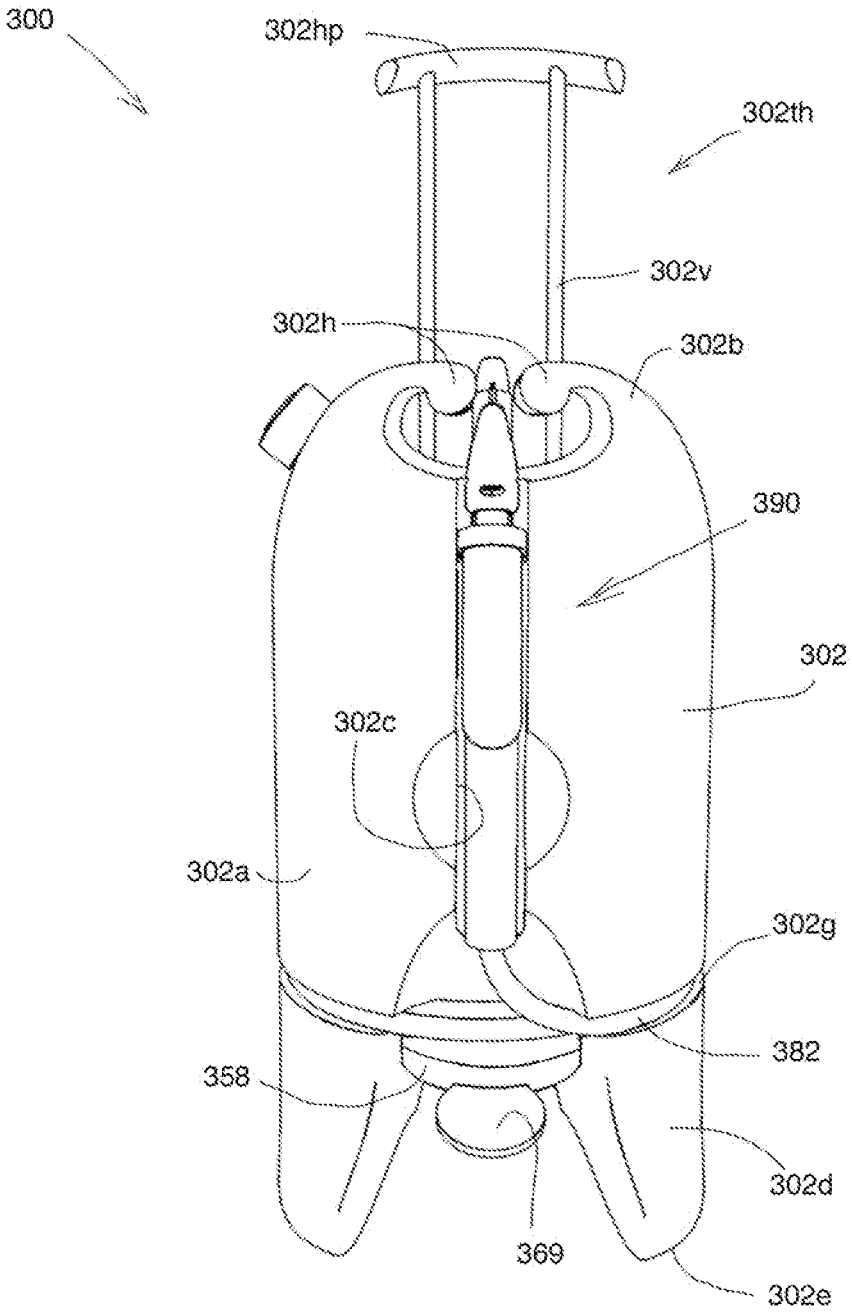
FIG. 9D is a front elevational view of the third preferred embodiment portable fluid exchange system of FIG. 9A.
Figure 9E:
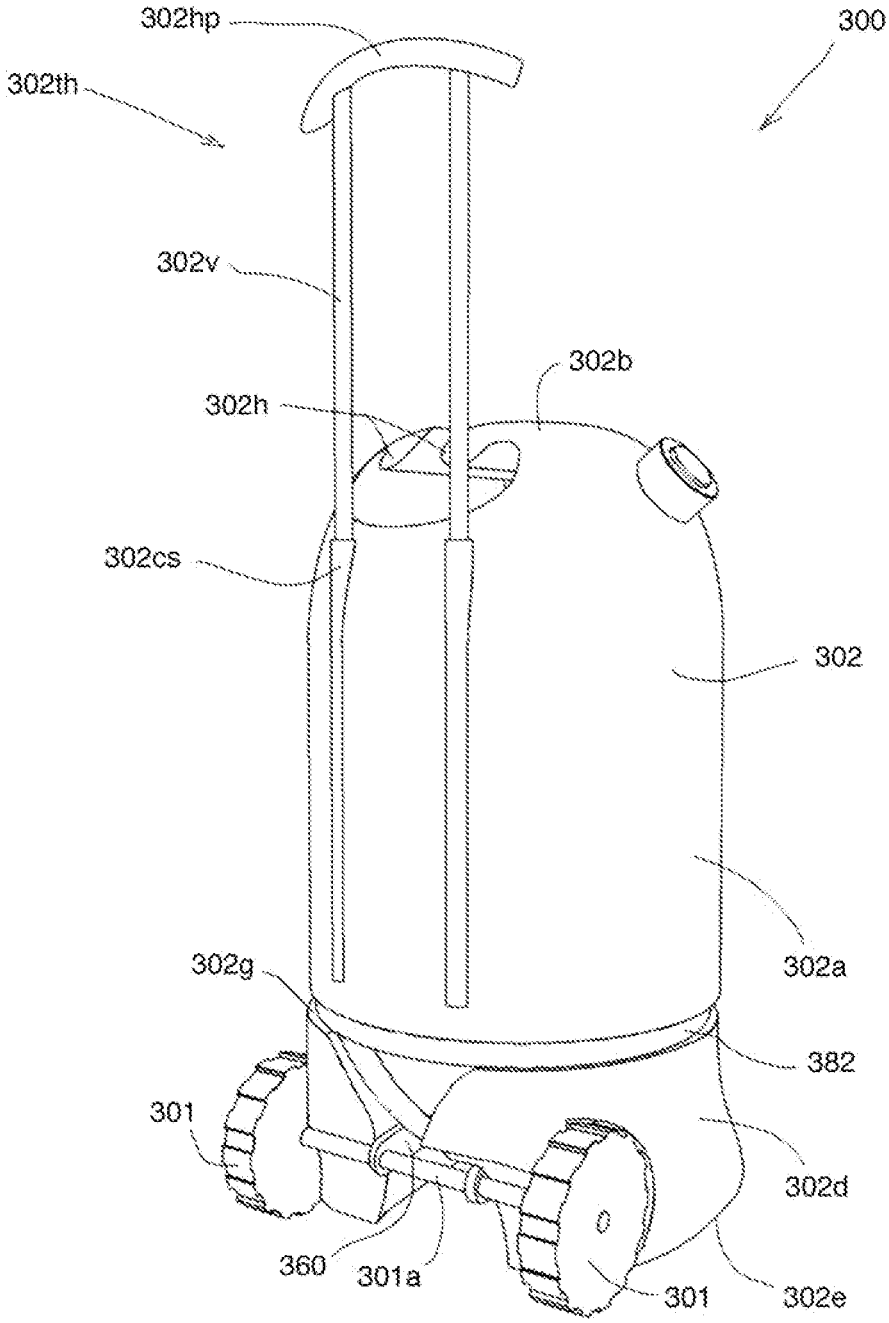
FIG. 9E is a perspective view from the back right of the third preferred embodiment portable fluid exchange system of FIG. 9A.

It will be understood that in FIG. 9A, the liquid and vapor pumping means 310 of the portable fluid exchange system 300 is shown separated from and between the cylindrical main body 302*a* and the arc-shaped base portion 302*d*. In use, the source container 302 will be fully assembled with the liquid and vapor pumping means 310 disposed within the interior of the source container 302. The interior thread 359 of the threaded cap 358 threadably engages the co-operating threads on the mouth 303 of the source container 302, to thereby secure the liquid and vapor pumping means 310 in place and provide the aforementioned airtight leakproof seal.

It can also be seen in FIG. 9A through 9E, that the source container 302 is non-conventional, and has a cylindrical main body 302*a* a rounded top portion 302*b*. The liquid and vapor pumping means 310 is enclosed by the source container 302. The mouth 303 of the source container 302 is disposed at the side of the rounded top portion 302*b*. There is a slot 302*c* in one side of the cylindrical main body 302*a*, offset 90° (ninety degrees) from the mouth 303, for receiving the nozzle and spout assembly 390 therein where it is retained in place in a similar manner to how a gas station nozzle is retained in place at a gas station. Disposed oppositely from the slot 302*c* is a retractable and extendable tow handle 302*th*, similar to luggage retractable and extendable tow handles, having a handle portion 302*hp* and a pair of vertically disposed arm members 302*v* retained in vertically sliding relation within a pair of co-operating cylindrical slots 302*cs*.

Also, the cylindrical main body 302*a* is mountable on a separate arc-shaped base portion 302*d*. The separate arc-shaped base portion 302*d* base allows the bottom 303*b* of the container 302 to be constructed where it does not have to be flat on the bottom and can be formed in such a way so that a pump can be attached directly to the bottom or underside of the container 302 where all the liquid will tend to flow. The arc-shaped base portion 302*d* is designed and formed to connect to and accommodated the bottom 303*b* of the container 302 and provides the over all assembly of this embodiment of a fluid exchange system 300 with a flat stable sturdy bottom 302*e* to rest on.

A pair of wheels 301 are mounted on the arc-shaped base portion 302*d* by means of an axle 301*a*, to permit the portable fluid exchange system 300 to be readily moved around. The selectively controllable actuation mechanism 360 further comprises a pedal member 369 pivotally mounted on the axle 301*a* of the wheels 301. The pedal member 369 is connected at its central area 369*a* in freely pivoting relation to the forty-five degree elbow 361 by means of two axially aligned posts 361*a* on the elbow 361. A toe step on the pedal member 369 permits ready pumping by means of a person's foot. The foot pedal 369 provides the mechanical advantage of leverage, which transfers the force applied to the toe step 369 to the piston rod member 362.

The ideal material for a piston rod member 362 would be metal but due to the arching motion of the pedal member 369 in embodiment three a flexible material such as plastic would be best suited for the piston rod member 362 in order to allow for the transverse movement of the forty-five degree elbow 361 which will move transversely relative to the liquid and vapor pump 310 when the pedal member 369 actuates the piston rod member. One skilled in the art will readily recognize that there are numerous ways, means and linkages that can appropriately convert the many various interactions between the pedal member 369 and piston rod member 362 into linear motion of the forty-five degree elbow 361 if there is a need to do so.

The assembly of the container 302 and arc-shaped base portion 302*d* provides a grooved recess 302*g* about the perimeter of the fluid exchange system 300 between where the container 302 and the arc-shaped base portion 302*d* meet. The grooved recess 302*g* is provided as a means to conveniently wrap the two line hose within for storage.

It will be understood that mounting the liquid and vapor pumping means 310 within the container 302 reduces permeation problems associated with volatile materials retained within the source container 302. In this case, only the container 302 and the base member 350 need to be constructed with permeation inhibiting technologies. With the rest of the liquid and vapor pumping means 310 mounted within the interior of the source container 302, the remainder of the pump components do not have to include any permeation inhibiting precautions.

Further, by mounting the pump inside the container leaking and permeation design considerations can be minimized, resulting in a pump and refueling system combination, which can be constructed very inexpensively relative to a pump that would be exterior to the container.

The placement of the liquid and vapor pumping means 310 in the source container 302, specifically at the bottom of the source container 302, where it can be used as a manual foot pump, is preferable; however, one skilled in the art can readily see how the liquid and vapor pumping means 310 of the present invention could be placed on either the top, bottom or side of the source container 302, or be oriented such that the selectively controllable actuation mechanism 360 is accessible from either the top, bottom or side of the liquid and vapor pumping means 310, and how the operation of the liquid and vapor pumping means 310 can be powered either manually by a persons foot or hand, or by an electric motor, fuel powered engine, or other such means as is known in the art.

The source container 302 further comprises a unique lifting handle arrangement. As shown in FIGS. 9A through 9J, a pair of lifting handles 302*h* are disposed at the top end of the rounded top portion 302*b*. The centerline of the lifting handles 302*h* are in the Z axis, which is perpendicular to the XY plane that the centerline of the mouth 303 of the source container 302 lies on. Containers with lifting handles typically orient the centerline of the lifting handle in the same plane as the centerline of the mouth 303 of the source container and this is done for ease of manufacturing reasons. In the present invention the orientation of the lifting handles 302*h* is perpendicular to the to the mouth 303 of the source container 302. This orientation of the lifting handles 302*h* provides an ergonomic axis of rotation for the source container 302 in an individual's hand, as the source container 302 is tipped forwardly, when pouring fuel out of the mouth 303 of the source container 302.

Figure 9F:
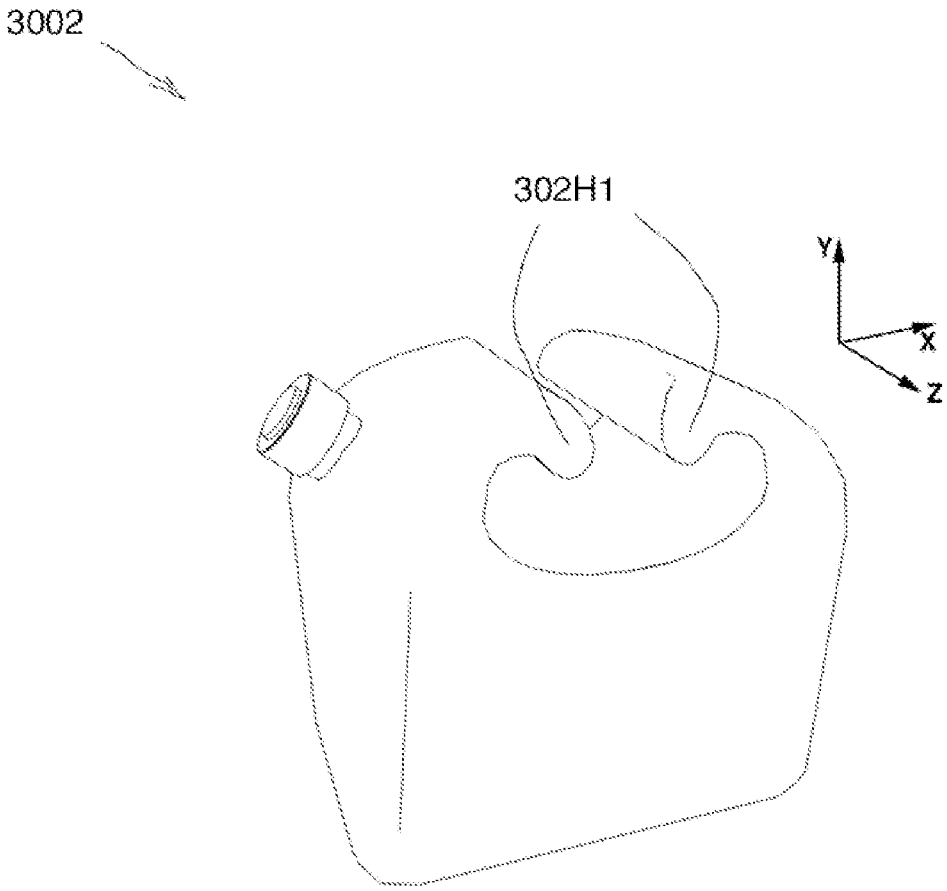
FIG. 9F is a perspective view from the front left of the first alternative embodiment of the third preferred embodiment portable fluid exchange system of FIG. 9A.
Figure 9G:
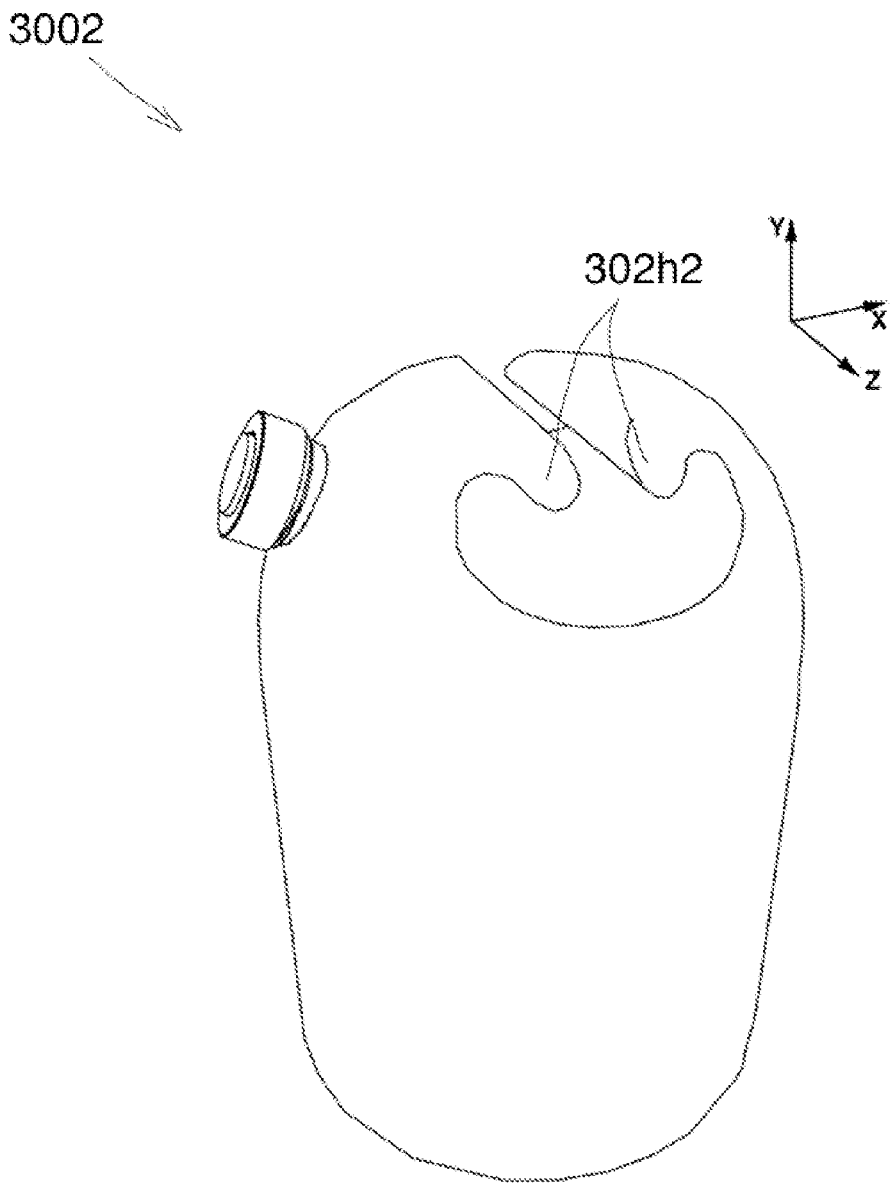
FIG. 9G is a perspective view from the front left of the second alternative embodiment of the third preferred embodiment portable fluid exchange system of FIG. 9A.
Figure 9H:
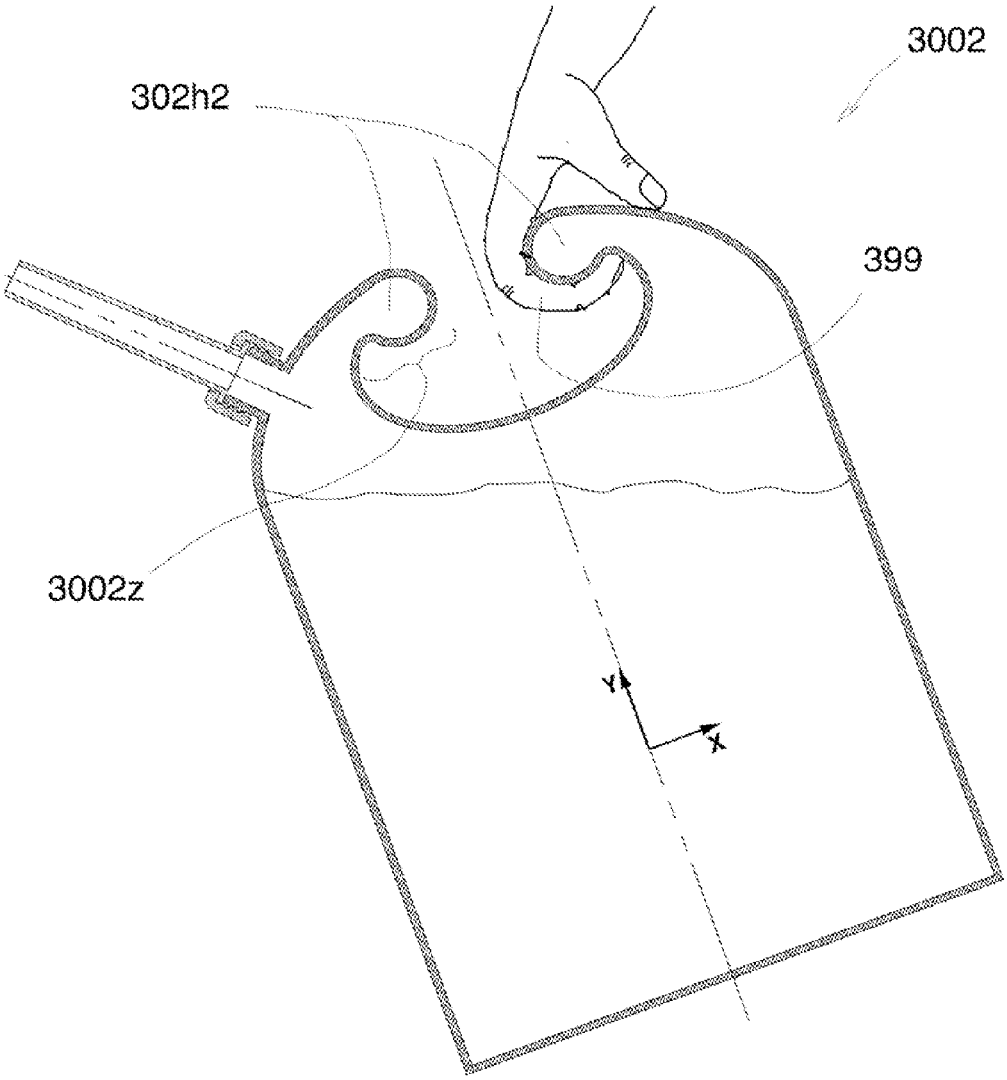
FIG. 9H is a cut-away side elevational view of the second alternative embodiment of the third preferred embodiment portable fluid exchange system of FIG. 9A.
Figure 9I:
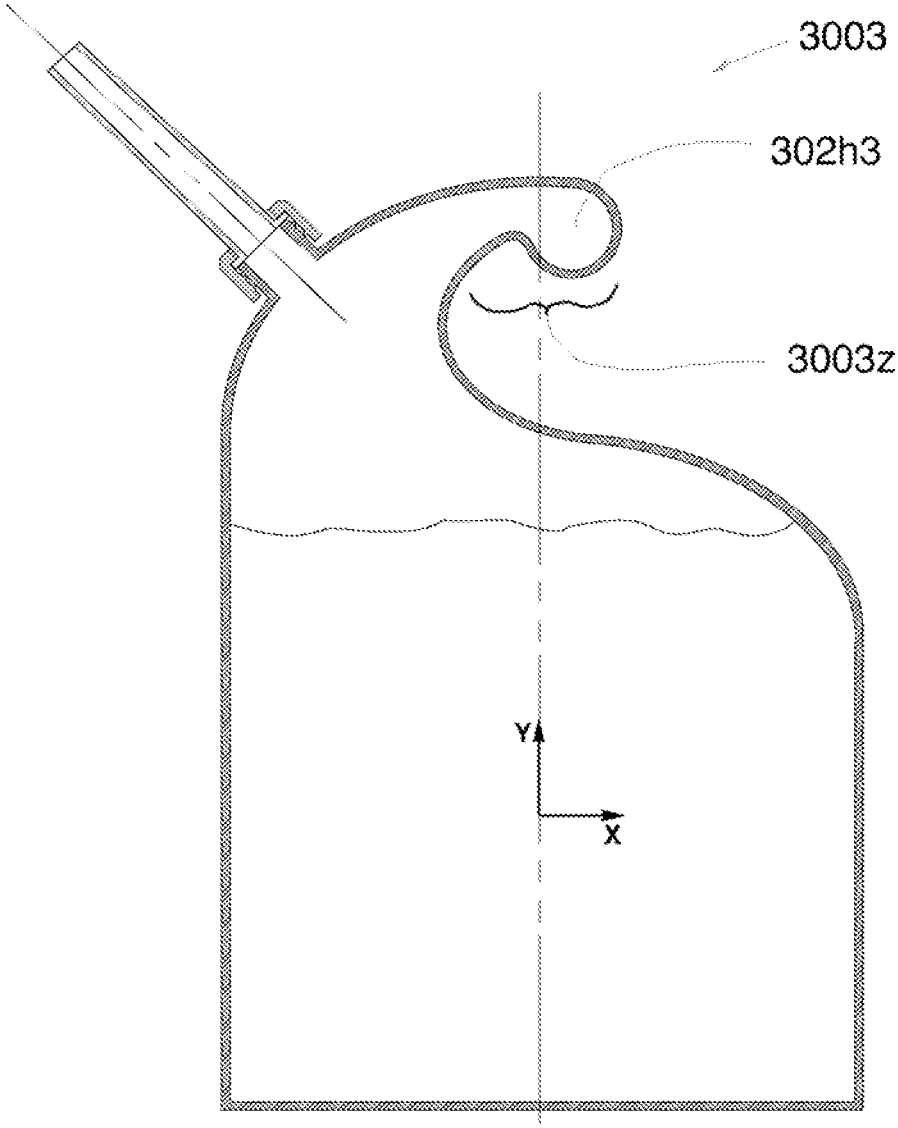
FIG. 9I is a cut-away side elevational view of the third alternative embodiment of the third preferred embodiment portable fluid exchange system of FIG. 9A.
Figure 9J:
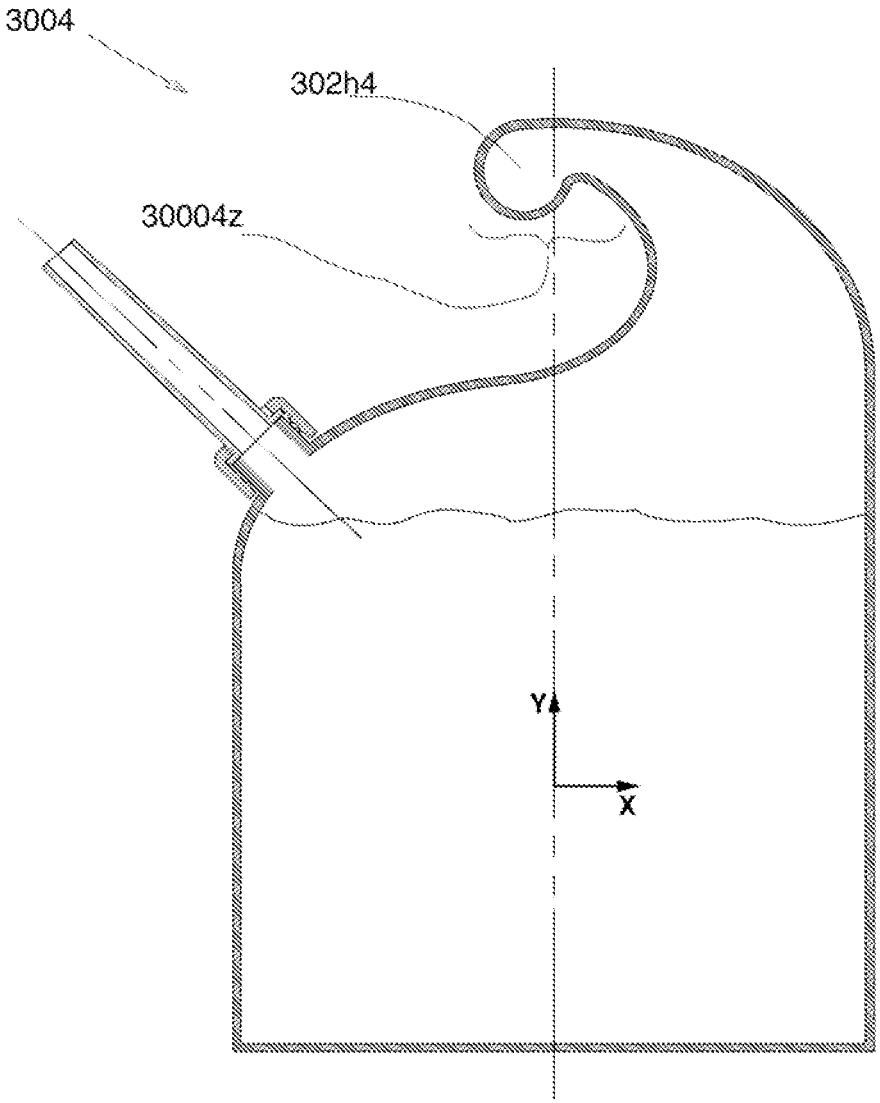
FIG. 9J is a cut-away side elevational view of the fourth alternative embodiment of the third preferred embodiment portable fluid exchange system of FIG. 9A.
Figure 10:
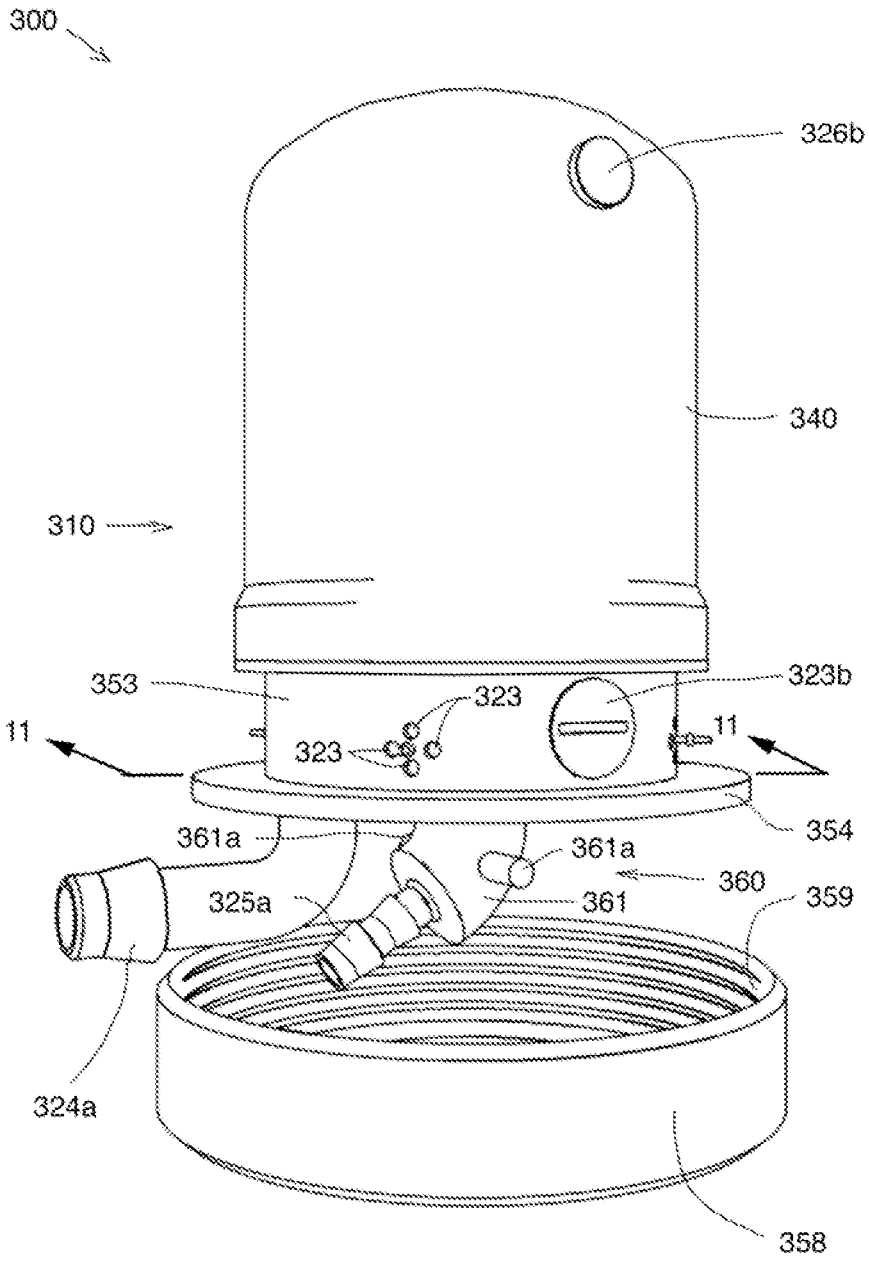
FIG. 10 is a side elevational view of the third preferred embodiment portable fluid exchange system of FIG. 9.
Figure 11:
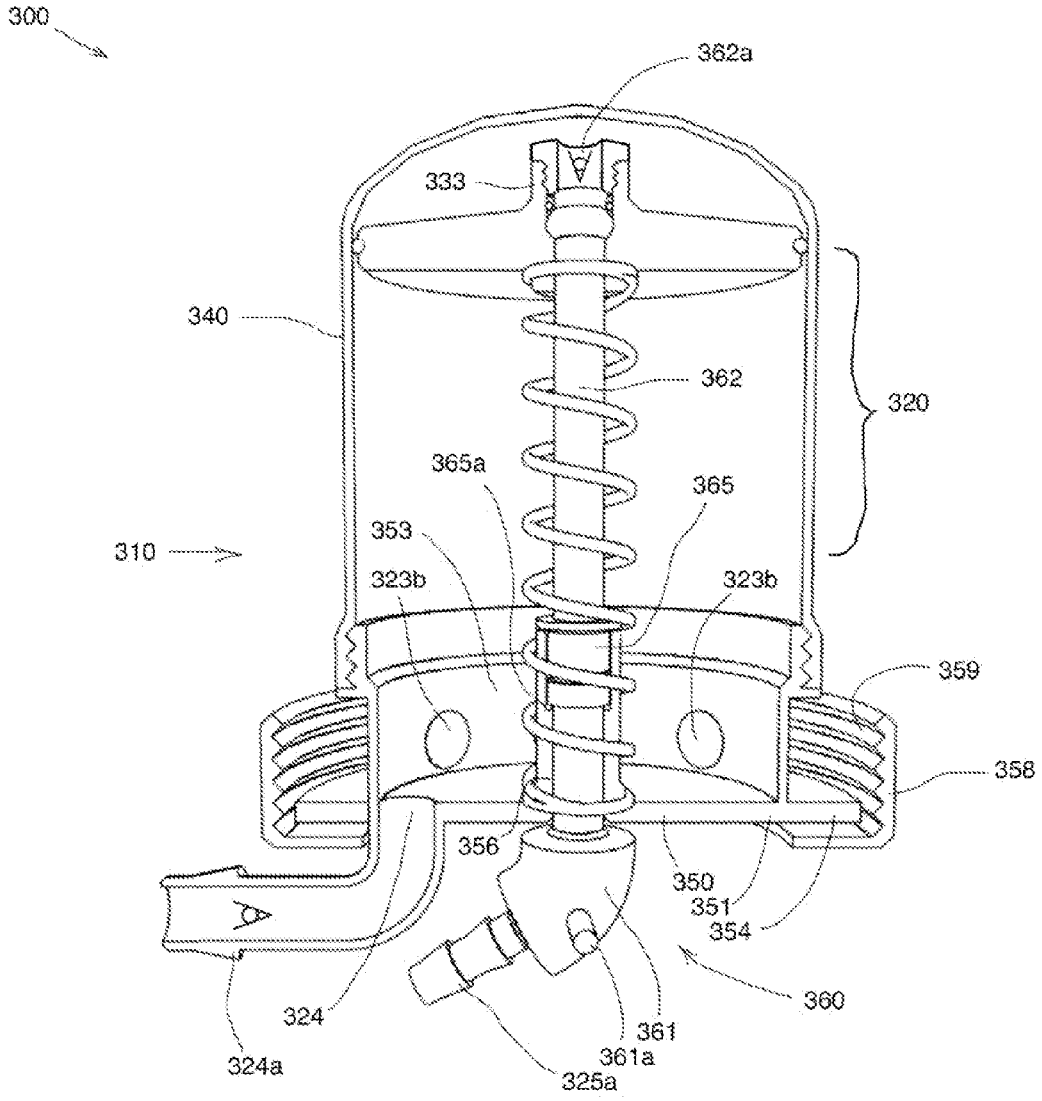
FIG. 11 is a sectional side elevational view of the third preferred embodiment portable fluid exchange system of FIG. 9, taken along section line 11-11 of FIG. 10, with the piston in position such that the liquid pumping portion is in its full configuration and the vapor pumping portion is in its reduced configuration.
Figure 12:
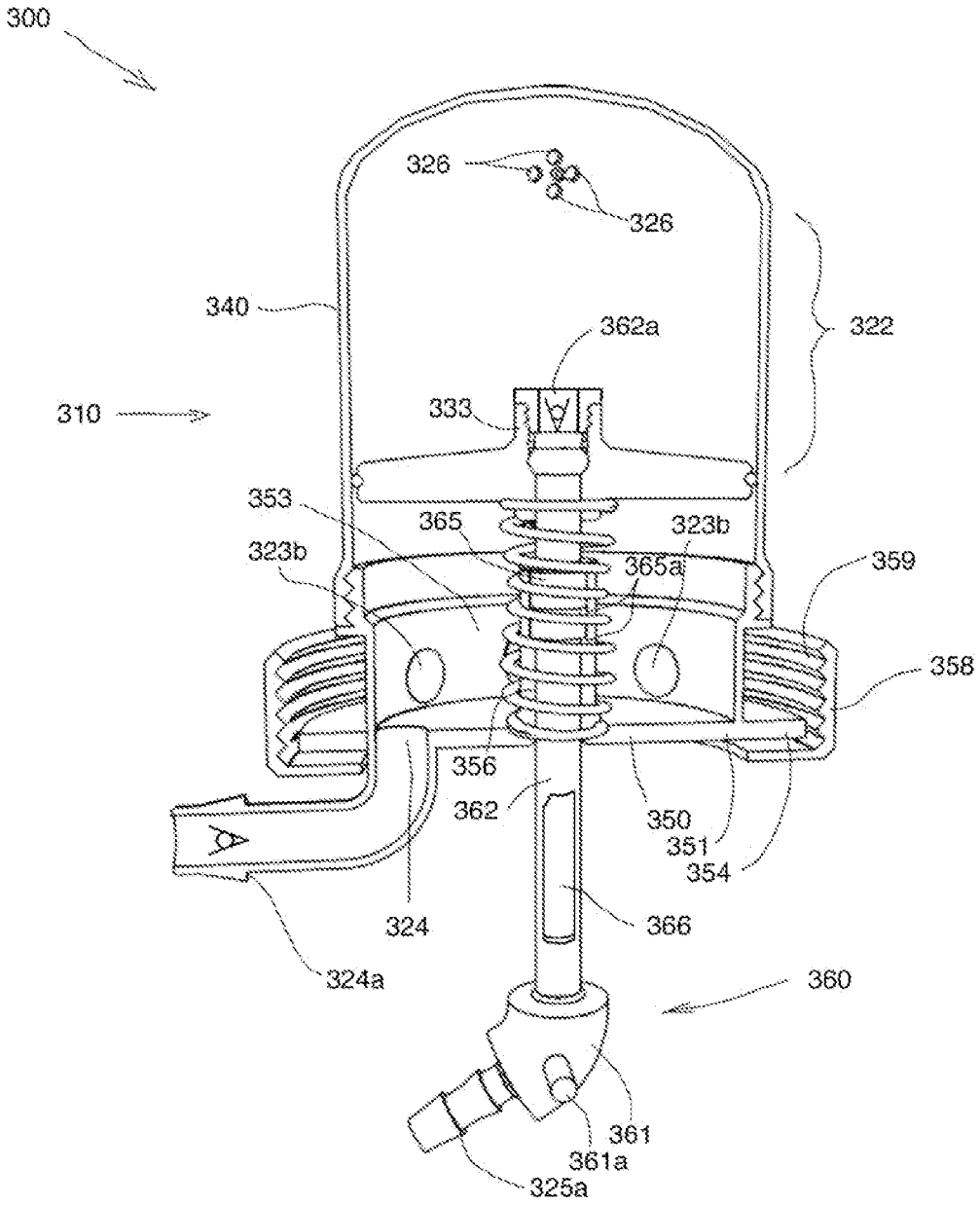
FIG. 12 is a sectional side elevational view similar to FIG. 11, but with the piston in position such that the liquid pumping portion is in its reduced configuration and the vapor pumping portion is in its full configuration.
Figure 13:
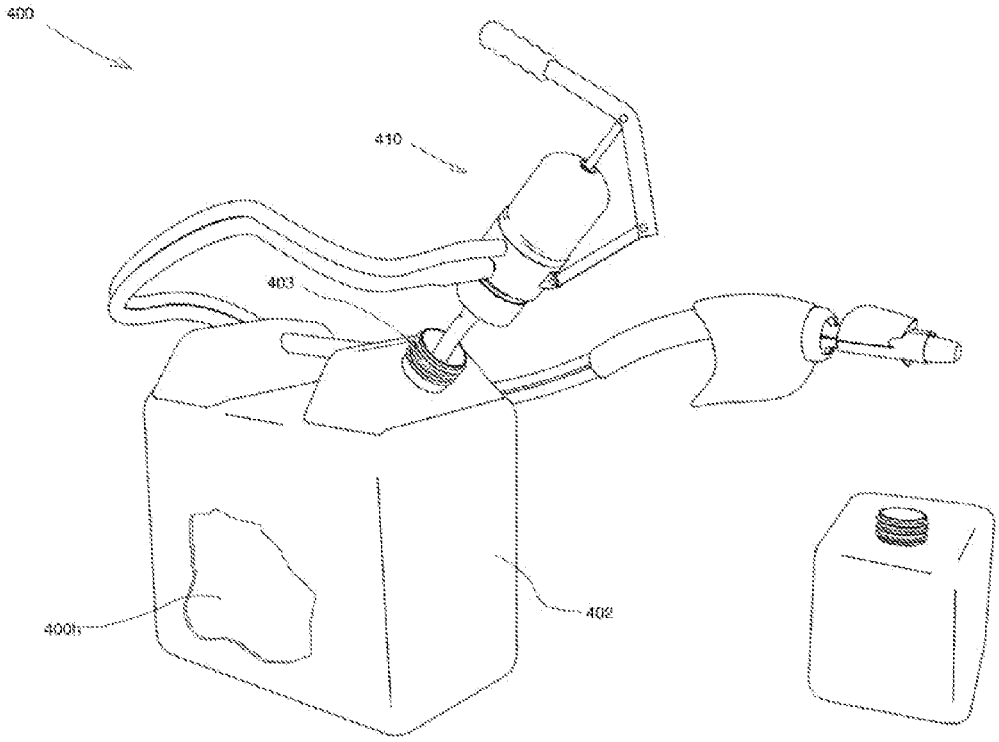
FIG. 13 is a perspective view from above of the fourth preferred embodiment of the portable fluid exchange system according to the present invention, about to be used to pump fuel from a portable fuel container type of source container to a portable fuel container type of destination container.
Figure 14:
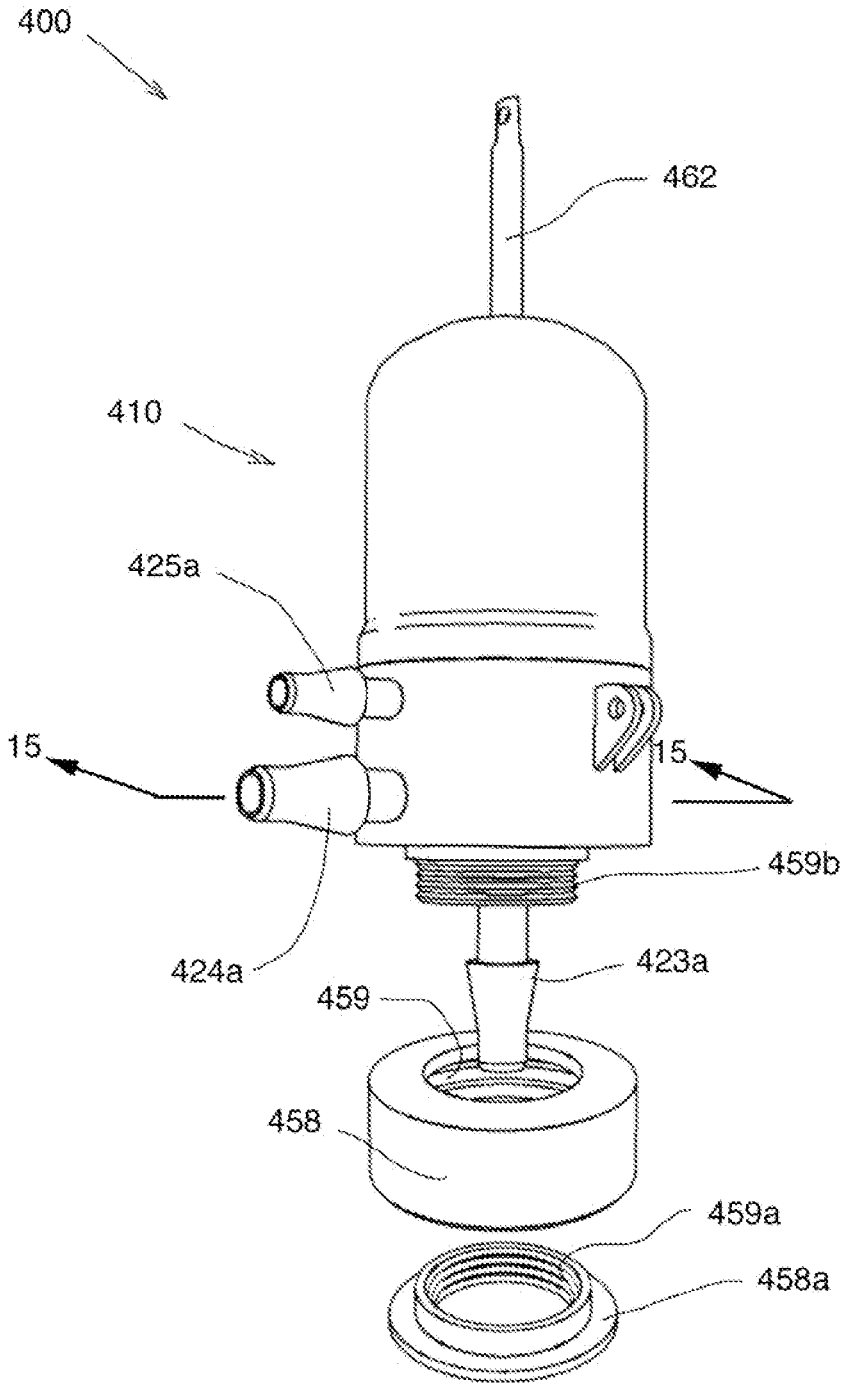
FIG. 14 is a partially exploded side elevational view of the fourth preferred embodiment portable fluid exchange system of FIG. 13.

The lifting handles 302*h* provide an ergonomic overhanging tubular formation 3001*z*, 3002*z* and 3004*z*, shown in FIGS. 9H, 9I and 9J respectively, available on the top of the source container 302, which allow a user to hook their fingers 399 underneath the lifting handles 302*h*, as seen in FIG. 9H, and comfortably curl them around the underside so that the source container 302 can be lifted.

The tubular formation at the end of the overhang can be positioned on or close to the centerline of the container, as in FIGS. 9I and 9J, or alternatively the tubular formation can be off center as in FIGS. 9F, 9G and 9H, which would cause the container to hang at an angle when it is lifted off the ground.

The cylindrical shape of the tubular handles as shown, but one skilled in the art will recognize that numerous shapes could be incorporated and or adapted to perform this function. The cross section of the handles could be any appropriate shape, which include but are not limited to circular, oval, diamond, square, rectangular, and so on.

Also, each tubular handle could have a uniform cross section down the length of its centerline or the cross-section could be non-uniform, wherein the cross-section could be more narrow towards the outside ends of the handle and fatter in the middle, such as the shape of a football, a sphere, and ellipsoid, and so on. One skilled in the art will recognize that the handles could be any appropriately shaped handhold whose form generally follows a centerline, which is perpendicular to the plane that the centerline of the container opening is on.

The handle arrangement of the present invention provides the consumer with the most ergonomic relationship between the centerline of the lifting handles 302*h* and the centerline of the mouth 303 of the source container 302. The lifting handles 302*h* has a centerline perpendicular to the XY plane that the centerline of the mouth 303 of the source container 302 lies in.

In a first alternative embodiment of the third preferred embodiment of the present invention, as can be seen in FIG. 9F and as indicated by general reference numeral 3001, the lifting handles 302*h*1 are similar to the lifting handles 302*h* of the third preferred embodiment portable fluid exchange system 300, but are inherently molded as part of the source container 3021 that is substantially different than the source container 302, wherein the substantial difference is a rectangular cross-section.

In a second alternative embodiment of the third preferred embodiment of the present invention, as can be seen in FIGS. 9G and 9H and as indicated by general reference numeral 3002, the lifting handles 302*h*2 are similar to the lifting handles 302*h* of the third preferred embodiment portable fluid exchange system 300, but are inherently molded as part of the source container 3022 that is only somewhat similar to the source container 302.

In a third alternative embodiment of the third preferred embodiment of the present invention, as can be seen in FIG. 9I and as indicated by general reference numeral 3003, there is only one lifting handle 302*h*3, which is similar to the forward one of the lifting handles 302*h*2 of the third alternative embodiment of the present invention.

In a fourth alternative embodiment of the third preferred embodiment of the present invention, as can be seen in FIG. 9J and as indicated by general reference numeral 3004, there is only one lifting handle 302*h*4, which is similar to the forward lifting handle 302*h*3 of the third alternative embodiment of the present invention.

The lifting handles as described in the third preferred embodiment of the present invention, alternatively have embodiments where the centerline of the lifting handles 302*h*, 302*h*1, 302*h*2, 302*h*3 and 302*h*4 is not constricted to the Z axis but could ergonomically lie at any angle within in the XZ plan or three dimensional space for that matter. The angle of the lifting handles centerline could be at any angel to the XY plane but ideally the angle would be between 80 degrees and 10 degrees.

Reference will now be made to FIGS. 13 through 16, which show a fourth preferred embodiment of the portable fluid exchange system of the present invention, as indicated by general reference numeral 400. The fourth preferred embodiment portable fluid exchange system 400 is similar to the first preferred embodiment of the portable fluid exchange system 100 of the present invention, with many elements being in common. Accordingly, elements in the fourth preferred embodiment portable fluid exchange system 400 that are common to, and essentially the same as, elements in the first preferred embodiment portable fluid exchange system 100, will not be specifically discussed with reference to the fourth preferred embodiment portable fluid exchange system 400, for the sake of brevity. Similar numbering has been used between the two embodiments to indicate commonality of functioning parts within each embodiment. For example, the liquid inlet 423 of the fourth preferred embodiment will be similar in function to the liquid inlet 123 of the first preferred embodiment, and so on. Only the significant differences between the fourth preferred embodiment portable fluid exchange system 400 and the first preferred embodiment portable fluid exchange system 100 will be discussed.

In the fourth preferred embodiment portable fluid exchange system 400, the pumping mechanism 430 comprises a movable pumping member 432 disposed within the substantially hollow chamber 446 so as to divide the substantially hollow chamber 446 into the variable volume liquid pumping portion 420 and the variable volume vapor pumping portion 422. More specifically, the pumping mechanism 430 comprises a bellows member 432 that is open at its bottom end 431*b* and secured to the base member 450 by a leakproof seal shown in FIGS. 15 and 16 to be a threaded connection.

The pumping mechanism 430 is operatively disposed within the substantially hollow chamber 446 so as to divide the substantially hollow chamber 446 in sealed relation into the variable volume liquid pumping portion 420 and the variable volume vapor pumping portion 422 that are fluidically isolated one from the other by the pumping mechanism 430, specifically the movable pumping member 432. The variable volume liquid pumping portion 420 is in fluid communication with the liquid inlet 423 and the liquid outlet 424 and the variable volume vapor pumping portion 422 is in fluid communication with the vapor inlet 425 and the vapor outlet 426.

Figure 15:
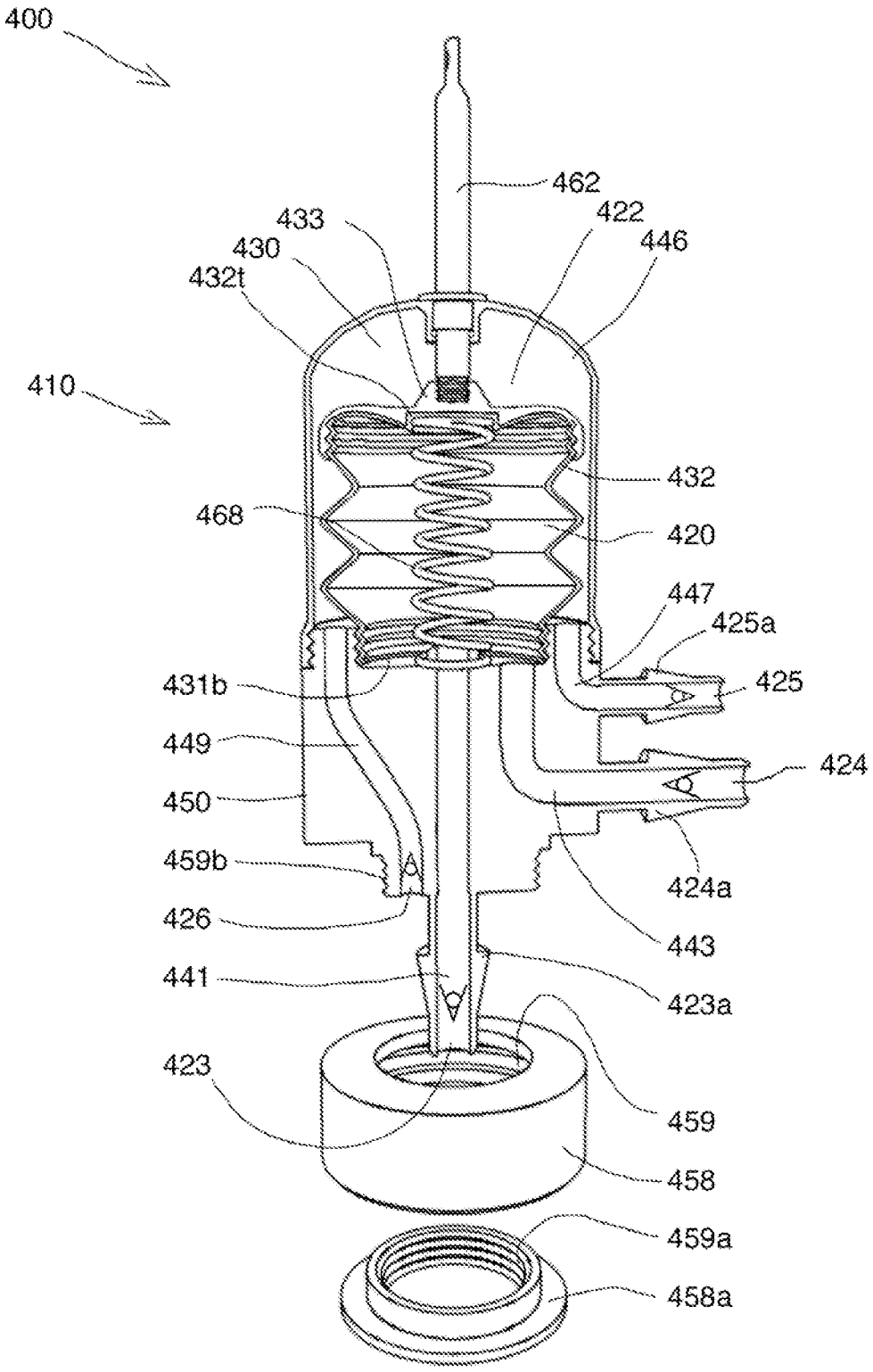
FIG. 15 is a partially exploded sectional side elevational view of the fourth preferred embodiment portable fluid exchange system of FIG. 13, taken along section line 15-15 of FIG. 14, with the bellows member in position such that the liquid pumping portion is in its full configuration and the vapor pumping portion is in its reduced configuration.
Figure 16:
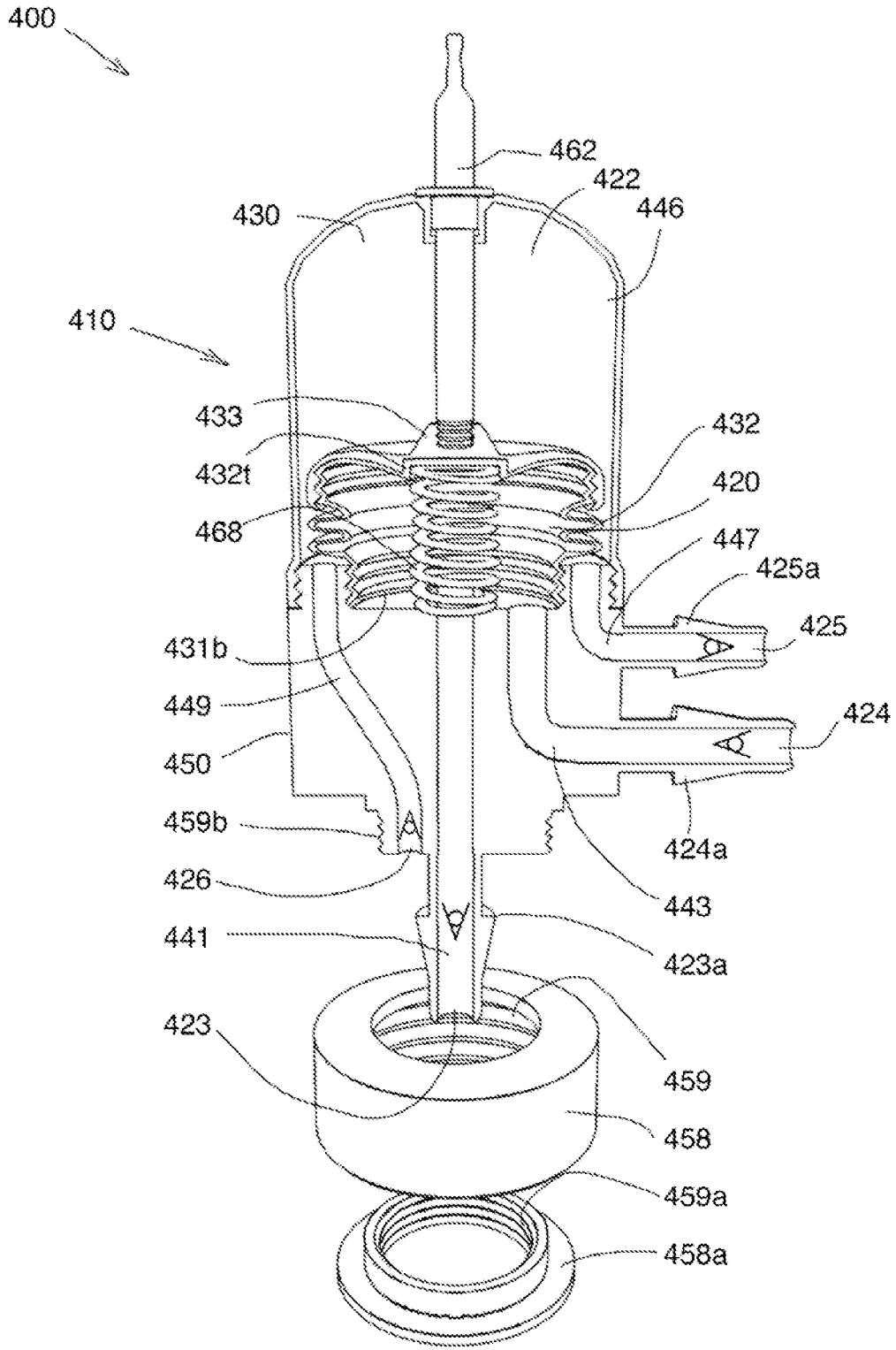
FIG. 16 is a partially exploded sectional side elevational view similar to FIG. 15, but with the bellows member in position such that the liquid pumping portion is in its reduced configuration and the vapor pumping portion is in its full configuration.

The pumping mechanism 430 of the first preferred embodiment portable fluid exchange system 400 is moveable between a pre-determined full configuration of the liquid pumping portion, as shown in FIG. 15, and a pre-determined full configuration of the vapor pumping portion, as shown in FIG. 16. When the pumping mechanism 430 moves from the full configuration of the liquid pumping portion 420 to the full configuration of the vapor pumping portion 422, liquid within the variable volume liquid pumping portion 420 is pumped from the variable volume liquid pumping portion 420 through the liquid outlet 424 and vapor is pumped into the variable volume vapor pumping portion 422 of the substantially hollow chamber 446 through the vapor inlet 425. When the pumping mechanism 430 moves from the full configuration of the vapor pumping portion 422 to the full configuration of the liquid pumping portion 420, vapor within the full configuration of the vapor pumping portion 422 of the substantially hollow chamber 446 is pumped from the variable volume vapor pumping portion 422 through the vapor outlet 426, and liquid is pumped into the variable volume liquid pumping portion 420 through the liquid inlet 423.

In the fourth preferred embodiment portable fluid exchange system 400, as illustrated, the actuation mechanism comprises a rod member 462 that actuates the bellows member 432. The rod member 462 is secured to the bellows member 432 by a top plate member 432*t*. The biasing means 468 comprises a coil spring 468 operatively interposed between the top plate member 432*t* and the base member 450 such that the spring member 468 biases the top plate member 432*t* upwardly, to the full configuration of the liquid pumping portion 420, as shown in FIG. 15. This is also the reduced configuration of the vapor pumping portion 422.

The rod member 462, which does not communicate fluid, is threadably engaged to the top plate member 432*t* at its raised central portion 433 by cooperating threads such that up-and-down vertical movement of the rod member 462 moves the top plate member 432*t* correspondingly, thus moving the bellows member 432 from the full configuration of the liquid pumping portion 420, to the reduced configuration of the liquid pumping portion 420, as shown in FIG. 16.

The base member 450 is substantially thicker than in the first preferred embodiment portable fluid exchange system 100. The liquid inlet 423 is shown to be a straight throughpassage 441 in the base member 450, which throughpassage 441 extends through a barbed hose fitting 423*a* that is integrally formed with the base member 450. The liquid outlet 424 is shown to be a curved throughpassage 443 in the base member 450, which throughpassage 443 extends through a barbed hose fitting 424*a* that is integrally formed with the base member 450. The vapor inlet 425 is shown to be a curved throughpassage 447 in the base member 450, which throughpassage 447 extends through a barbed hose fitting 425*a* that is integrally formed with the base member 450. The vapor outlet 426 is shown to be an "S"-shaped throughpassage 449 in the base member 450.

The attachment means of the portable fluid exchange system 400 comprises a threaded cap 458 with an interior thread 459, and a collar member 458*a* with an internal thread 459*a* that is compatible with the threaded shoulder 459*b* on the base member 450 of the portable fluid exchange system 400. The threaded cap 458 and the collar member 458*a* together allow the portable fluid exchange system 400 to be attachable to the source container 402 at its mouth 403, in an air tight leak proof manner such that the liquid inlet 423 and the vapor outlet 426 are in fluid communication with the interior of the source container 402.

Reference will now be made to FIGS. 17 through 20, which show a fifth preferred embodiment of the portable fluid exchange system of the present invention, as indicated by general reference numeral 500. The fifth preferred embodiment portable fluid exchange system 500 is similar to the fourth preferred embodiment of the portable fluid exchange system 400 of the present invention, with many elements being in common. Accordingly, elements in the fifth preferred embodiment portable fluid exchange system 500 that are common to, and essentially the same as, elements in the fourth preferred embodiment portable fluid exchange system 400, will not be specifically discussed with reference to the fifth preferred embodiment portable fluid exchange system 500, for the sake of brevity. Similar numbering has been used between the two embodiments to indicate commonality of functioning parts within each embodiment. For example, the liquid inlet 523 of the fifth preferred embodiment will be similar in function to the liquid inlet 423 of the fourth preferred embodiment, and so on. Only the significant differences between the fifth preferred embodiment portable fluid exchange system 500 and the fourth preferred embodiment portable fluid exchange system 400 will be discussed.

In the fifth preferred embodiment portable fluid exchange system 500, the liquid inlet 523 is at the side 550*s* and is shown as curved throughpassage 541 in the base member 550, which throughpassage 541 extends through a barbed hose fitting 523*a* that is integrally formed with the base member 550. Also, the vapor outlet 526 is also a curved throughpassage 549 in the base member 550, which throughpassage 549 extends through a barbed hose fitting 526*a* that is integrally formed with the base member 550.

The attachment means of the portable fluid exchange system 500 comprises a threaded cap 558 with an interior thread 559 that threadably engages the threaded mouth 503 of the source container 502, and a collar member 558*a* with an internal thread 559*a* that threadably engages the threaded side portion 559*b* of the base member 550. The threaded cap 558 and the collar member 558*a* together allow the portable fluid exchange system 500 to be attachable to the source container 502 at its mouth 503 in an airtight leakproof manner such that the liquid inlet 523 and the vapor outlet 526 are in fluid communication with the interior of the source container 502.

Figure 17:
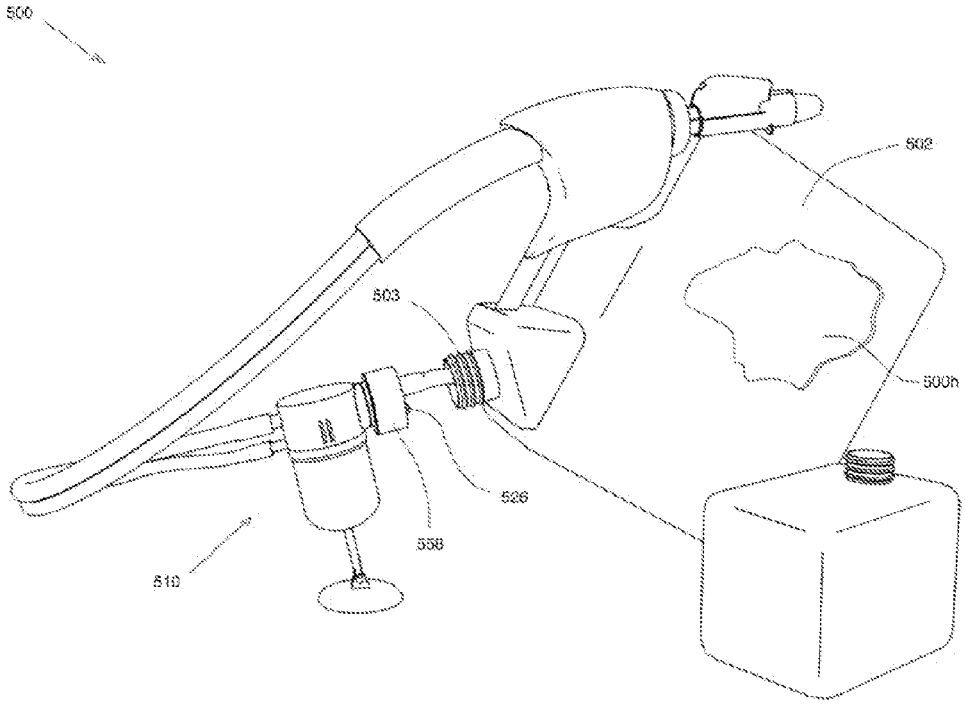
FIG. 17 is a perspective view from above of the fifth preferred embodiment of the portable fluid exchange system according to the present invention, about to be used to pump fuel from a portable fuel container type of source container to a portable fuel container type of destination container.
Figure 18:
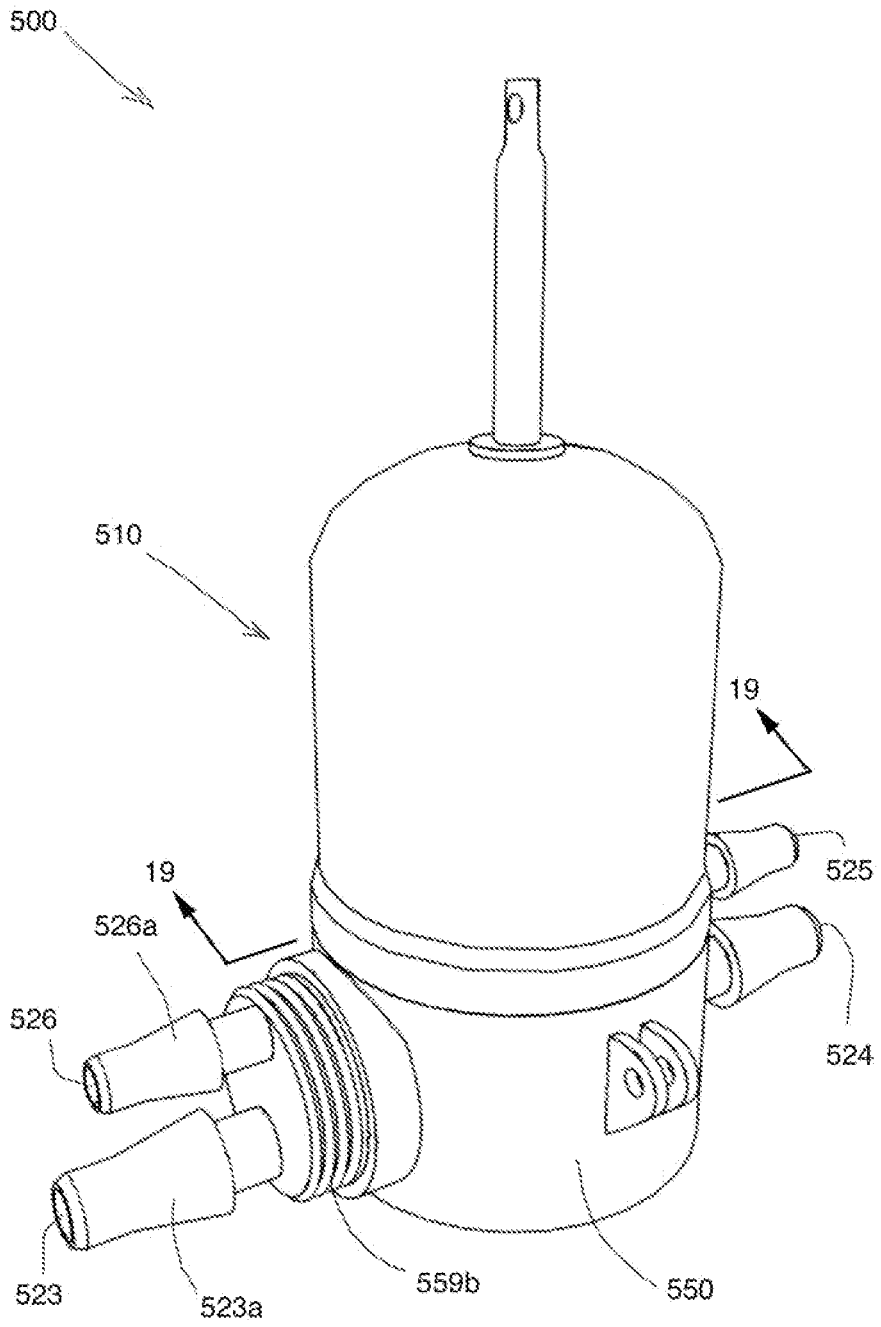
FIG. 18 is a side elevational view of the fifth preferred embodiment portable fluid exchange system of FIG. 17.
Figure 19:
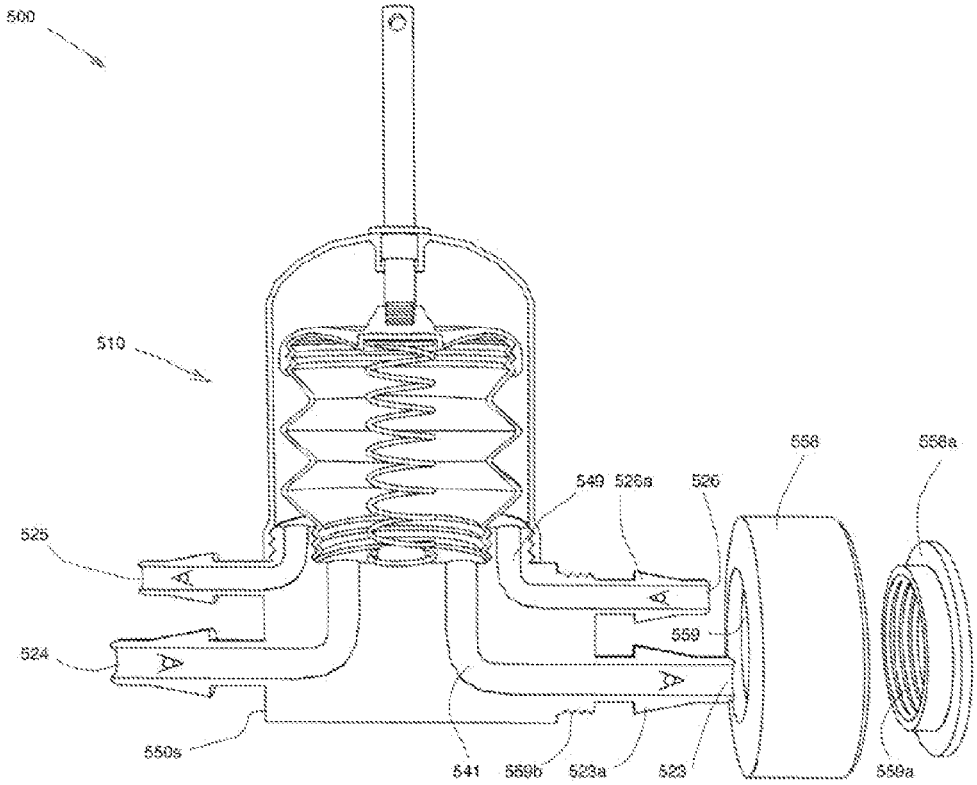
FIG. 19 is a partially exploded sectional side elevational view of the fifth preferred embodiment portable fluid exchange system of FIG. 17, taken along section line 19-19 of FIG. 18, with the bellows member in position such that the liquid pumping portion is in its full configuration and the vapor pumping portion is in its reduced configuration.
Figure 20:
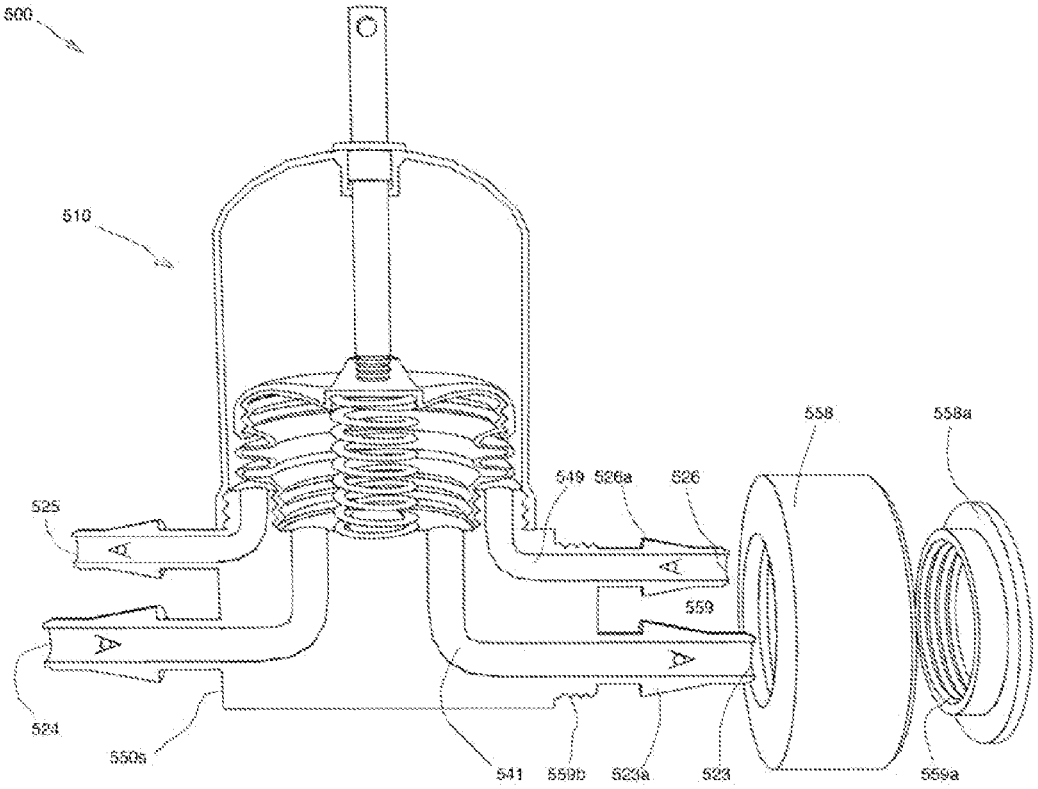
FIG. 20 is a partially exploded sectional side elevational view similar to FIG. 19, but with the bellows member in position such that the liquid pumping portion is in its reduced configuration and the vapor pumping portion is in its full configuration.
Figure 21:
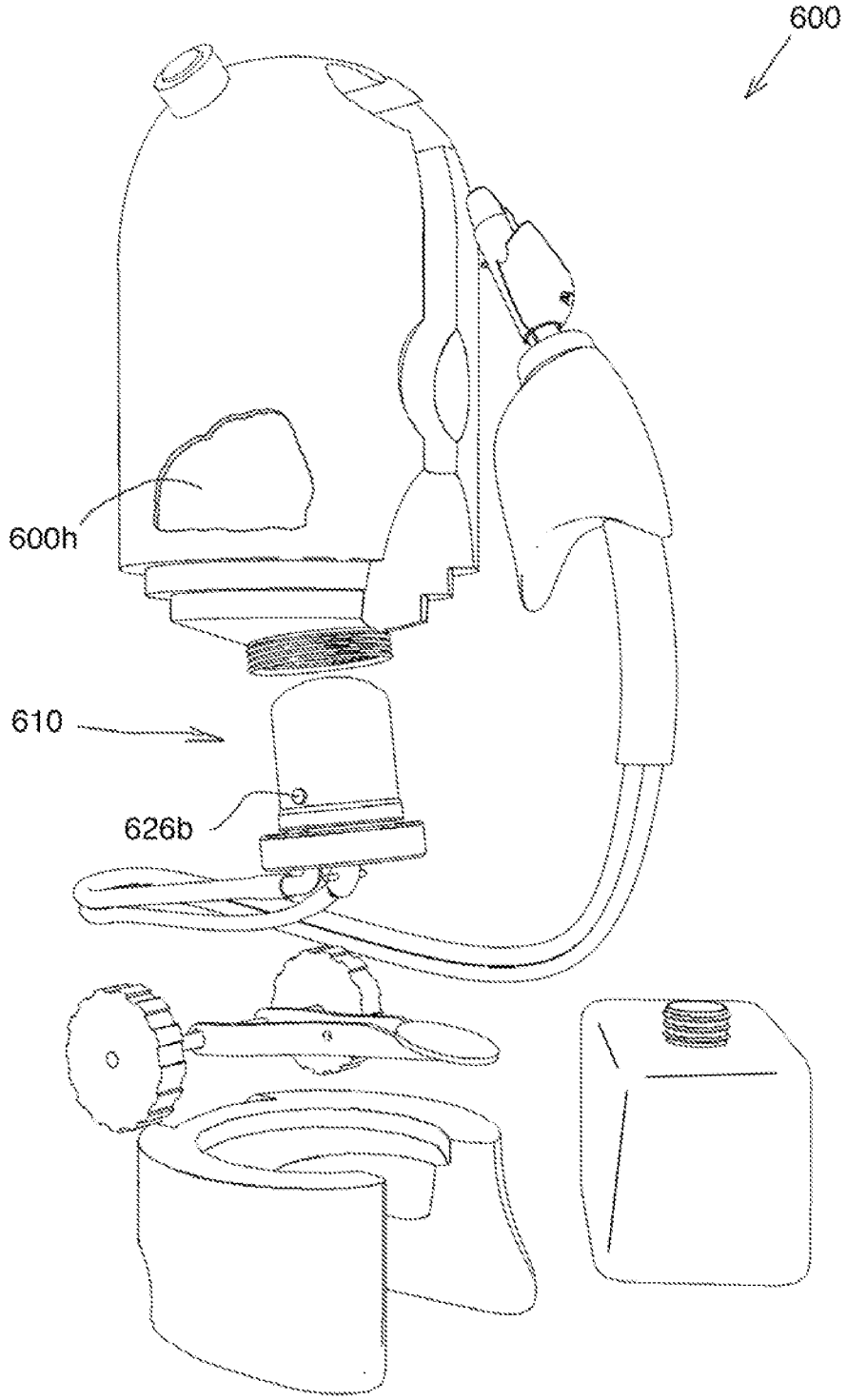
FIG. 21 is a perspective view from above of the sixth preferred embodiment of the portable fluid exchange system according to the present invention, about to be used to pump fuel from a portable fuel container type of source container to a portable fuel container type of destination container.
Figure 22:
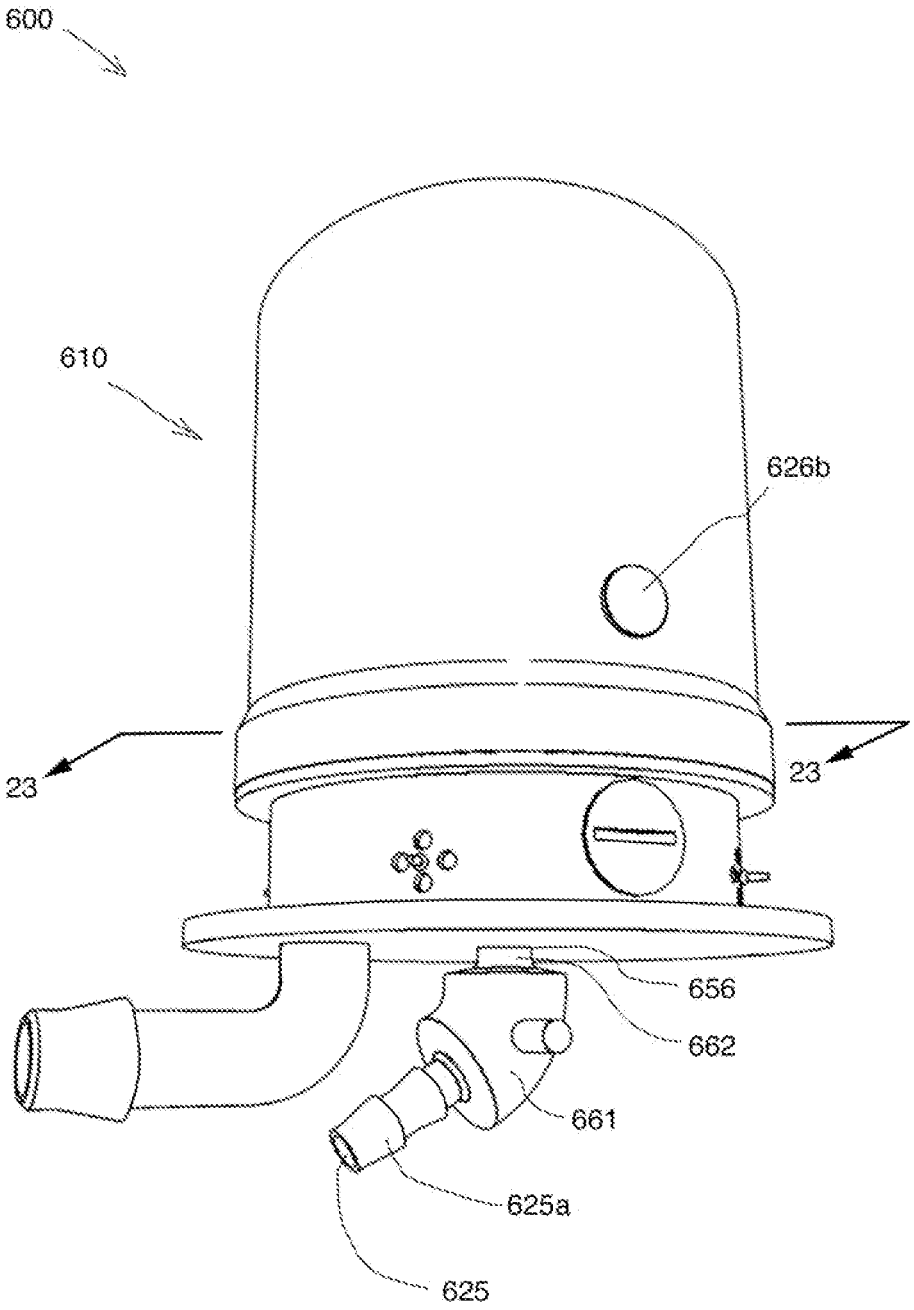
FIG. 22 is a side elevational view of the sixth preferred embodiment portable fluid exchange system of FIG. 21.

In the fifth preferred embodiment portable fluid exchange system 500, the liquid and vapor pump 510 is mountable to a source container 502 such that the liquid and vapor pump 510 could be used as a foot pump, as shown in FIG. 17.

Reference will now be made to FIGS. 21 through 24, which show a sixth preferred embodiment of the portable fluid exchange system of the present invention, as indicated by general reference numeral 600. The sixth preferred embodiment portable fluid exchange system 600 is similar to the third preferred embodiment of the portable fluid exchange system 300 of the present invention, with many elements being in common. Accordingly, elements in the sixth preferred embodiment portable fluid exchange system 600 that are common to, and essentially the same as, elements in the third preferred embodiment portable fluid exchange system 300, will not be specifically discussed with reference to the sixth preferred embodiment portable fluid exchange system 600, for the sake of brevity. Similar numbering has been used between the two embodiments to indicate commonality of functioning parts within each embodiment. For example, the liquid inlet 623 of the sixth preferred embodiment will be similar in function to the liquid inlet 323 of the third preferred embodiment, and so on. Only the significant differences between the sixth preferred embodiment portable fluid exchange system 600 and the third preferred embodiment portable fluid exchange system 300 will be discussed.

In the sixth preferred embodiment portable fluid exchange system 600, the rod member 662 extends up through borehole 656 in the base member 650, on through the bellows pumping member 632 and into the top plate member 632*t* where the top end 662*a* of the rod member 662 is securely retained by an airtight leak proof seal within an annular recess 633 projecting upwardly from the top of the top plate member 632*t*. The throughpassage 666 in the rod member 662 is open at its top end so as to be in fluid communication with the vapor pumping portion 622 of the liquid and vapor pumping means 610, and is in fluid communication at its bottom end with the vapor inlet 625 that is disposed at a barbed hose fitting 625*a*. The barbed hose fitting 625*a* is shown connected to the rod member 662 by means of a forty-five degree elbow 661. When the pumping apparatus 600 is pumped, the bellows member 632 is movable by the rod member 662 and the top plate member 632*t* between the full configuration of the liquid pumping portion 620, which is also the reduced configuration of the vapor pumping portion, as shown in FIG. 23, and the reduced configuration of the liquid pumping portion 620, which is also the full configuration of the vapor pumping portion 622, as shown in FIG. 24.

Figure 23:
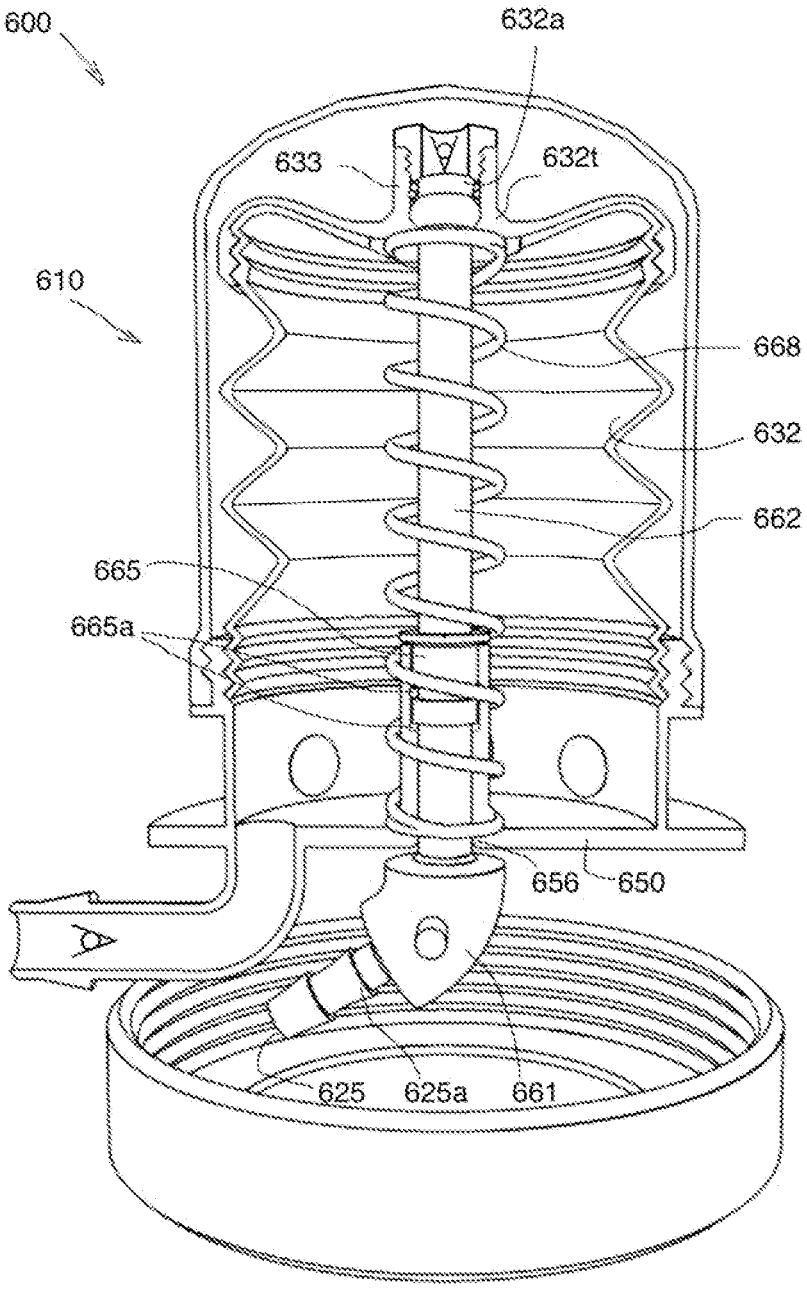
FIG. 23 is a sectional side elevational view of the sixth preferred embodiment portable fluid exchange system of FIG. 21, taken along section line 23-23 of FIG. 22, with the bellows member in position such that the liquid pumping portion is in its full configuration and the vapor pumping portion is in its reduced configuration.
Figure 24:
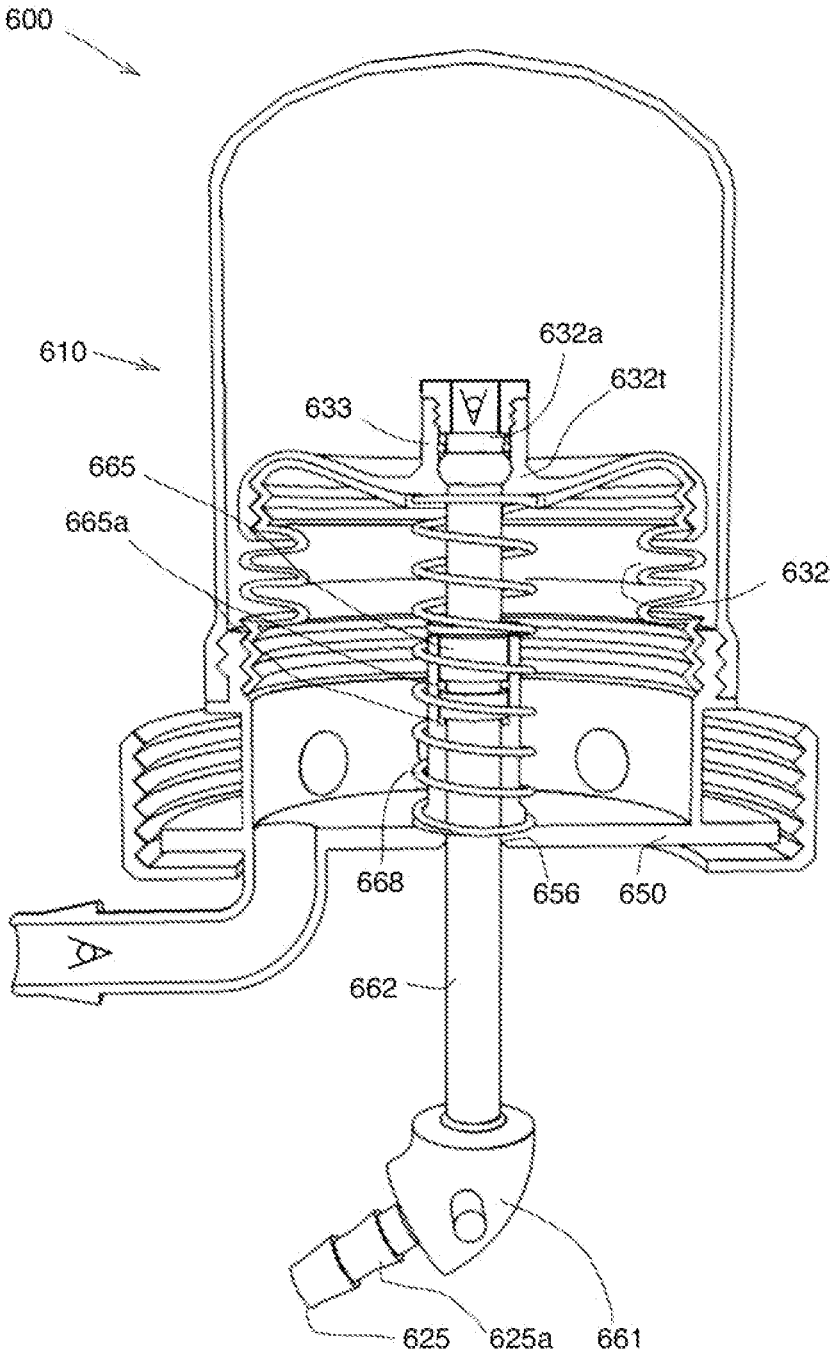
FIG. 24 is a sectional side elevational view similar to FIG. 23, but with the bellows member in position such that the liquid pumping portion is in its reduced configuration and the vapor pumping portion is in its full configuration.

The biasing means 668 comprises a coil spring 668 operatively interposed between the top plate member 632*t* and the base member 650 such that the spring member 668 biases the top plate member 632*t* upwardly, so the liquid pumping portion 620 is in the full configuration, as shown in FIG. 23.

Reference will now be made to FIGS. 25 through 28, which show a seventh preferred embodiment of the portable fluid exchange system of the present invention, as indicated by general reference numeral 700. The seventh preferred embodiment portable fluid exchange system, as indicated by the general reference numeral 700, is for concurrently pumping liquid from a source container 702 to a destination container 704 and pumping vapor from the destination container 704 to the source container 702. In the seventh preferred embodiment, the portable fluid exchange system 700 comprises the source container 702 having a substantially hollow interior 700*h*, and is capable of retaining liquid and vapor therein, in sealed relation with respect to the ambient environment. As illustrated, the source container 702 comprises a portable fuel container and the destination container 704 comprises a portable fuel container.

The portable fluid exchange system 700 comprises a liquid and vapor pumping means 710, as indicated by the general reference numeral 710, having a liquid inlet 723, a liquid outlet 724, a vapor inlet 725 and a vapor outlet 726. Conventional check valves 723*b*,724*b*,725*b*, and 726*b* are included at the liquid inlet 723, the liquid outlet 724, the vapor inlet 725 and the vapor outlet 726 respectively to control flow of liquid and vapor into and out of the liquid and vapor pumping means 710, as will be discussed in greater detail subsequently. In the seventh preferred embodiment, as illustrated, the liquid and vapor pumping means 710 comprises a variable volume liquid pumping portion, as indicated by the general reference numeral 720 and a variable volume vapor pumping portion, as indicated by the general reference numeral 722. The liquid pumping portion 720 is in fluid communication with the liquid inlet 723 and the liquid outlet 724 and the vapor pumping portion 722 is in fluid communication with the vapor inlet 725 and the vapor outlet 726.

The liquid pumping portion 720 comprises a resiliently deformable liquid pumping member 720 having a substantially hollow interior 716 for receiving liquid thereinto. The resiliently deformable liquid pumping member 720 is resiliently deformable between a full configuration and a reduced configuration wherein the internal volume of the resiliently deformable liquid pumping member 720 is less than the internal volume of the resiliently deformable liquid pumping member 720 in the full configuration.

The vapor pumping portion 722 comprises a resiliently deformable vapor pumping member 722 having a substantially hollow interior 717 for receiving vapor thereinto. The resiliently deformable vapor pumping member 722 is resiliently deformable between a full configuration and a reduced configuration wherein the internal volume of the resiliently deformable vapor pumping member 722 is less than the internal volume of the resiliently deformable vapor pumping member 722 in the full configuration.

The volume of the substantially hollow interior 716 of the resiliently deformable liquid pumping member 720 in the full configuration is substantially equal to the volume of the substantially hollow interior 717 of the resiliently deformable vapor pumping member 722 in the full configuration.

In the seventh preferred embodiment, as illustrated, the resiliently deformable liquid pumping member 720 and the resiliently deformable vapor pumping member 722 are each substantially cylindrical in cross-section, and are substantially identical one to the other. The resiliently deformable liquid pumping member 720 comprises a liquid pumping resiliently deformable bellows member 720 and the resiliently deformable vapor pumping member 722 comprises a vapor pumping resiliently deformable bellows member 722.

When the liquid pumping resiliently deformable bellows member 720 is in the full configuration, the vapor pumping resiliently deformable bellows member 722 is in the reduced configuration, and when the vapor pumping resiliently deformable bellows member 722 is in the full configuration, the liquid pumping resiliently deformable bellows member 720 is in the reduced configuration.

The liquid pumping resiliently deformable bellows member 720 and the vapor pumping resiliently deformable bellows member 722 are fluidically isolated one from the other.

Figure 27:
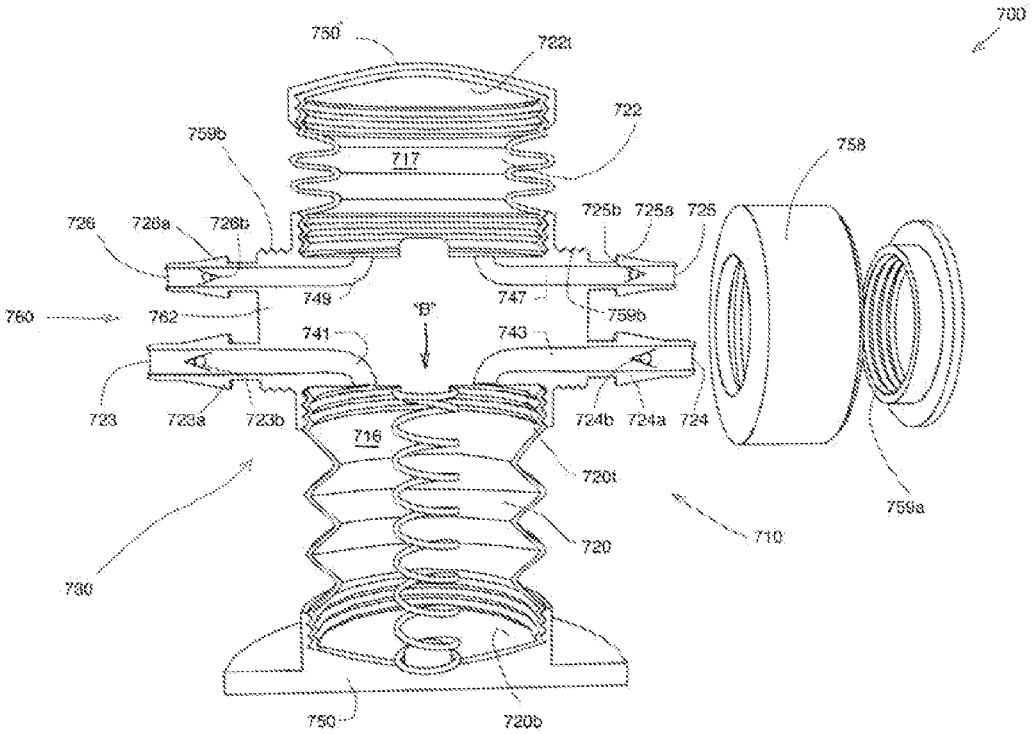
FIG. 27 is a partially exploded sectional side elevational view of the seventh preferred embodiment portable fluid exchange system of FIG. 25, taken along section line 27-27 of FIG. 26, with the resiliently deformable liquid pumping member in its full configuration and the resiliently deformable vapor pumping member is in its reduced configuration.
Figure 28:
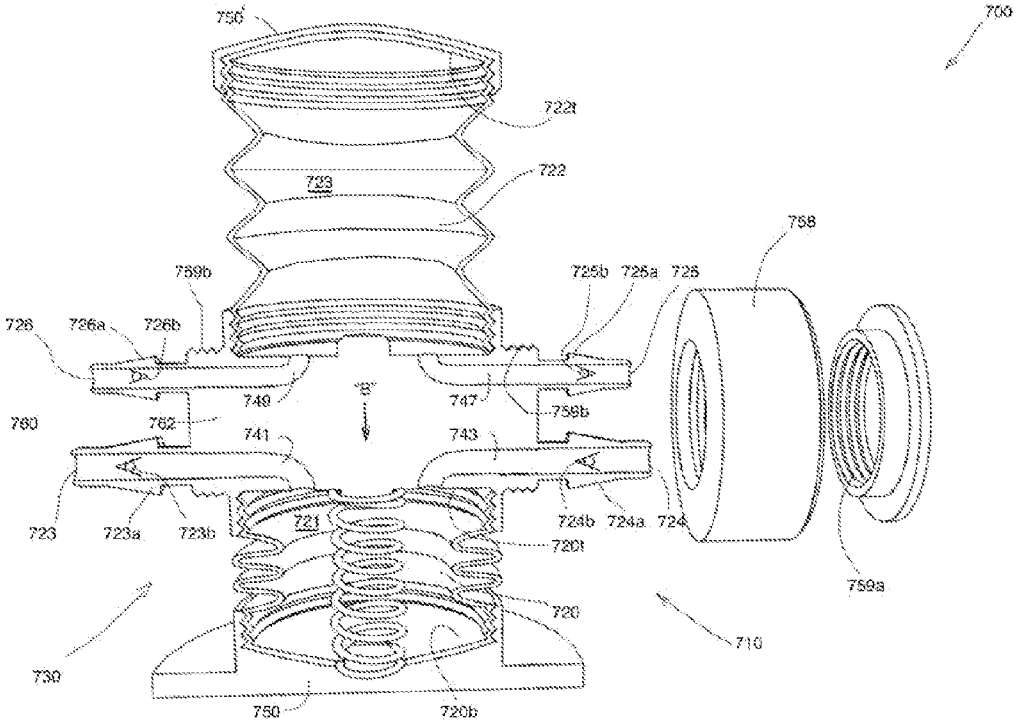
FIG. 28 is a partially exploded sectional side elevational view similar to FIG. 27, but with the resiliently deformable liquid pumping member in its reduced configuration and the resiliently deformable vapor pumping member is in its full configuration.
Figure 29:
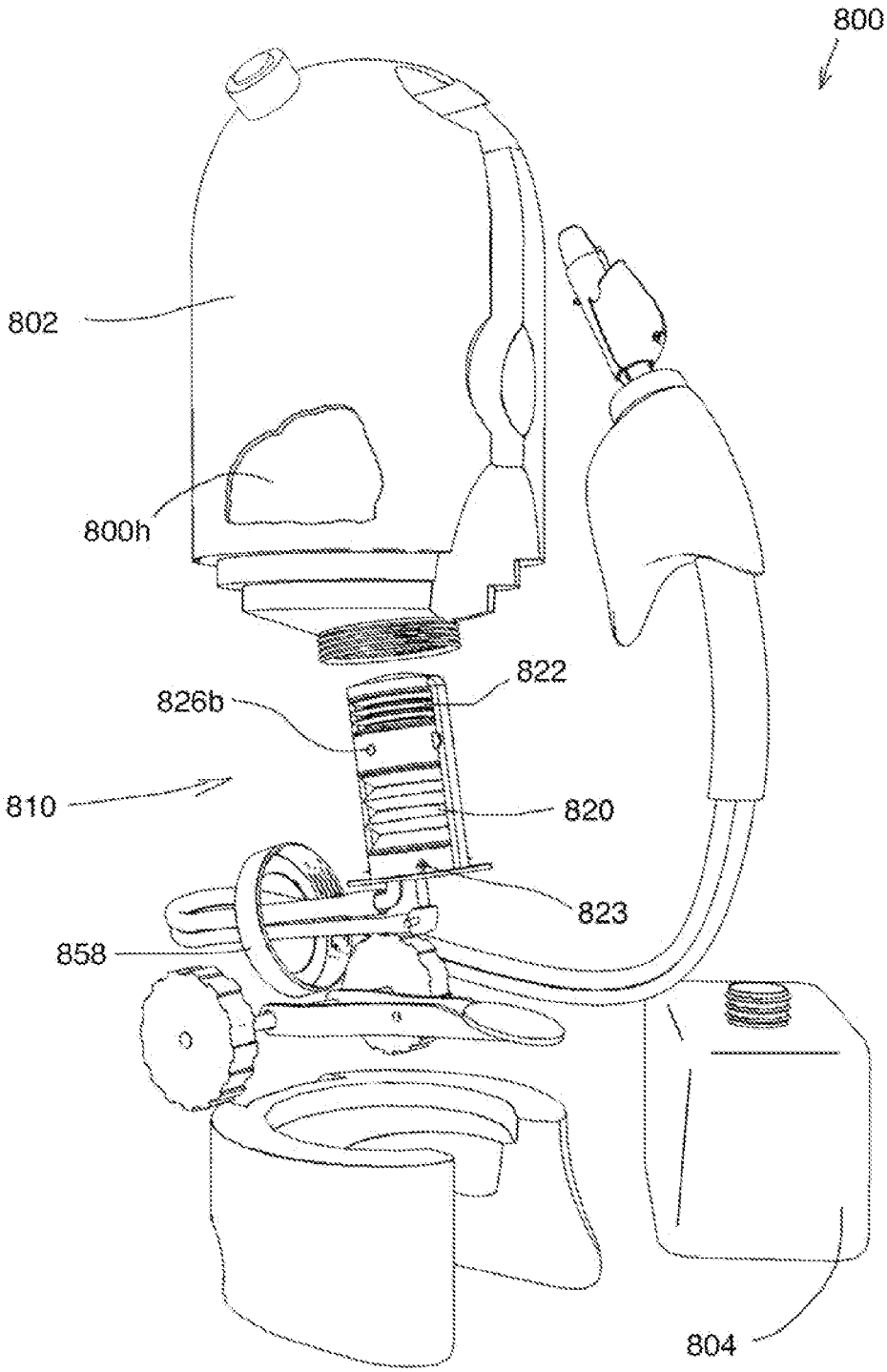
FIG. 29 is a perspective view from above of the eighth preferred embodiment of the portable fluid exchange system according to the present invention, about to be used to pump fuel from a portable fuel container type of source container to a portable fuel container type of destination container.
Figure 30:
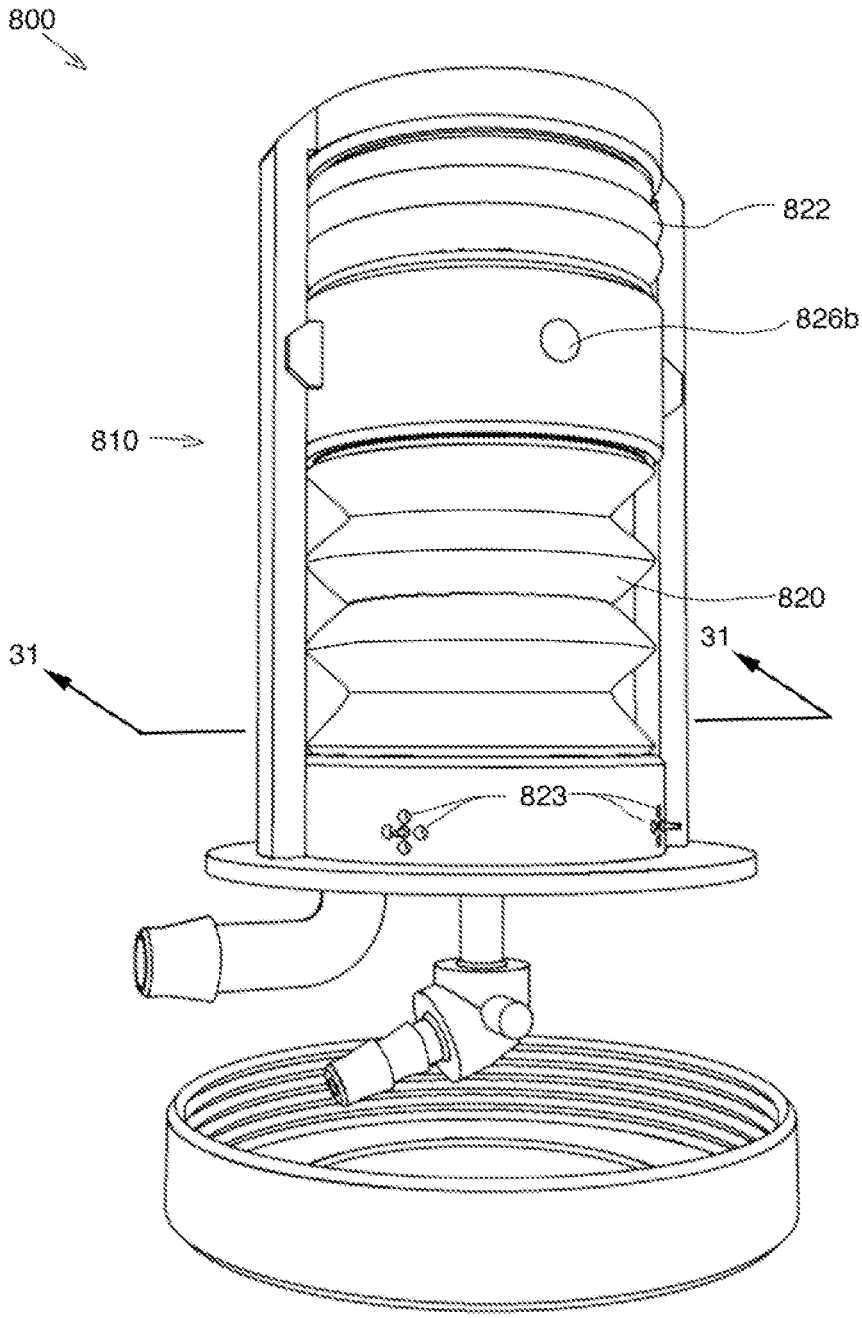
FIG. 30 is a partially exploded side elevational view of the eighth preferred embodiment portable fluid exchange system of FIG. 29.
Figure 31:
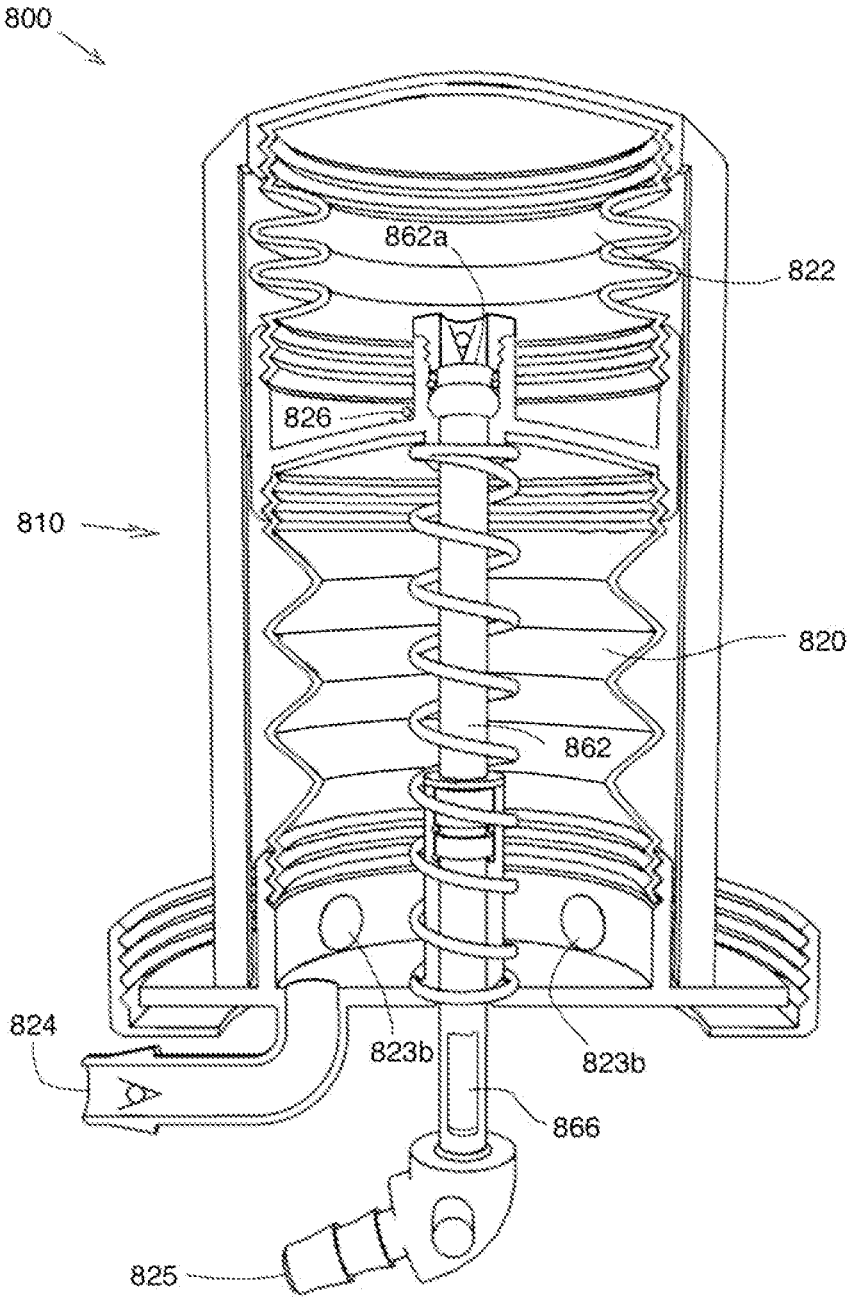
FIG. 31 is a sectional side elevational view of the eighth preferred embodiment portable fluid exchange system of FIG. 29, taken along section line 31-31 of FIG. 30, with the resiliently deformable liquid pumping member in its full configuration and the resiliently deformable vapor pumping member is in its reduced configuration.
Figure 32:
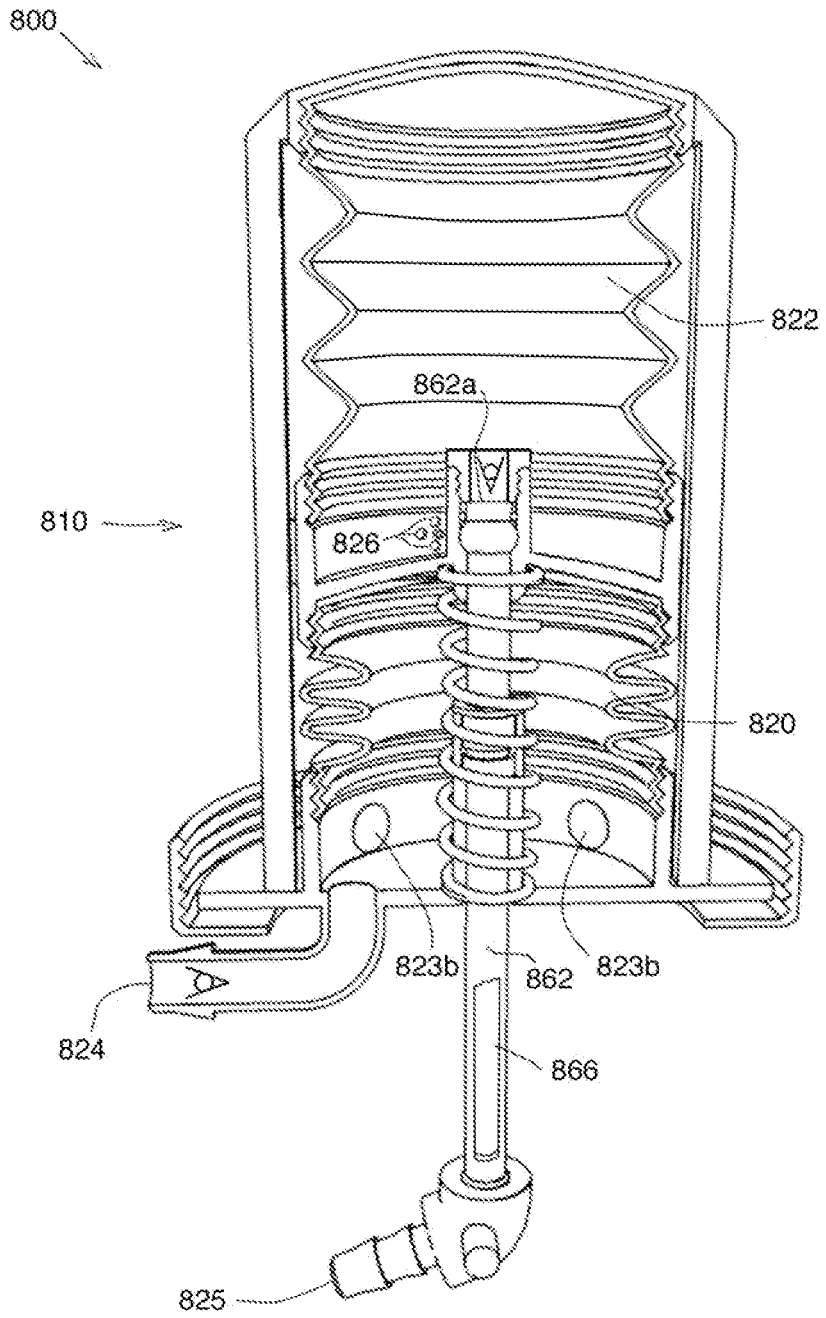
FIG. 32 is a sectional side elevational view similar to FIG. 31, but with the resiliently deformable liquid pumping member in its reduced configuration and the resiliently deformable vapor pumping member is in its full configuration.

As discussed previously, the liquid pumping resiliently deformable bellows member 720 is moveable between its full configuration, as seen in FIG. 27, and its reduced configuration, as seen in FIG. 28. Similarly, the vapor pumping resiliently deformable bellows member 722 is movable between its reduced configuration and its full configuration. When the liquid pumping resiliently deformable bellows member 720 moves from its full configuration to its reduced configuration, liquid within the liquid pumping resiliently deformable bellows member 720 is pumped from the liquid pumping resiliently deformable bellows member 720 through the liquid outlet 724. Concurrently, the vapor pumping resiliently deformable bellows member 722 is moved from its reduced configuration to its full configuration. Accordingly, vapor is pumped into the vapor pumping resiliently deformable bellows member 722 through the vapor inlet 725.

When the liquid pumping resiliently deformable bellows member 720 moves in the reverse direction from its reduced configuration, as seen in FIG. 28, to its full configuration, as seen in FIG. 27, liquid is pumped into the liquid pumping resiliently deformable bellows member 720 through the liquid inlet 723. Concurrently, the vapor pumping resiliently deformable bellows member 722 is moved from its full configuration to its reduced configuration. Accordingly, vapor in the vapor pumping resiliently deformable bellows member 722 is pumped through the vapor outlet 726.

As can be readily seen, the internal volume of the liquid pumping resiliently deformable bellows member 720 is less in the reduced configuration than in the full configuration. Similarly, the internal volume of the vapor pumping resiliently deformable bellows member 722 is less in the reduced configuration than in the full configuration.

The liquid inlet 723 comprises a throughpassage 741 that is disposed in the disk member 762, which throughpassage 741 extends through a barbed hose fitting 723*a* that is integrally molded to the disk member 762. Similarly, the liquid outlet 724 comprises a throughpassage 743 that is disposed in the disk member 762, which throughpassage 743 extends through a barbed hose fitting 724*a* that is integrally molded to the disk member 762. The vapor inlet 725 comprises a throughpassage 747 that is disposed in the disk member 762, which throughpassage 747 extends through a barbed hose fitting 725*a* that is integrally molded to the disk member 762. Similarly, the vapor outlet 726 comprises a throughpassage 749 that is disposed in the disk member 762, which throughpassage 749 extends through a barbed hose fitting 726*a* that is integrally molded to the disk member 762.

There is also a selectively controllable actuation mechanism, as indicated by the general reference numeral 760, for directly actuating the liquid and vapor pumping means 710 to thereby concurrently pump liquid from the liquid and vapor pumping means 710 through the liquid outlet 724 and vapor into the liquid and vapor pumping means 710 through the vapor inlet 725, and concurrently pump vapor from the liquid and vapor pumping means 710 through the vapor outlet 726 and liquid into the liquid and vapor pumping means 710 through the liquid inlet 723. In the seventh preferred embodiment, as illustrated, the movable pumping mechanism 730 is for concurrently pumping liquid from the liquid pumping portion 720, specifically the liquid pumping resiliently deformable bellows member 720, through the liquid outlet 724 and vapor into the vapor pumping portion 722 through the vapor inlet 725, and concurrently pumping vapor from the vapor pumping portion 722, specifically the vapor pumping resiliently deformable bellows member 722, through the vapor outlet 726 and liquid into the liquid pumping portion 720 through the liquid inlet 723.

The selectively controllable actuation mechanism 760 operatively interconnects the liquid pumping portion 720 and the vapor pumping portion 722 of the liquid and vapor pumping means 710, for actuating the liquid pumping portion 720 and the vapor pumping portion 722 to thereby concurrently pump liquid from the liquid pumping portion 720 through the liquid outlet 724 and vapor into the vapor pumping portion 722 through the vapor inlet 725, and concurrently pump vapor from the vapor pumping portion 722 through the vapor outlet 726 and liquid into the liquid pumping portion 720 through the liquid inlet 723.

More specifically, the selectively controllable actuation mechanism 760 comprises a disk member 762 that physically interconnects the resiliently deformable liquid pumping member 720 and the resiliently deformable vapor pumping member 722, and other elements connected to the disk member 762, as will be discussed in greater detail subsequent.

The pumping mechanism 730 concurrently pumps vapor from the vapor pumping portion 722 through the vapor outlet 726 and liquid into the liquid pumping portion 720 through the liquid inlet 723, and due to the reciprocating nature of the pumping mechanism 730, alternatingly concurrently pumps liquid from the liquid pumping portion 720 through the liquid outlet 724 and vapor into the vapor pumping portion 722 through the vapor inlet 725. It can readily be seen that the pumping of vapor from the destination container to the portable fluid exchange system 700 is not dependent on measurement of a condition of the liquid being pumped from the portable fluid exchange system 700 to the destination container 704, but is directly effected in accordance with the pumping of the liquid from the portable fluid exchange system 700 to the destination container 704.

As can be seen in FIGS. 27 and 28, the check valve 724*b* permits fluid to flow out of the portable fluid exchange system 700 through the liquid outlet 724, and the check valve 725*b* permits vapor to concurrently flow into the portable fluid exchange system 700 through the vapor inlet 725. Similarly, the check valve 723*b* permits liquid to flow into the portable fluid exchange system 700 through the liquid inlet 723 and the check valve 726*b* permits vapor to flow out of the portable fluid exchange system 700 through the vapor outlet 726.

The check valves 723*b*, 724*b*, 725*b* and 726*b* could be positioned either within the barbed hose fitting 723*a* at the liquid inlet 723, the barbed hose fitting 724*a* at the liquid outlet 724, the barbed hose fitting 725*a* at the vapor inlet 725, and the barbed hose fitting 726*a* at the vapor outlet 726, respectively. Alternatively, these check valves could be a part of the elongate flexible liquid delivery hose 782, the elongate flexible vapor recovery hose 783, the vapor supply hose 712, or the liquid supply hose 706, or even be part of the two-line container coupling means 707 in conjunction with the liquid extension hose 706'. Also alternatively, the various check valves could be attached to the vapor inlet 725, liquid inlet 723, liquid outlet 724 and vapor outlet 726 of the liquid and vapor pumping means, or the check valves could be within a component such as the nozzle of the nozzle and spout assembly 790.

As mentioned previously, the selectively controllable actuation mechanism 760 comprises the disk member 762 that physically interconnects the liquid pumping resiliently deformable bellows member 720 and the vapor pumping resiliently deformable bellows member 722. As can be seen in FIGS. 27 and 28, the liquid pumping resiliently deformable bellows member 720 is open at its top end 720*t* and secured to the disk member 762 by a leakproof seal, and is closed at its bottom end 720*b* and secured to the base member 750. Similarly, the vapor pumping resiliently deformable bellows member 722 is open at its bottom end 722*b* and secured to the disk member 762 by a leakproof seal. The top end 722*t* of the vapor pumping resiliently deformable bellows member 722 is closed off and secured to the top member 750'. The top member 750' and the base member 750 are rigidly connected together by frame members 719. The disk member 762 includes guide tabs 762*g*, as seen in FIG. 26, which are used to locate and guide the disk member 762 as it is actuated.

Figure 26:
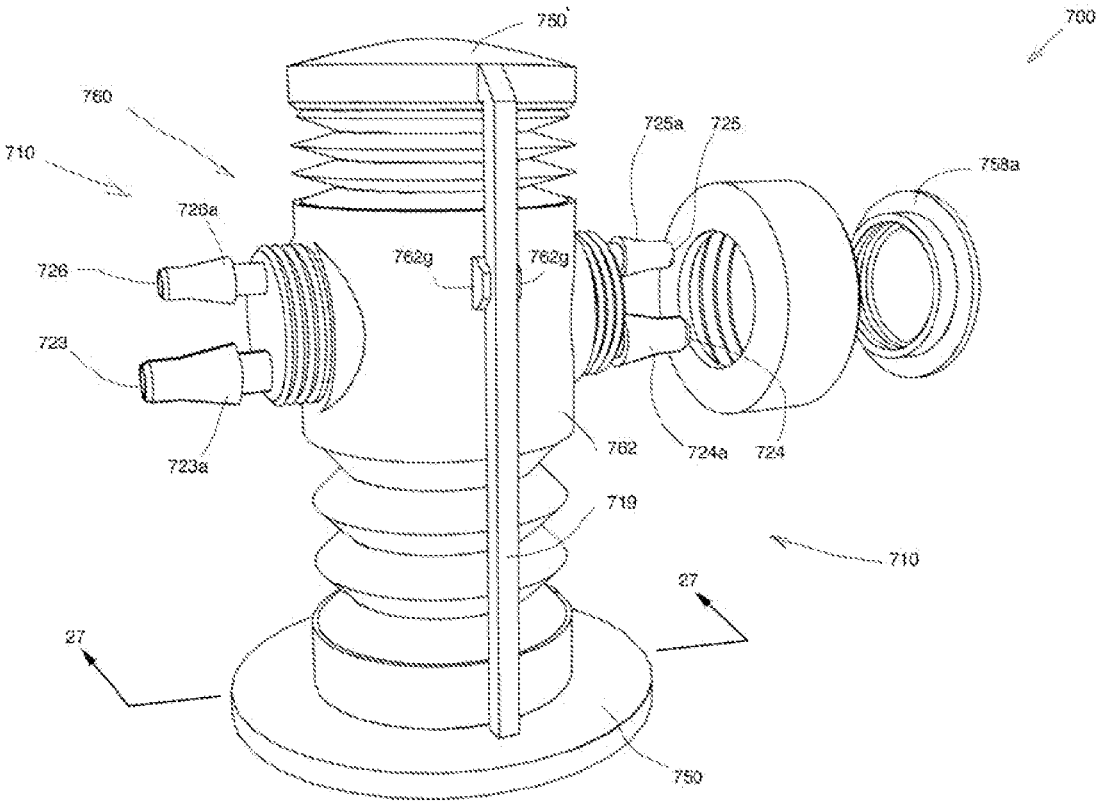
FIG. 26 is a partially exploded side elevational view of the seventh preferred embodiment portable fluid exchange system of FIG. 25.

The liquid pumping resiliently deformable bellows member 720 and the vapor pumping resiliently deformable bellows member 722 are precluded from moving laterally by means of a vertically disposed frame members 719, which interconnects the top member 750' and the base member 750, as is best seen in FIG. 26.

Figure 25:
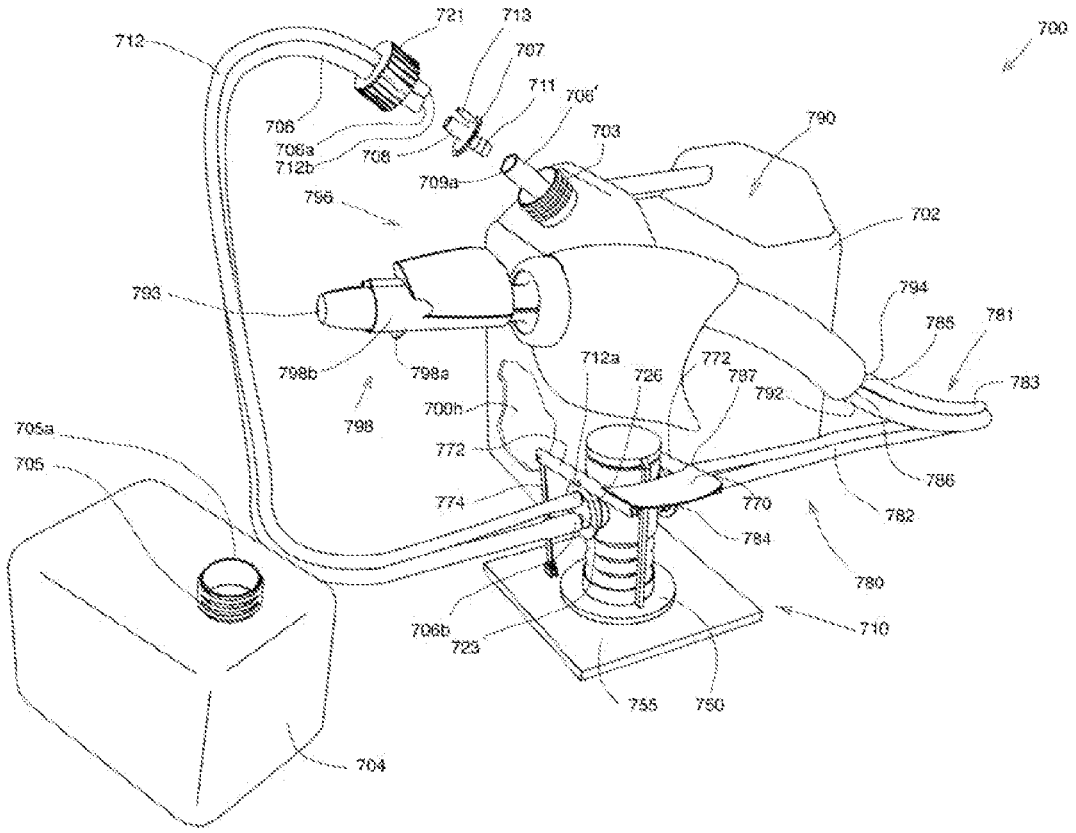
FIG. 25 is a perspective view from above of the seventh preferred embodiment of the portable fluid exchange system according to the present invention, about to be used to pump fuel from a portable fuel container type of source container to a portable fuel container type of destination container.

As can be seen in FIG. 25, the selectively controllable actuation mechanism 760 is manually powered, and comprises a foot operable pedal member 770 that is secured to a pair of a pump arms 772 that are connected in freely pivoting relation at their opposite ends to a pair of connecting arms 774, that are anchored at the bottom ends to a small platform 755. The pair of pump arms 772 are secured at their central area to the disk member 762, such that up-and-down vertical movement of the pedal member 770 moves the disk member 762 and causes the liquid and vapor pumping means 710 to pump.

The selectively controllable actuation mechanism 760 further comprises a biasing means 768 for biasing the liquid pumping portion 720 to its full configuration. The biasing means 768 preferably comprises a spring member 768 operatively acting on one of the selectively controllable actuation mechanism 760 and the liquid and vapor pumping means 710, for biasing the liquid pumping resiliently deformable bellows member 720 to the full configuration. In the seventh preferred embodiment, as illustrated, the spring member 768 comprises a coil spring 768 operatively interposed between the disk member 762 and the base member 750 such that the spring member 768 biases the disk member 762 upwardly, so the liquid pumping resiliently deformable bellows member 720 is in its full configuration, as shown in FIG. 27, whereat the coil spring 768 is in a neutral configuration. In the full configuration of the vapor pumping portion 722, the coil spring 768 is compressed by the downward actuation of the pedal member 770, as indicated by arrow "B" in FIGS. 27 and 28.

It can readily be seen that the selectively controllable actuation mechanism 760 causes the concurrent pumping of liquid from the liquid and vapor pumping means 710 through the liquid outlet 724 and vapor into the liquid and vapor pumping means 710 through the vapor inlet 725, at an equal rate one to the other, on an ongoing basis.

The selectively controllable actuation mechanism 760 is movable in a cyclical motion when actuating the liquid and vapor pumping means 710, or in other words when actuating the resiliently deformable liquid pumping member 720 and the resiliently deformable vapor pumping member 722.

The pumping mechanism 730 is movable through one cycle of the cyclical motion when varying the volume of the liquid pumping portion 720 from the full configuration, as shown in FIG. 27, through the reduced configuration, as shown in FIG. 28, and back to the full configuration. Similarly, the pumping mechanism 730 is movable through one cycle of the cyclical motion when varying the volume of the vapor pumping portion 722 from the reduced configuration, as shown in FIG. 27, through the full configuration, as shown in FIG. 28, and back to the reduced configuration. In one cycle of the pumping mechanism 730, the volume of liquid pumped by the liquid pumping portion 720 is equal to the volume of vapor pumped by the vapor pumping portion 722.

The portable fluid exchange system 700 further comprises a liquid delivery means 780 for delivering liquid from the liquid and vapor pumping means 710 to the destination container 704, and a vapor recovery means 781 for delivering vapor from the destination container 704 to the liquid and vapor pumping means 710.

In the seventh preferred embodiment is illustrated, the liquid delivery means 780 comprises an elongate flexible liquid delivery hose 782 having a liquid inlet 784 and a liquid outlet 786. The elongate flexible liquid delivery hose 782 is securely connected to the barbed hose fitting 724*a* at the liquid outlet 724 of the liquid and vapor pumping means 710. Accordingly, the elongate flexible liquid delivery hose 782 is in fluid communication at the liquid inlet 784 with the liquid outlet 724 of the liquid and vapor pumping means 710 for receiving liquid from the liquid and vapor pumping means 710, and in fluid communication at the liquid outlet 786 with the destination container 704 through a nozzle and spout assembly 790, for delivering the received liquid to the destination container 704.

Similarly, the vapor recovery means 781 comprises an elongate flexible vapor recovery hose 783 having a vapor inlet 785 and a vapor outlet 787. The elongate flexible vapor delivery hose 783 is securely connected to the barbed hose fitting 725*a* at the vapor inlet 725 of the liquid and vapor pumping means 710. Accordingly, the elongate flexible vapor recovery hose 783 is in fluid communication at the vapor inlet 785 with the destination container 704 through a nozzle and spout assembly 790, for receiving vapor from the destination container 704, and is in fluid communication at the vapor outlet 787 with the vapor inlet 725 of the liquid and vapor pumping means 710 for delivering the received vapor to the liquid and vapor pumping means 710.

As can be seen in FIG. 25, the elongate flexible liquid delivery hose 782 and the elongate flexible vapor recovery hose 783 together comprise a two line hose, and in the seventh preferred embodiment, as illustrated, the elongate flexible liquid delivery hose 782 and the elongate flexible vapor recovery hose 783 are integrally formed one with the other.

The portable fluid exchange system 700 further comprises a nozzle and spout assembly 790. The liquid outlet 786 of the elongate flexible liquid delivery hose 782 is operatively connected in supported relation to the nozzle and spout assembly 790, and more specifically is operatively connected in liquid delivery relation to the liquid inlet 792 of the nozzle and spout assembly 790. Similarly, the vapor inlet 785 of the elongate flexible vapor recovery hose 783 is operatively connected in supported relation to the nozzle and spout assembly 790, and more specifically is operatively connected in vapor receiving relation to the vapor outlet 794 of the nozzle and spout assembly 790. The nozzle and spout assembly 790 receives liquid from the liquid outlet 786 of the elongate flexible liquid delivery hose 782 and dispenses the liquid to the destination container 704 and receive vapor from the destination container 704 and conveys the vapor to the vapor inlet 785 of the elongate flexible vapor recovery hose 783.

As can also be seen in FIG. 25, the nozzle and spout assembly 790 comprises an auto-shutoff mechanism 796 and an auto-closure mechanism 798. The auto-shutoff mechanism 796 operates similarly to a gas station nozzle, and works by shutting off the valve means in the nozzle and spout assembly 790, which was opened to allow liquid to be conveyed from the liquid outlet 786 of the elongate flexible liquid delivery hose 782 through the nozzle and spout assembly 790, to the destination container 704. The auto-shutoff mechanism 796 closes the valve means of the nozzle and spout assembly 790, to thereby stop the flow of liquid from the liquid outlet 793 of the nozzle and spout assembly 790 in response to a level of liquid being encountered by the auto-shutoff mechanism. By automatically shutting off the flow of liquid in this manner, the nozzle and spout assembly 790 will prevent the destination container 704 from being overfilled.

The auto-closure mechanism 798 comprises an activation means for causing the valve means of the nozzle and spout assembly 790 to open and close. The activation means has an engaging means 798*a* that comprises a hook on the underside of the spout 798*b*, which, in use, can be activated by engaging the hook 798*a* of the nozzle and spout assembly 790 to a destination container 704 at the lip 705*a* of its receiving opening 705, and applying pressure to cause the valve means of the nozzle and spout assembly 790 to open and permit liquid delivery through the nozzle and spout assembly 790. The engaging means 798*a* also causes the valve means to close, thus inhibiting liquid from flowing through the nozzle and spout assembly 790 in response to the disengagement of the engaging means 798*a*, which relieves the applied pressure when the nozzle and spout assembly is removed away from the opening 705 of the destination container 704.

The elongate flexible liquid delivery hose 782 and the elongate flexible vapor recovery hose 783 permit the movement of the liquid outlet 786 of the elongate flexible liquid delivery hose 782 to the destination container 704 while the source container 702 remains substantially stationary, to thereby permit the delivery of the liquid to the destination container 704.

The portable fluid exchange system 700 further comprises an attachment means for connecting in fluid communication at least one of the liquid inlet 723 and the vapor outlet 726 with the interior of the source container 702 or connecting in fluid communication at least one of the liquid outlet 724 and the vapor inlet 725 with the interior of the destination container 704. More specifically, the attachment means is for attaching the portable fluid exchange system 700 to the source container 702 or the destination container 704, and in the seventh preferred embodiment, as illustrated, to the source container 702, such that the liquid inlet 723 and the vapor outlet 726 are in fluid communication with the interior of the source container 702. The attachment means comprises a threaded cap 721 for threadably engaging the mouth 703 of the source container 702. A two-line container coupling means 707 is used to connect the liquid supply hose 706 so as to be in fluid communication with liquid in the source container 702 via an extension hose 706'. A vapor return hose 712 is also connected to the two-line container coupling means 707, so as to be in fluid communication with the source container 702.

The liquid inlet 723 of the liquid and vapor pumping means 710 is in fluid communication with the interior of the source container 702, via liquid supply hose 706 which is securely attached at its outlet end 706*b* to the barbed hose fitting 723*a*. The inlet end 706*a* of liquid supply hose 706 is securely attached to liquid supply nipple 708 of coupling means 707. The inlet end 706*a* of liquid supply hose 706 is in fluid communication with extension hose 706', which is securely connected to the nipple 711 of the coupling means 707. The coupling means 707 conveys liquid between the inlet end 706*a* of liquid supply hose 706 and the outlet end 709*a* of the extension hose 706'. The extension hose 706' extends downwardly into the portable fuel container 702 to draw liquid off the bottom so that liquid is pumped form the source container 702 into the variable volume liquid pumping portion 720 in this manner.

The vapor outlet 726 of the liquid and vapor pumping means 710 is in fluid communication with the interior of the source container 702, via a vapor return hose 712 which is securely attached to the barbed hose fitting 726*a* at its inlet end 712*a*. The outlet end 712*b* of the vapor return hose 712 is securely attached to the vapor return nipple 713 of the coupling means 707, which communicates the vapor into the interior of the source container 702 when properly installed.

It will be understood that in FIG. 25, the threaded cap 721 and the two-line container coupling means 707 are shown displaced from the mouth 703 of the portable fuel container 702 and not actually connected to it. In order to connect the liquid and vapor pumping means 710 in fluid communication with the interior of the portable fuel container 702, the outlet end of the extension hose 706' is connected to the nipple 711 on the two-line container coupling means 707. The inlet end 706*a* of the liquid supply hose 706 is connected to the liquid supply nipple 708 of coupling means 707, and the outlet end 712*b* of the vapor return hose 712 is connected to the vapor return nipple 713 of the coupling means 707. The extension hose 706' is lowered into the interior of the portable fuel container 702, and the threaded cap 721 is brought to the mouth 703 of the portable fuel container 702 and is threadably engaged thereon, to thereby secure the liquid and vapor pumping means 710 and the two-line container coupling means 207 in place and provide the aforementioned airtight leakproof seal.

In use, in order to pump liquid from the source container 702 to the destination container 704, by means of the seventh preferred embodiment portable fluid exchange system, the pedal member 770 is first moved downwardly from the raised position as shown in FIG. 25, such that the disk member 762 moves from the position shown in FIG. 27, whereat the liquid pumping resiliently deformable bellows member 720 is in its full configuration, to the position shown in FIG. 28, whereat the liquid pumping resiliently deformable bellows member 720 is in its reduced configuration. Accordingly, liquid is pumped from the liquid pumping resiliently deformable bellows member 720 of the liquid and vapor pumping means 710 through the liquid outlet 724, and through the elongate flexible liquid delivery hose 782 to the nozzle and spout assembly 790, where it is delivered to the destination container 704. Concurrently, the liquid and vapor pumping means 710 pumps vapor into the liquid and vapor pumping means 710, specifically into the vapor pumping resiliently deformable bellows member 722 through the vapor inlet 725, where the vapor being pumped is drawn in from the destination container 704 through the nozzle and spout assembly 790 to the elongate flexible recovery hose 783 and on into the vapor inlets 725 of the vapor pumping resiliently deformable bellows member 722. In this manner, on an ongoing basis, vapor is pumped out of the destination container 704 as liquid is pumped into the destination container 704, thus precluding vapor from escaping to the ambient surroundings.

Next, the pedal member 770 is then moved upwardly from the lowered position, by the coil spring 768 such that the disk member 762 moves from the position shown in FIG. 28, whereat the liquid pumping resiliently deformable bellows member 720 is in its reduced configuration, back to the position shown in FIG. 27, whereat the liquid pumping resiliently deformable bellows member 720 is in its full configuration. Accordingly, liquid is pumped from the source container 702 to the liquid pumping resiliently deformable bellows member 720 of the liquid and vapor pumping means 710 UP through the liquid extension hose 706' through the coupling means 707, through the liquid supply hose 706 and into the liquid inlet 723 of the liquid pumping resiliently deformable bellows member 720. Concurrently, the liquid and vapor pumping means 710 pumps vapor out of the liquid and vapor pumping means 710, specifically out of the vapor pumping resiliently deformable bellows member 722 through the vapor outlet 726, through the vapor return hose 712, through the coupling means 707, and into the source container 702. In this manner, concurrently on an ongoing basis, vapor is pumped into the source container 702 as liquid is pumped out of the source container 702, thus precluding vapor from escaping to the ambient surroundings.

Reference will now be made to FIGS. 29 through 32, which show an eighth preferred embodiment of the portable fluid exchange system of the present invention, as indicated by general reference numeral 800. The eighth preferred embodiment portable fluid exchange system 800 is similar to the seventh preferred embodiment of the portable fluid exchange system 700 of the present invention and also the third preferred embodiment of the portable fluid exchange system 300 of the present invention, with many elements being in common. Accordingly, elements in the eighth preferred embodiment portable fluid exchange system 800 that are common to, and essentially the same as, elements in the seventh preferred embodiment of the portable fluid exchange system 700 and the third preferred embodiment portable fluid exchange system 300, will not necessarily be specifically discussed with reference to the eighth preferred embodiment portable fluid exchange system 800, for the sake of brevity. Similar numbering has been used between the three embodiments to indicate commonality of functioning parts within each embodiment. For example, the liquid inlet 823 of the eighth preferred embodiment will be similar in function to the liquid inlet 723 of the seventh preferred embodiment and to the liquid inlet 323 of the third preferred embodiment, and so on. Generally, only the significant differences between the eighth preferred embodiment portable fluid exchange system 800, the seventh preferred embodiment of the portable fluid exchange system 700, and the third eighth preferred embodiment portable fluid exchange system 300 will be discussed.

In the eighth preferred embodiment portable fluid exchange system 800, in a manner similar to the seventh preferred embodiment portable fluid exchange system 700, the liquid pumping portion 820 comprises a resiliently deformable liquid pumping member 820, and more specifically a liquid pumping resiliently deformable bellows member 820. Also, the vapor pumping portion 822 comprises a resiliently deformable vapor pumping member 822, and more specifically a vapor pumping resiliently deformable bellows member 822. However, the liquid inlet 823, the liquid inlet 824, the vapor inlet 825, and the vapor outlet 726 are the same as in the third preferred embodiment portable fluid exchange system 300.

It should be noted that the eighth preferred embodiment portable fluid exchange system 800 mounts interiorly with in a source container 802, in the same manner as does the third preferred embodiment portable fluid exchange system 300, so as to permit pumping of liquid from the source container 802 to the destination container 804, and the pumping of vapor from the destination container 804 to the source container 802.

Reference will now be made to FIGS. 33 through 35, which show a ninth preferred embodiment of the portable fluid exchange system of the present invention, as indicated by general reference numeral 900. The ninth preferred embodiment portable fluid exchange system 900 is similar to the seventh preferred embodiment of the portable fluid exchange system 700 of the present invention, with many elements being in common. Accordingly, elements in the ninth preferred embodiment portable fluid exchange system 900 that are common to, and essentially the same as, elements in the seventh preferred embodiment of the portable fluid exchange system 700, will not necessarily be specifically discussed with reference to the ninth preferred embodiment portable fluid exchange system 900, for the sake of brevity. Similar numbering has been used between the two embodiments to indicate commonality of functioning parts within each embodiment. For example, the liquid pumping portion 920 of the ninth preferred embodiment will be similar in function to the liquid pumping portion 720 of the seventh preferred embodiment, and so on. Generally, only the significant differences between the ninth preferred embodiment portable fluid exchange system 900, and the seventh preferred embodiment of the portable fluid exchange system 700, will be discussed.

In the ninth preferred embodiment portable fluid exchange system 900, in a manner similar to the seventh preferred embodiment portable fluid exchange system 700, the liquid pumping portion 920 comprises a resiliently deformable liquid pumping member 920, and more specifically a liquid pumping resiliently deformable bellows member 920. Also, the vapor pumping portion 922 comprises a resiliently deformable vapor pumping member 922, and more specifically a vapor pumping resiliently deformable bellows member 922. However, there is a slight difference in that the liquid pumping resiliently deformable bellows member 920 and the vapor pumping resiliently deformable bellows member 922 are both reduced in size, so as to fit within a nozzle and spout assembly 990. The actuation means 960 comprises a connecting member 962 that physically interconnects the liquid pumping resiliently deformable bellows member 920 and the vapor pumping resiliently deformable bellows member 922. A movable handle member 970 is securely connected to the connecting member 962 for movement therewith. A user's hand is positioned to grasp the handle portion 991 of the nozzle and spout assembly 990 and to move the handle member 970 in order to operate the portable fluid exchange system 900. The connecting member 962 serves the same purpose as the disk member 762 in the seventh preferred embodiment except that the connecting member 962 only comprises the vapor conduit means 926, 926*a*, 949, 947, 925*a* and 925, which regulate the flow of vapor through the vapor pumping portion 922. The vapor inlet 925 of the liquid and vapor pumping means 910 is in fluid communication with the destination container 904 via a vapor supply hose 911, where the inlet end 911*a* of the vapor supply hose 911 is connected in fluid communication with the vapor conduit 990*c* of the spout 990*s*. The vapor conduit 990*c* has a vapor inlet 990*a* and a vapor outlet 990*b*, vapor is received by the vapor inlet 990*a* and delivered to the vapor supply hose 911 at the inlet end 911*a*. The connecting member 963 located between the outlet 982*b* of the liquid delivery hose 982 and the inlet 990*i* of the spout 990*s* comprises the liquid conduit means 923, 923*a*, 941, 943, 924*a* and 924 that regulate the flow of liquid through the liquid pumping portion 920 of the liquid and vapor pumping means 910.

It should be noted that the ninth preferred embodiment portable fluid exchange system 900 also connects to the source container 902, in the same manner as does the seventh preferred embodiment portable fluid exchange system 700, so as to permit pumping of liquid from the source container 902 to the destination container 904, and the pumping of vapor from the destination container 904 to the source container 902.

Reference will now be made to FIGS. 36 through 39, which show a tenth preferred embodiment of the portable fluid exchange system of the present invention, as indicated by general reference numeral 1000. The tenth preferred embodiment portable fluid exchange system 1000 is similar to the seventh preferred embodiment of the portable fluid exchange system 700 of the present invention, with many elements being in common. Accordingly, elements in the tenth preferred embodiment portable fluid exchange system 1000 that are common to, and essentially the same as, elements in the seventh preferred embodiment of the portable fluid exchange system 700, will not necessarily be specifically discussed with reference to the tenth preferred embodiment portable fluid exchange system 1000, for the sake of brevity. Similar numbering has been used between the two embodiments to indicate commonality of functioning parts within each embodiment. For example, the liquid pumping portion 1020 of the tenth preferred embodiment will be similar in function to the liquid pumping portion 720 of the seventh preferred embodiment, and so on. Generally, only the significant differences between the tenth preferred embodiment portable fluid exchange system 1000, and the seventh preferred embodiment of the portable fluid exchange system 700, will be discussed.

In the tenth preferred embodiment portable fluid exchange system 1000, the liquid pumping portion 1020 comprises a resiliently deformable liquid pumping member 1020, and more specifically a liquid pumping resiliently deformable force cup 1020. Also, the vapor pumping portion 1022 comprises a resiliently deformable vapor pumping member 1022, and more specifically a vapor pumping resiliently deformable force cup 1022. When the liquid pumping resiliently deformable force cup 1020 is in its full configuration, as can be seen best in FIG. 38, the vapor pumping resiliently deformable force cup 1022 is in its reduced configuration, and when the vapor pumping resiliently deformable force cup 1022 is in the full configuration, as can be seen best in FIG. 39, the liquid pumping resiliently deformable force cup 1020 is in the reduced configuration.

The liquid pumping resiliently deformable force cup 1020 comprises a wide base portion 1020*b* and a narrow opposite end portion 1020*e*, and is of a substantially hemispherical shape. In its reduced configuration, the liquid pumping resiliently deformable force cup 1020 comprises a substantially flattened shape. Similarly, the vapor pumping resiliently deformable force cup 1022 comprises a wide base portion 1022*b* and a narrow opposite end portion 1022*e*, and is of a substantially hemispherical shape. In its reduced configuration, the vapor pumping resiliently deformable force cup 1022 comprises a substantially flattened shape.

The liquid pumping resiliently deformable force cup 1020 is open at its wide base portion 1020*b* and secured to a base member 1050*a* by means of a lower hose clamp 1020*c* to form a leakproof seal. The narrow opposite end portion 1020*e* of the liquid pumping resiliently deformable force cup 1020 is closed and has an inwardly directed annular flange portion 1020*f* that receives the base flange 1064*a* of a connector socket 1063*a* therein. The connector socket 1063*a* comprises a socket 1020*s* that is formed within a hub 1020*h*. Similarly, the vapor pumping resiliently deformable force cup 1022 is open at its wide base portion 1022*b* and secured to a base member 1050*b* by means of an upper hose clamp 1022*c* to form a leakproof seal. The narrow opposite end portion 1022*e* of the vapor pumping resiliently deformable force cup 1022 is closed and has an inwardly directed annular flange portion 1022*f* that receives the base flange 1064*b* of a connector socket 1063*b* therein. The connector socket 1063*b* comprises a socket 1022*s* that is formed in a hub 1022*h*.

The selectively controllable actuation mechanism, as indicated by the general reference numeral 1060, comprises a connector arm 1062 that physically interconnects the liquid pumping resiliently deformable force cup 1020 and the vapor pumping resiliently deformable force cup 1022, and other elements connected to the connector arm 1062. The connector arm 1062 has a first ball 1067*a* that is received in the cooperating socket 1020*s* and a second end ball 1067*b* that is received in the cooperating socket 1022*s* so as to physically connect the liquid pumping resiliently deformable force cup 1020 and the vapor pumping resiliently deformable force cup 1022.

The liquid inlet 1023 comprises a throughpassage 1041 that is disposed in the base member 1050*a* and also in a barbed hose fitting 1023*a* that is connected to the base member 1050*a*. The liquid outlet 1024 comprises an aperture 1043 in the liquid pumping resiliently deformable force cup 1020, with a barbed hose fitting 1024*a* secured in place on the liquid pumping resiliently deformable force cup 1020, at the aperture 1043 by a leak proof seal.

The vapor inlet 1025 comprises an aperture 1045 that is disposed in the vapor pumping resiliently deformable force cup 1022 with a barbed hose fitting 1025*a* that is secured in place to the vapor pumping resiliently deformable force cup 1022 by a leakproof seal. The vapor outlet 1026 comprises a throughpassage 1047 disposed in the base member 1050*b*, with a barbed hose fitting 1026*a* secured in place.

A pedal member 1069 is part of the actuation mechanism, and is connected at its central area in freely pivoting relation to a pin member 1062*p* on the connector arm 1062, to permit the pedal member 1069 to be used to actuate the portable fluid exchange system 1000.

Figure 38:
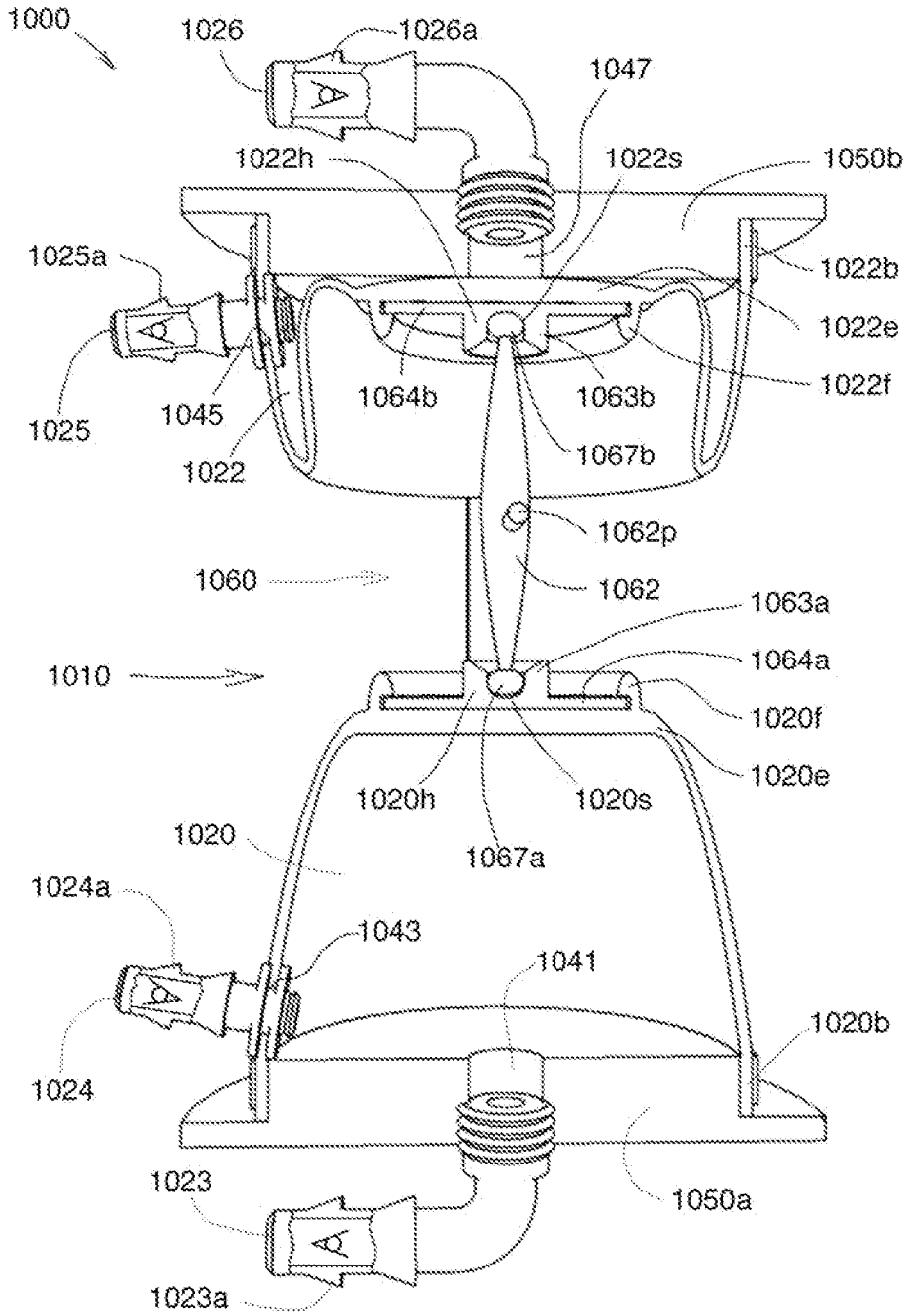
FIG. 38 is a sectional side elevational view of the tenth preferred embodiment portable fluid exchange system of FIG. 36, taken along section line 38-38 of FIG. 37, with the resiliently deformable liquid pumping member in its full configuration and the resiliently deformable vapor pumping member is in its reduced configuration.
Figure 39:
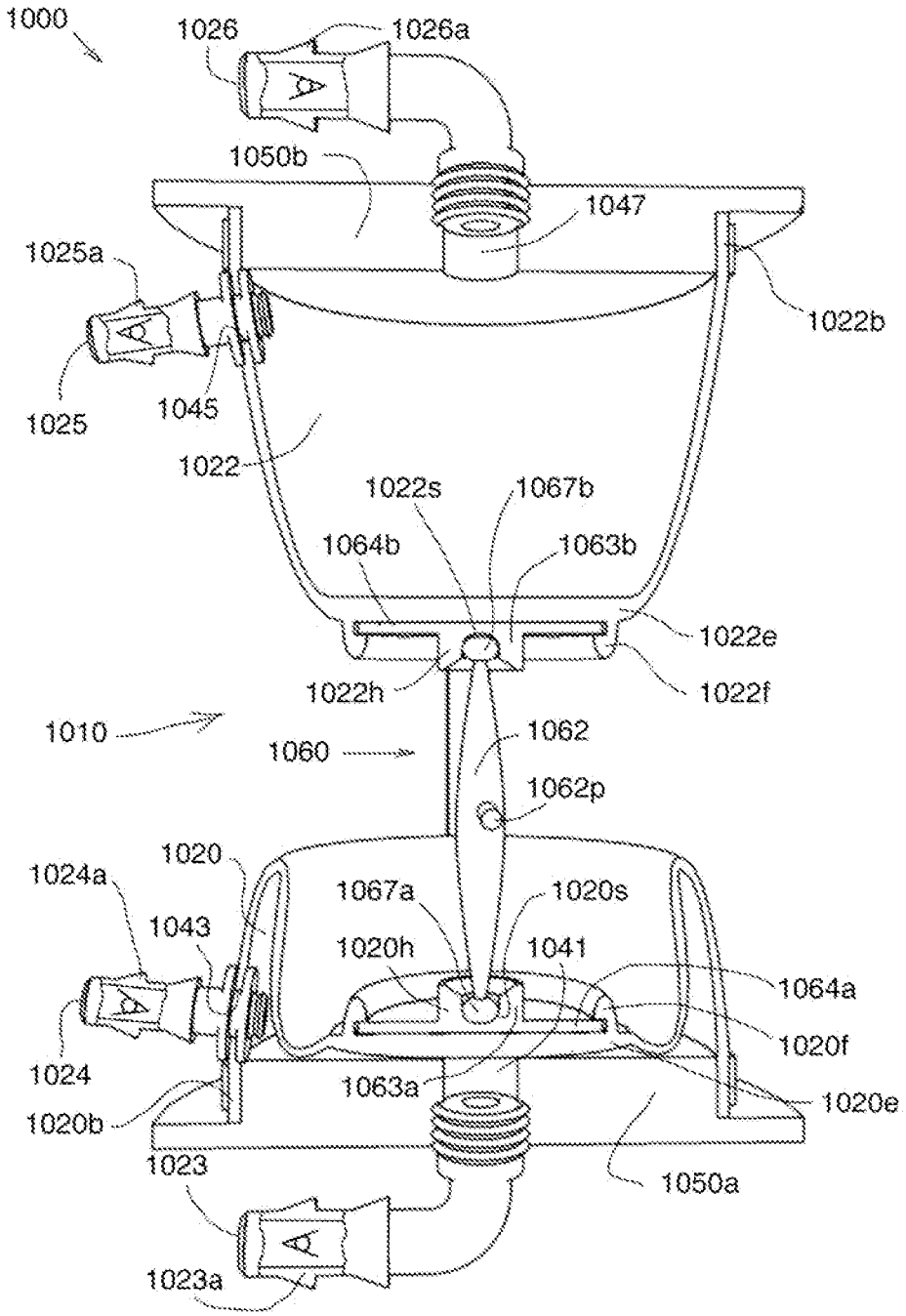
FIG. 39 is a sectional side elevational view similar to FIG. 38, but with the resiliently deformable liquid pumping member in its reduced configuration and the resiliently deformable vapor pumping member is in its full configuration.

The selectively controllable actuation mechanism 1060 further comprises a biasing means in the form of a spring member 1068*a* operatively acting on one of the selectively controllable actuation mechanism 1060 and the liquid and vapor pumping means 1010 for biasing the liquid pumping portion 1020 to the full configuration. In the tenth preferred embodiment, as illustrated, the spring member 1068*a* comprises an extension coil spring 1068*a* operatively interposed between the base member 1050*b* and the pedal member 1069 such that the spring member 1068*a* biases the pedal member 1069 upwardly, thereby biasing the liquid pumping portion 1020 to the full configuration, as shown in FIG. 38, whereat the coil spring 1068*a* is in a neutral configuration. In the full configuration of the vapor pumping portion 1022, the coil spring 1068 is extended by the downward actuation of the pedal member 1069.

Reference will now be made to FIGS. 40 through 42, which show an eleventh preferred embodiment of the portable fluid exchange system of the present invention, as indicated by general reference numeral 1100. The eleventh preferred embodiment portable fluid exchange system 1100 is similar to the first preferred embodiment of the portable fluid exchange system 100 of the present invention, with many elements being in common. Accordingly, elements in the eleventh preferred embodiment portable fluid exchange system 1100 that are common to, and essentially the same as, elements in the first preferred embodiment of the portable fluid exchange system 100, will not necessarily be specifically discussed with reference to the eleventh preferred embodiment portable fluid exchange system 1100, for the sake of brevity. Similar numbering has been used between the two embodiments to indicate commonality of functioning parts within each embodiment. For example, the liquid pumping portion 1120 of the eleventh preferred embodiment will be similar in function to the liquid pumping portion 120 of the first preferred embodiment, and so on. Generally, only the significant differences between the eleventh preferred embodiment portable fluid exchange system 1100, and the first preferred embodiment of the portable fluid exchange system 100, will be discussed.

In the eleventh preferred embodiment portable fluid exchange system 1100, the actuation means 1160 is movable in a rotary motion to actuate the liquid and vapor pumping means 1110 and comprises at least one peristaltic type pumping mechanism, and more specifically comprises a peristaltic type pump 1110 having an outer housing 1150 with a resiliently deformable liquid pumping tube 1120 and a resiliently deformable vapor pumping tube 1122 passing through the outer housing 1150. A cover plate 1151 is shown removed from the outer housing 1150 for the sake of clarity.

The resiliently deformable liquid pumping tube has a liquid inlet 1123 and a liquid outlet 1124. The resiliently deformable liquid pumping tube 1120 is secured in liquid receiving relation at its liquid inlet end 1120*a* with a barbed hose fitting 1123*a* by a leakproof seal and is secured in liquid delivery relation at its liquid outlet end 1120*b* with a barbed hose fitting 1124*a* by a leakproof seal. Similarly, the resiliently deformable vapor pumping tube 1122 has a vapor inlet 1125 and a vapor outlet 1126. The resiliently deformable vapor pumping tube 1122 is secured in vapor receiving relation at its vapor inlet end 1122*a* with a barbed hose fitting 1125*a* by a leakproof seal and is secured in vapor delivery relation at its vapor outlet end 1122*b* with barbed hose fitting 1126*a* by a leakproof seal.

The selectively controllable actuation mechanism, as indicated by the general reference numeral 1160, comprises a rotor member 1162 having four arm members 1163 with roller members 1163*b* mounted in freely rotatable relation on the outer end of each of the arm members 1163, mounted within the outer housing 1150 by means of a central axle member 1166. A handle member 1170 is securely connected to the central axle member 1166 by means of a crank arm 1171 for rotation therewith to permit selective rotation of the rotor member 1162.

A threaded cap 1158 with an interior thread 1159, and a collar member 1158*a* with an internal thread 1159*a* that is compatible with the threaded shoulder 1159*b* on the outer housing 1150 of the portable fluid exchange system 1100. The threaded cap 1158 and the collar member 1158*a* together allow the portable fluid exchange system 1100 to be attachable to the source container 1102 at its mouth 1103, in an air tight leak proof manner such that the liquid inlet 1123 and the vapor outlet 1126 are in fluid communication with the interior of the source container 1102.

In use, rotation of the handle member 1170 causes corresponding rotation of the rotor member 1162 in a counterclockwise direction, and showing in FIGS. 41 and 42, thereby causing the roller member 1163*b* to pump liquid through the resiliently deformable liquid pumping tube 1120 in the direction as indicated by arrow "D", from the source container 1102 to the destination container 1104, and to concurrently pump vapor through the resiliently deformable vapor pumping tube 1122 in the direction as indicated by arrow "E", from the destination container 1104 to the source container 1102.

Reference will now be made to FIGS. 43 through 44, which show a twelfth preferred embodiment of the portable fluid exchange system of the present invention, as indicated by general reference numeral 1200. The twelfth preferred embodiment portable fluid exchange system 1200 is similar to the eleventh preferred embodiment of the portable fluid exchange system 1100 of the present invention, with many elements being in common. Accordingly, elements in the twelfth preferred embodiment portable fluid exchange system 1200 that are common to, and essentially the same as, elements in the eleventh preferred embodiment of the portable fluid exchange system 1100, will not necessarily be specifically discussed with reference to the twelfth preferred embodiment portable fluid exchange system 1200, for the sake of brevity. Similar numbering has been used between the two embodiments to indicate commonality of functioning parts within each embodiment. For example, the liquid pumping portion 1220 of the twelfth preferred embodiment will be similar in function to the liquid pumping portion 1120 of the eleventh preferred embodiment, and so on. Generally, only the significant differences between the twelfth preferred embodiment portable fluid exchange system 1200, and the eleventh preferred embodiment of the portable fluid exchange system 1100, will be discussed.

In the twelfth preferred embodiment portable fluid exchange system 1200, the liquid and vapor pumping means 1210 comprises a first rotary pump 1211 and a second rotary pump 1212 physically secured together by means of bolts 1214. The first rotary pump 1211 is a liquid pumping mechanism and the second rotary pump 1212 is a vapor pumping mechanism.

The first rotary pump 1211 has a liquid inlet 1223 and a liquid outlet 1224. A barbed hose fitting 1223*a* is threadably engaged onto the first rotary pump 1211 at the liquid inlet 1223. A barbed hose fitting 1224*a* is threadably engaged onto the first rotary pump 1211 at the liquid outlet 1224. Similarly, the second rotary pump 1212 has a vapor inlet 1225 and a vapor outlet 1226. A barbed hose fitting 1225*a* is threadably engaged onto the second rotary pump 1212 at the vapor inlet 1225. A barbed hose fitting 1226*a* is threadably engaged onto the second rotary pump 1212 at the vapor outlet 1226.

The selectively controllable actuation mechanism, as indicated by the general reference numeral 1260, is movable in a rotary motion to actuate the liquid and vapor pumping means 1210. A handle member 1270 is securely connected to a central axle member 1266 for rotation therewith to permit selective concurrent actuation of the liquid pumping mechanism 1211 and a vapor pumping mechanism 1212.

In use, rotation of the handle member 1270 such that the internal pumping mechanism of the liquid pumping mechanism 1211 and the internal pumping mechanism of the vapor pumping mechanism 1212 are correspondingly rotated in a counterclockwise direction, and showing in FIG. 44, thereby causing the liquid pumping mechanism 1211 to pump liquid in a direction as indicated by arrow "F", from the source container 1202 to the destination container 1204, and the vapor pumping mechanism 1212 to pump vapor in a direction as indicated by arrow "G", from the destination container 1204 to the source container 1202.

Reference will now be made to FIG. 45, which shows a thirteenth preferred embodiment of the portable fluid exchange system of the present invention, as indicated by general reference numeral 1300. The thirteenth preferred embodiment portable fluid exchange system 1300 is similar to the eleventh preferred embodiment of the portable fluid exchange system 1100 of the present invention, with many elements being in common. Accordingly, elements in the thirteenth preferred embodiment portable fluid exchange system 1300 that are common to, and essentially the same as, elements in the eleventh preferred embodiment of the portable fluid exchange system 1100, will not necessarily be specifically discussed with reference to the thirteenth preferred embodiment portable fluid exchange system 1300, for the sake of brevity. Similar numbering has been used between the two embodiments to indicate commonality of functioning parts within each embodiment. For example, the liquid pumping portion 1320 of the thirteenth preferred embodiment will be similar in function to the liquid pumping portion 1120 of the eleventh preferred embodiment, and so on. Generally, only the significant differences between the thirteenth preferred embodiment portable fluid exchange system 1300, and the eleventh preferred embodiment of the portable fluid exchange system 1100, will be discussed.

In the thirteenth preferred embodiment portable fluid exchange system 1300, the liquid and vapor pumping means comprises a liquid pumping portion 1320, which more specifically comprises a resiliently deformable liquid pumping member 1320 having a substantially hollow interior 1316 for receiving liquid thereinto, and a vapor pumping portion 1322, which more specifically comprises a resiliently deformable vapor pumping member 1322 having a substantially hollow interior 1317 for receiving vapor thereinto.

The resiliently deformable liquid pumping member 1320 has a liquid inlet 1323 and a liquid outlet 1324, with a barbed hose fitting 1323*a* threadably engaged onto the liquid inlet 1323 of the resiliently deformable liquid pumping member 1320, and a barbed hose fitting 1324*a* threadably engaged onto the liquid outlet 1324 of the resiliently deformable liquid pumping member 1320. Similarly, the resiliently deformable vapor pumping member has a vapor inlet 1325 and a vapor outlet 1326, with a barbed hose fitting 1325*a* threadably engaged onto the vapor inlet 1325 of the resiliently deformable vapor pumping member 1322, and a barbed hose fitting 1326*a* threadably engaged onto the vapor outlet 1326 of the resiliently deformable vapor pumping member 1322.

The selectively controllable actuation mechanism, as indicated by the general reference numeral 1360, is movable in a rotary motion to actuate the liquid and vapor pumping means 1310. A handle member 1370 is securely connected via a generally vertically disposed extension arm 1371 to an axle member 1366 disposed of the bottom of the source container 1302. A liquid pumping plate 1320*p* extends outwardly from the extension arm 1371 to contact the resiliently deformable liquid pumping member 1320. Similarly, a vapor pumping plate 1322*p* extends outwardly from the extension arm 1371 to contact the resiliently deformable vapor pumping member 1322. It can therefore be seen that the selectively controllable actuation mechanism is for selectively actuating the resiliently deformable liquid pumping member 1320 and a resiliently deformable vapor pumping member 1322, to thereby concurrently pump liquid from the resiliently deformable liquid pumping member 1320 through the liquid outlet 1324 and vapor into the resiliently deformable vapor pumping member 1322 through the vapor inlet 1325, and concurrently pump vapor from the resiliently deformable vapor pumping member 1322 through the vapor outlet 1326 and liquid into the resiliently deformable liquid pumping member 1320 through the liquid inlet 1323.

In use, back and forth movement of the handle member 1370, as indicated by arrows "H" and "I", causes the pumping action of the resiliently deformable liquid pumping member 1320 and the resiliently deformable vapor pumping member 1322. More specifically, when the handle member 1370 is moved in the direction of arrow "H", the resiliently deformable liquid pumping member 1320 is deformed from its full configuration towards its reduced configuration, and concurrently the resiliently deformable vapor pumping member 1322 is deformed from its reduced configuration towards its full configuration. Similarly, when the handle member 1370 is moved in the direction of arrow "I", the resiliently deformable liquid pumping member 1320 is deformed from its reduced configuration towards its full configuration, and concurrently the resiliently deformable vapor pumping member 1322 is deformed from its full configuration towards its reduced configuration.

Reference will now be made to FIGS. 46 and 47, which shows a fourteenth preferred embodiment of the portable fluid exchange system of the present invention, as indicated by general reference numeral 1400. The fourteenth preferred embodiment portable fluid exchange system 1400 is similar to the thirteenth preferred embodiment of the portable fluid exchange system 1300 of the present invention, with many elements being in common. Accordingly, elements in the fourteenth preferred embodiment portable fluid exchange system 1400 that are common to, and essentially the same as, elements in the thirteenth preferred embodiment of the portable fluid exchange system 1300, will not necessarily be specifically discussed with reference to the fourteenth preferred embodiment portable fluid exchange system 1400, for the sake of brevity. Similar numbering has been used between the two embodiments to indicate commonality of functioning parts within each embodiment. For example, the liquid pumping portion 1420 of the fourteenth preferred embodiment will be similar in function to the liquid pumping portion 1320 of the thirteenth preferred embodiment, and so on. Generally, only the significant differences between the fourteenth preferred embodiment portable fluid exchange system 1400, and the thirteenth preferred embodiment of the portable fluid exchange system 1300, will be discussed.

In the fourteenth preferred embodiment portable fluid exchange system 1400, the liquid and vapor pumping means comprises a liquid pumping portion 1420, which comprises a resiliently deformable liquid pumping member 1416 having a substantially hollow interior 1416 for receiving liquid thereinto, and a resiliently deformable vapor pumping member 1422 having a substantially hollow interior 1417 for receiving vapor thereinto.

The selectively controllable actuation mechanism, as indicated by the general reference numeral 1460, is movable in a rotary motion to actuate the liquid and vapor pumping means 1410, and comprises a selectively controllable actuation mechanism comprises a selectively rotatable cam member 1462 rotatably mounted on the source container 1402. A handle member 1470 is securely connected to selectively rotatable cam member 1462 for rotation therewith.

In use, rotating movement of the selectively rotatable cam member 1462, as indicated by arrows "J", causes the pumping action of the resiliently deformable liquid pumping member 1420 and the resiliently deformable vapor pumping member 1422. More specifically, when the handle member 1470 is turned in the direction of arrows "J", or even in the opposite direction, the resiliently deformable liquid pumping member 1420 is deformed from its full configuration (shown in FIG. 47) towards its reduced configuration (shown in FIG. 46), and concurrently the resiliently deformable vapor pumping member 1422 is deformed from its reduced configuration (shown in FIG. 47) towards its full configuration (shown in FIG. 46).

Reference will now be made to FIGS. 48A through 48D, which show a fifteenth preferred embodiment of the portable fluid exchange system of the present invention, as indicated by general reference numeral 1500. The fifteenth preferred embodiment portable fluid exchange system 1500 is similar to the tenth preferred embodiment of the portable fluid exchange system 1000 of the present invention, with many elements being in common. Accordingly, elements in the fifteenth preferred embodiment portable fluid exchange system 1500 that are common to, and essentially the same as, elements in the tenth preferred embodiment of the portable fluid exchange system 1000, will not necessarily be specifically discussed with reference to the fifteenth preferred embodiment portable fluid exchange system 1500, for the sake of brevity. Similar numbering has been used between the two embodiments to indicate commonality of functioning parts within each embodiment. For example, the liquid pumping resiliently deformable force cup 1520 of the fifteenth preferred embodiment will be similar in function to the liquid pumping resiliently deformable force cup 1020 of the tenth preferred embodiment, and so on. Generally, only the significant differences between the fifteenth preferred embodiment portable fluid exchange system 1500, the tenth preferred embodiment of the portable fluid exchange system 1000 will be discussed.

The source container 1502 comprises a generally "C"-shaped main body portion 1502*b* having a top handle 1502*h* and an opening sealed by a container cap 1502*m* disposed immediately forwardly of the top handle 1502*h*. The floor 1502*f* of the source container 1502 is substantially flat with a short leg member 15021 disposed at the back end thereof to tilt the container forward so as to encourage liquid within the container to flow towards the pump. The generally "C"-shaped main body portion 1502*b* defines an angled slot 1502*s* having a top surface 1502*st* and a bottom surface 1502*sb*, into which the liquid and vapor pumping means 1510 is received and retained. The angled slot 1502*s* comprises an upper circular support feature 1550*b* molded into the top surface 1502*st*. The upper circular support feature 1550*b* is integrally molded within the container material, which would typically be blow molded. The upper circular support feature 1550*b* has a central aperture 1502*ca*1 in the wall of the container 1502 where a vapor passageway fitting 1502*vp* is securely attached in sealed relation to the container 1502. The open end 1522*b* of the vapor pumping resiliently deformable force cup 1022 is securely attached to the circular support feature 1550*b*, in a manner that would provide a leak proof seal, via bonding or such mechanical means as a hose clamp. The vapor passageway fitting 1502*vp* comprises throughpassage 1547 which enables fluid communication between the interior 1500*h* of the source container 1502 and the interior of the vapor pumping resiliently deformable force cup 1522. The throughpassage 1547 allows the vapor being pumped into the vapor pumping resiliently deformable force cup 1022 to be transferred from the vapor pumping resiliently deformable force cup 1022 into the sources container 1502 as the liquid an vapor pumping means 1510 is pumped.

The vapor passageway fitting 1502*vp* or throughpassage 1547 would comprises a check valve means operatively connected to preclude fluid flow from the container 1502 through the throughpassage 1547 and back into the vapor pumping resiliently deformable force cup 1022.

Similarly, there is a lower circular support feature 1550*a* molded into the bottom surface 1502*sb* of the angled slot 1502*s*. The lower circular support feature 1550*a* is also integrally molded within the container material. The lower circular support feature 1550*a* has a central aperture 1502*ca*2 in the wall of the container 1502 where a liquid passageway fitting 15021*p* is securely attached in sealed relation to the container 1502. The open end 1520*b* of the liquid pumping resiliently deformable force cup 1520 is securely attached to the circular support feature 1550*a*, in a manner that would provide a leak proof seal, via bonding or such mechanical means as a hose clamp. The liquid passageway fitting 15021P comprises throughpassage 1541, which enables fluid communication between the interior 1500*h* of the source container 1502 and the interior of the liquid pumping resiliently deformable force cup 1520. The throughpassage 1541 allows liquid within the source container 1502 to pass into the liquid pumping resiliently deformable force cup 1520 as the liquid an vapor pumping means 1510 is pumped. The liquid passageway fitting 15021*p* also comprises a barbed hose end 1523*a* disposed within the interior 1500*h* of the container 1502 where a liquid extension hose 1506' is attached so as to extend the liquid inlet 1523 of the liquid an vapor pumping means 1510 to the bottom of the container so that the liquid pumping resiliently deformable force cup 1520 can draw in liquid from the lowest point within the source container 1502.

One of the liquid passageway fitting 15021*p*, the throughpassage 1541, the barbed hose end 1523*a*, the liquid extension hose 1506', and so on, would comprises a check valve means operatively connected to preclude fluid flow from the liquid pumping resiliently deformable force cup 1520 through the throughpassage 1541 and back into the container 1502.

The pedal member 1569 is part of the actuation mechanism 1560, and is connected at its central area in freely pivoting relation to a pin member 1562*p* on the connector arm 1562, to permit the pedal member 1069 to be used to actuate the portable fluid exchange system 1500. The pedal member 1569 is also mounted in freely pivoting relation to the main body portion 1502*b* by means of an enlarged axle portion 1569*a* received within at generally cylindrical slot 1502*cs* molded in the main body portion 1502*b* at the back of the angled slot 1502*s*. The pedal member 1569 has a lowered front portion 1569*f* for receiving a person's foot thereon.

As can be understood from the above description and from the accompanying drawings, the present invention provides a portable fluid exchange system for concurrently pumping liquid from a source container to a destination container and pumping vapor from said destination container to said source container, wherein the portable fluid exchange system can be manually powered, wherein the portable fluid exchange system is inexpensive to manufacture, wherein the portable fluid exchange system does not need to be powered by electricity, wherein the portable fluid exchange system is simple and uncomplicated, wherein the portable fluid exchange system does not require feedback in order to operate, wherein the pumping of vapor does not rely on certain conditions of the liquid flow to exist and be measured, wherein the recovery of vapor is not dependent on the negative pressure within the portable fuel container, wherein there is no significant delay in time between the fuel flowing out of the portable fuel container and the vapor being recovered into the container, and wherein the portable fluid exchange system is manually transportable by a single individual, all of which features are unknown in the prior art.

The portable fluid exchange system discussed with respect to the present invention could be used for the exchange of fuel such as gasoline, diesel, kerosene, and so on. Further, one skilled in the art will readily recognize that such a portable fluid exchange system as disclosed herein could readily be used for any fluid (vapor or liquid) for example water, alcohol such as wine, beer, and liquor, various chemicals, and so on.

It is intended that the liquid and vapor pumping means of this invention be a part of a closed system consisting of a container in fluid communication with the liquid and vapor pumping means where the liquid exiting the container and vapor entering the container is solely controlled by the liquid and vapor pumping means. In such a closed system where liquid is being removed from a container and vapor is being introduced into the container it would be ideal that the volume of liquid being removed equal the volume of vapor being introduced because this balance between the volume of liquid and the volume of vapor would prevent any build up of positive or negative pressures within the container but this is not always a requirement.

The compressible nature of vapor would allow the liquid and vapor pumping means of the present invention to safely pump a bit more liquid or a bit more vapor than liquid. The vapor being introduced into the closed system is significantly more compressible than the liquid being removed. As well, it is the nature of containers to be able to support and or withstand certain amounts of both negative and positive pressure and it is suggested here that such a liquid and vapor pumping means which pumps a bit more liquid than vapor or a liquid and vapor pumping means, which pumps a bit more vapor than liquid can be safely incorporated into such a closed system as long as the overall design is careful not exceed the container abilities to withstand the maximum negative or positive pressures created within by such a pump.

It will be readily understood by one of ordinary skill in the art that any of the embodiments of the portable fluid exchange system according to the present invention could have its various components made from any number of materials, which include but are not limited to plastic, metal, moldable resin, and so on, and wherein any of the characteristic features of each component be it barbed hose ends, fittings, guides, fins, and so on, can be integrally molded or affixed via any number of numerous means to their associated part.

As can be readily ascertained from the above detailed description, the president invention provides a portable fluid exchange system with a vapor recovery ability that functions even when the source container is pressurized from, for example, heating up when sitting in the sun. For instance, in the realm of known prior art fuel containers, an internal negative pressure within the fuel container is necessary in order to recover vapor. This means of vapor recovery has the opportunity of being ineffective at recovering all or the majority of the vapor due to delays in the build up of an adequate vacuum pressure within the container as previously discussed. This type of vapor recovery process requires first that the internal pressure within the container be relieved and then that vacuum pressure building up within the container be enough to overcome the head pressure of the liquid still in the container.

The portable fluid exchange system of the present invention has the ability to concurrently pump liquid and vapor, which provides a vapor recovery means wherein there is no delay in the vapor recovery process. Vapor is always pumped into the source container as the liquid and vapor pumping means is pumping. This vapor pumping feature provides the present portable fluid exchange system with the most effective vapor recovery performance.

Other variations of the above principles will be apparent to those who are knowledgeable in the field of the invention, and such variations are considered to be within the scope of the present invention. Further, other modifications and alterations may be used in the design and manufacture of the portable fluid exchange system of the present invention without departing from the spirit and scope of the accompanying claims.

I claim:

1. A portable fluid exchange system for concurrently pumping liquid from a source container to a destination container and pumping vapor from said destination container to said source container, said portable fluid exchange system comprising:

a source container having a substantially hollow interior for retaining liquid and vapor therein;

a liquid and vapor pumping means for pumping liquid from said source container to said destination container and for pumping vapor from said destination container to said source container, and having a liquid inlet, a liquid outlet, a vapor inlet and a vapor outlet;

wherein said liquid inlet and said vapor outlet of said liquid and vapor pumping means are connected in fluid communication with said substantially hollow interior of said source container;

liquid delivery means for delivering liquid from said liquid and vapor pumping means to said destination container;

vapor delivery means for delivering vapor from said destination container to said liquid and vapor pumping means; and, a selectively controllable actuation mechanism for actuating said liquid and vapor pumping means to thereby concurrently pump liquid from said liquid and vapor pumping means through said liquid outlet and vapor into said liquid and vapor pumping means through said vapor inlet, and concurrently pump vapor from said liquid and vapor pumping means through said vapor outlet and liquid into said liquid and vapor pumping means through said liquid inlet.

2. The portable fluid exchange system of claim 1, wherein said liquid and vapor pumping means comprises a liquid pumping portion and a vapor pumping portion fluidically isolated one from the other.

3. The portable fluid exchange system of claim 2, wherein said selectively controllable actuation mechanism concurrently pumps vapor from said vapor pumping portion through said vapor outlet and liquid into said liquid pumping portion through said liquid inlet, and alternatingly concurrently pumps liquid from said liquid pumping portion through said liquid outlet and vapor into said vapor pumping portion through said vapor inlet.

4. The portable fluid exchange system of claim 3, wherein said liquid pumping portion and said vapor pumping portion are fluidically isolated one from the other by a pumping mechanism movable to vary the internal volume of each of said liquid pumping portion and said vapor pumping portion.

5. The portable fluid exchange system of claim 4, wherein the internal volume of said liquid pumping portion is variable, via pumping movement of said pumping mechanism, between a full configuration and a reduced configuration wherein the internal volume of said liquid pumping portion is less than in the full configuration.

6. The portable fluid exchange system of claim 5, wherein the internal volume of said vapor pumping portion is variable, via pumping movement of said pumping mechanism, between a full configuration and a reduced configuration wherein the internal volume of said vapor pumping portion is less than in the full configuration.

7. The portable fluid exchange system of claim 4, wherein said liquid and vapor pumping means comprises a main body having a substantially hollow chamber.

8. The portable fluid exchange system of claim 7, wherein said pumping mechanism comprises a movable pumping member disposed within said substantially hollow chamber so as to divide said substantially hollow chamber into said variable volume liquid pumping portion and said variable volume vapor pumping portion.

9. The portable fluid exchange system of claim 8, wherein said movable pumping member comprises a piston.

10. The portable fluid exchange system of claim 9, wherein said selectively controllable actuation mechanism comprises a piston rod member operatively connected to said piston.

11. The portable fluid exchange system of claim 10, wherein said piston rod member includes a throughpassage that permits said variable volume liquid pumping portion to be in fluid communication with one of said liquid inlet and said liquid outlet.

12. The portable fluid exchange system of claim 10, wherein said piston rod member includes a throughpassage that permits said variable volume vapor pumping portion to be in fluid communication with one of said vapor inlet and said vapor outlet.

13. The portable fluid exchange system of claim 4, wherein said pumping mechanism comprises a resiliently deformable pumping member disposed within said substantially hollow chamber so as to divide said substantially hollow chamber into said variable volume liquid pumping portion and said variable volume vapor pumping portion.

14. The portable fluid exchange system of claim 13, wherein said selectively controllable actuation mechanism comprises a rod member operatively connected to said resiliently deformable pumping member.

15. The portable fluid exchange system of claim 14, wherein said rod includes a throughpassage that permits said variable volume liquid pumping portion to be in fluid communication with one of said liquid inlet and said liquid outlet.

16. The portable fluid exchange system of claim 14, wherein said rod includes a throughpassage that permits said variable volume vapor pumping portion to be in fluid communication with one of said vapor inlet and said vapor outlet.

17. The portable fluid exchange system of claim 14, further comprising a plate member secured to said resiliently deformable pumping member for movement therewith and wherein said rod member is operatively connected to said plate member for movement therewith.

18. The portable fluid exchange system of claim 13, wherein said resiliently deformable pumping member comprises a bellows member.

19. The portable fluid exchange system of claim 1, wherein said liquid and vapor pumping means comprises a liquid pumping means having said liquid inlet and said liquid outlet, and a vapor pumping means having said vapor inlet and said vapor outlet.

20. The portable fluid exchange system of claim 19, wherein said selectively controllable actuation mechanism concurrently pumps vapor from said vapor pumping means through said vapor outlet and liquid into said liquid pumping means through said liquid inlet, and alternatingly concurrently pumps liquid from said liquid pumping means through said liquid outlet and vapor into said vapor pumping means through said vapor inlet.

* * * * *